US010159616B2

(12) United States Patent
Newkirk et al.

(10) Patent No.: US 10,159,616 B2
(45) Date of Patent: Dec. 25, 2018

(54) MODULAR WALL FOR DIVIDING ROOMS IN A HEALTHCARE FACILITY

(71) Applicant: Wittrock Enterprises LLC, Cincinnati, OH (US)

(72) Inventors: David C. Newkirk, Lawrenceburg, IN (US); Dennis J. Gallant, Harrison, OH (US); Brian J. Hoffman, Lawrenceburg, IN (US); Steven R. Westerfeld, Holton, IN (US); Sebastian Moster, Batesville, IN (US); Joseph H. Abel, New Palestine, IN (US)

(73) Assignee: WITTROCK ENTERPRISES LLC, Cincinnati, OH (US)

( * ) Notice: Subject to any disclaimer, the term of this patent is extended or adjusted under 35 U.S.C. 154(b) by 0 days.

(21) Appl. No.: 14/553,027

(22) Filed: Nov. 25, 2014

(65) Prior Publication Data

US 2015/0075085 A1 Mar. 19, 2015

Related U.S. Application Data

(63) Continuation of application No. 14/141,879, filed on Dec. 27, 2013, which is a continuation of application (Continued)

(51) Int. Cl.

*E04B 2/72* (2006.01)
*E04B 2/74* (2006.01)

(Continued)

(52) U.S. Cl.

CPC ..... *A61G 12/005* (2013.01); *E04C 2/521* (2013.01); *E04F 19/08* (2013.01); *E04H 3/08* (2013.01);

(Continued)

(58) Field of Classification Search

CPC . E04B 2/72; E04B 2/74; E04B 2/7488; E04B 2002/7488; E04B 2002/7461;

(Continued)

(56) References Cited

U.S. PATENT DOCUMENTS 2,526,727 A 10/1950 Bull
2,998,508 A 5/1959 Bobrick (Continued)

FOREIGN PATENT DOCUMENTS

DE 32 08 934 A1 9/1983
EP 0 715 037 A1 6/1996
GB 1 232 515 A 5/1971

OTHER PUBLICATIONS

Allen, D. R., "Prefab Utility Walls Save Up-Front Costs," Home Energy Magazine Online, Mar./Apr. 1999, downloaded May 7, 2018 from http://homeenergy.org/show/article/id/1457, 7 pgs.

(Continued)

*Primary Examiner* — Andrew J Triggs
(74) *Attorney, Agent, or Firm* — Frost Brown Todd LLC

(57) ABSTRACT

A modular architectural wall system for a patient room may support accessories and include panels. The architectural wall system may include gas outlets and electrical outlets mounted to a surface of the architectural wall system.

20 Claims, 49 Drawing Sheets

Related U.S. Application Data

No. 12/578,848, filed on Oct. 14, 2009, now Pat. No. 8,640,391.

(60) Provisional application No. 61/196,241, filed on Oct. 16, 2008.

(51) Int. Cl.

| | |
|---|---|
| ***A61G 12/00*** | (2006.01) |
| ***E04F 19/08*** | (2006.01) |
| ***E04H 3/08*** | (2006.01) |
| ***E04C 2/52*** | (2006.01) |

(52) U.S. Cl.

CPC ..... *A61G 2205/10* (2013.01); *E04B 2/72* (2013.01); *E04B 2/74* (2013.01); *E04B 2002/7461* (2013.01); *E04B 2002/7462* (2013.01); *E04B 2002/7477* (2013.01); *E04B 2002/7488* (2013.01)

(58) Field of Classification Search

CPC ..... E04B 2002/7462; E04B 2002/7477; E04C 2/521; A61G 12/002; A61G 12/005; Y10S 248/909

See application file for complete search history.

(56) References Cited

U.S. PATENT DOCUMENTS 3,088,178 A 5/1963 Propst
3,095,625 A 7/1963 Propst
3,430,997 A 3/1969 Propst et al.
3,443,350 A 5/1969 Birum, Jr.
3,461,349 A 8/1969 Meyer
3,462,892 A * 8/1969 Meyer ..... E04B 2/76 174/480
3,556,455 A 1/1971 Storm et al.
3,567,842 A 3/1971 Meyer
3,609,211 A 9/1971 Van Herk
3,660,591 A 5/1972 Schultz et al.
D226,353 S 2/1973 Schultz et al.
3,769,502 A 10/1973 Schultz et al.
4,065,898 A 1/1978 Munk
4,104,710 A * 8/1978 Damico ..... A47B 79/00 174/501
4,155,609 A 5/1979 Skafte et al.
D261,804 S 11/1981 Foster et al.
4,338,485 A * 7/1982 Fullenkamp ..... A47B 79/00 174/501
4,353,411 A 10/1982 Harter
4,354,330 A 10/1982 Schwartz
4,452,499 A 6/1984 Verburg
4,523,683 A 6/1985 Fullenkamp et al.
4,559,410 A 12/1985 Hostetter
4,574,963 A 3/1986 Fullenkamp et al.
4,589,557 A 5/1986 Bollmann
4,610,118 A 9/1986 Fullenkamp
4,632,591 A 12/1986 Fullenkamp
4,646,211 A 2/1987 Gallant et al.
4,662,524 A 5/1987 Fullenkamp et al.
4,720,768 A 1/1988 Schindele
4,725,030 A 2/1988 Miller et al.
4,738,369 A 4/1988 Desjardins
4,753,055 A 6/1988 Durham, Jr.
4,754,584 A 7/1988 Newton, II
4,807,659 A 2/1989 Schindele
4,821,470 A * 4/1989 Kappers ..... H02G 3/0431 174/480
D302,502 S 8/1989 Durham, Jr.
4,869,378 A 9/1989 Miller
D303,743 S 10/1989 Durham, Jr.
D303,889 S 10/1989 Durham, Jr.
4,905,433 A 3/1990 Miller
4,993,683 A 2/1991 Kreuzer
5,209,035 A * 5/1993 Hodges ..... E04B 2/7425 52/220.7
5,247,962 A 9/1993 Walker
5,277,005 A 1/1994 Hellwig et al.
5,341,615 A * 8/1994 Hodges ..... E04B 2/7425 52/220.7
5,381,994 A * 1/1995 Welch ..... E04B 2/7422 160/135
5,403,232 A * 4/1995 Helm ..... E04B 2/7425 454/230
5,448,859 A 9/1995 Walker et al.
5,513,574 A 5/1996 Collins
5,619,076 A 4/1997 Layden et al.
5,642,593 A * 7/1997 Shieh ..... E04B 2/7424 160/130
5,644,876 A * 7/1997 Walker ..... A61G 13/107 211/26
5,778,612 A 7/1998 Kissinger et al.
5,813,178 A * 9/1998 Edwards ..... E04B 2/7416 160/35
5,816,001 A * 10/1998 Goodman ..... A47B 57/425 52/220.7
5,839,240 A * 11/1998 Elsholz ..... E04B 2/7433 52/126.3
5,852,904 A 12/1998 Yu et al.
5,878,536 A 3/1999 Demmitt et al.
5,890,326 A 4/1999 Gallant et al.
5,899,036 A * 5/1999 Seiber ..... A47B 57/425 52/126.4
5,901,512 A * 5/1999 Bullwinkle ..... H02G 3/288 174/495
5,911,661 A 6/1999 Murray et al.
5,930,963 A * 8/1999 Nichols ..... E04B 2/7422 52/239
5,950,386 A * 9/1999 Shipman ..... A47B 57/425 52/239
5,953,871 A * 9/1999 MacConnell ..... E04B 2/7451 52/220.1
5,961,193 A 10/1999 Hobbs
6,003,273 A 12/1999 Elsholz et al.
6,009,675 A * 1/2000 Waalkes ..... A47B 21/06 52/127.11
6,009,676 A * 1/2000 Feldpausch ..... A47B 57/425 52/239
6,021,613 A * 2/2000 Reuter ..... A47B 21/06 52/238.1
6,023,893 A * 2/2000 Tanaka ..... E04B 2/7422 52/220.7
6,023,896 A * 2/2000 Rothschild ..... E04B 2/824 52/243.1
6,047,508 A * 4/2000 Goodman ..... E04B 2/745 52/220.7
6,076,308 A * 6/2000 Lyon ..... A47B 21/00 52/239
6,079,173 A * 6/2000 Waalkes ..... E04B 2/7433 211/192
6,088,980 A 7/2000 Gulliver
6,094,875 A * 8/2000 Laine ..... E04B 2/7453 52/126.3
6,098,358 A * 8/2000 Waalkes ..... E04B 2/7433 52/239
6,115,977 A * 9/2000 Hornberger ..... A47B 95/008 52/238.1
6,128,877 A * 10/2000 Goodman ..... E04B 2/7457 160/135
6,131,347 A * 10/2000 Hornberger ..... A47B 95/008 52/238.1
6,134,845 A * 10/2000 Shipman ..... A47B 57/425 52/239
6,134,852 A * 10/2000 Shipman ..... A47B 57/425 52/220.7
6,145,253 A * 11/2000 Gallant ..... A61G 12/005 52/220.1
6,148,567 A * 11/2000 DeRuiter ..... E04B 2/7422 52/239

(56) References Cited

U.S. PATENT DOCUMENTS 6,167,664 B1 * 1/2001 Reuter ..... A47B 21/06 160/135
6,167,665 B1 1/2001 Dame et al.
6,167,676 B1 * 1/2001 Shipman ..... A47B 57/425 52/745.1
6,201,687 B1 * 3/2001 Murray ..... A47B 21/06 174/498
6,230,445 B1 * 5/2001 Arko ..... E04B 2/7416 211/90.02
6,230,459 B1 * 5/2001 Jeffers ..... E04B 2/7433 52/239
6,231,526 B1 5/2001 Taylor et al.
D443,365 S 6/2001 Walker
6,253,509 B1 * 7/2001 Hellwig ..... E04B 2/7422 52/220.7
6,256,935 B1 7/2001 Walker
6,256,936 B1 7/2001 Swensson et al.
6,256,941 B1 * 7/2001 Yu ..... E04B 2/7433 181/284
6,260,324 B1 * 7/2001 Miedema ..... E04B 2/7437 52/239
6,266,935 B1 * 7/2001 Seiber ..... A47B 57/425 52/126.4
6,269,594 B1 8/2001 Walker
6,276,103 B1 * 8/2001 Waalkes ..... E04B 2/7433 248/354.6
6,286,276 B1 * 9/2001 Shipman ..... A47B 57/425 52/239
6,301,846 B1 * 10/2001 Waalkes ..... A47B 21/06 52/220.7
D452,573 S 12/2001 Walker
6,330,773 B1 * 12/2001 MacDonald ..... E04B 2/7425 52/220.7
6,349,516 B1 * 2/2002 Powell ..... E04B 2/7437 52/220.7
6,351,917 B1 * 3/2002 MacDonald ..... E04B 2/7433 160/135
6,397,532 B1 * 6/2002 Shipman ..... A47B 57/425 52/220.7
6,397,533 B1 * 6/2002 Hornberger ..... A47B 95/008 52/238.1
6,405,491 B1 * 6/2002 Gallant ..... E04B 2/74 52/220.1
6,408,579 B1 * 6/2002 Anderson ..... E04B 2/7437 52/220.7
6,412,249 B1 * 7/2002 Boyer ..... E04B 2/7457 52/481.1
6,418,671 B1 * 7/2002 DeRuiter ..... E04B 2/7422 211/103
6,425,219 B1 * 7/2002 Barmak ..... E04B 2/7425 52/238.1
6,442,909 B2 * 9/2002 Waalkes ..... A47B 21/06 211/192
6,446,396 B1 * 9/2002 Marangoni ..... A47B 96/027 108/50.02
6,481,168 B1 * 11/2002 Hodges ..... E04B 2/7425 52/220.7
6,484,360 B1 11/2002 DeBartolo, Jr. et al.
6,530,181 B1 * 3/2003 Seiber ..... A47B 57/425 52/126.3
6,557,310 B2 5/2003 Marshall et al.
6,658,805 B1 * 12/2003 Yu ..... E04B 2/7422 52/239
6,684,929 B2 * 2/2004 MacDonald ..... E04B 2/7425 160/135
6,748,710 B2 * 6/2004 Gresham ..... E04B 2/7425 52/242
6,775,953 B2 * 8/2004 Burken ..... E04B 2/7425 52/238.1
6,807,776 B2 * 10/2004 Girdwood ..... A47B 83/001 160/130
6,865,853 B2 * 3/2005 Burken ..... E04B 2/7422 160/135
6,883,277 B2 * 4/2005 Wiechecki ..... E04B 2/7427 52/238.1
6,920,727 B2 * 7/2005 Yu ..... E04B 2/7433 403/363
6,951,085 B2 * 10/2005 Hodges ..... E04B 2/7425 52/220.7
7,051,482 B2 * 5/2006 MacDonald ..... E04B 2/7425 160/135
7,055,287 B2 * 6/2006 Yu ..... E04B 2/7422 52/220.7
7,150,127 B2 * 12/2006 Underwood ..... A47B 46/005 108/106
7,174,678 B2 * 2/2007 Gallant ..... A61G 7/00 52/220.1
7,204,714 B2 * 4/2007 Walker ..... A61G 12/005 439/532
7,207,143 B2 4/2007 Stanchfield
7,211,726 B2 5/2007 Bally et al.
7,448,168 B2 * 11/2008 Waalkes ..... A47B 21/06 52/220.2
7,461,484 B2 * 12/2008 Battey ..... E04B 2/7425 52/220.7
7,469,512 B2 * 12/2008 Faber ..... E04B 2/7433 52/220.2
7,537,030 B2 * 5/2009 Gallant ..... A61G 7/00 141/18
7,540,115 B2 * 6/2009 Metcalf ..... A47B 46/005 52/243
7,549,893 B1 * 6/2009 Walker ..... E04H 3/08 439/532
7,565,772 B2 * 7/2009 Waalkes ..... A47B 21/06 52/220.2
7,644,552 B2 * 1/2010 Kuipers ..... E04B 2/7424 52/204.71
7,775,000 B2 * 8/2010 Walker ..... E04F 17/08 52/200
7,841,142 B2 * 11/2010 Towersey ..... E04B 2/7425 52/239
7,891,148 B2 * 2/2011 Underwood ..... A47B 46/005 52/17
7,908,805 B2 * 3/2011 Metcalf ..... A47B 46/005 52/220.7
7,950,189 B1 * 5/2011 Walker ..... E04F 17/08 52/220.1
8,215,065 B2 * 7/2012 Gallant ..... E04B 2/74 52/220.1
8,327,589 B2 * 12/2012 Sutton ..... A47B 46/005 52/27
8,387,314 B2 * 3/2013 Parshad ..... E04B 2/7422 52/239
8,458,962 B2 * 6/2013 Gallant ..... E04B 2/74 312/209
8,522,488 B1 * 9/2013 Newkirk ..... A61G 12/005 312/242
8,549,804 B2 * 10/2013 Metcalf ..... E04B 2/7448 439/215
8,640,391 B2 * 2/2014 Newkirk ..... E04F 19/08 52/220.1
8,955,271 B2 * 2/2015 Keller ..... E05B 65/006 49/409
8,959,859 B2 * 2/2015 Haan ..... E05B 65/006 52/205
8,966,842 B2 * 3/2015 Hager ..... E05B 65/006 52/238.1
8,978,324 B2 * 3/2015 Collins ..... E04C 2/521 52/220.1
9,010,031 B1 * 4/2015 Webb ..... A61G 12/00 52/238.1
9,045,896 B2 * 6/2015 Haan ..... E05B 65/006
2001/0013209 A1 * 8/2001 Waalkes ..... A47B 21/06 52/239
2002/0007561 A1 * 1/2002 Malizia ..... G01B 3/1071 33/528

(56) References Cited

U.S. PATENT DOCUMENTS

2002/0017066 A1* 2/2002 Marshall ..... A47B 83/001 52/220.2
2002/0029529 A1* 3/2002 Waalkes ..... E04B 2/7433 52/36.1
2002/0053174 A1* 5/2002 Barmak ..... E04B 2/7424 52/220.7
2002/0069601 A1* 6/2002 Hodges ..... E04B 2/7425 52/481.2
2002/0100235 A1 8/2002 Weiss
2002/0100236 A1* 8/2002 Kuipers ..... E04B 2/7424 52/239
2002/0104271 A1* 8/2002 Gallant ..... A61G 7/00 52/36.1
2002/0108330 A1* 8/2002 Yu ..... E04B 2/7433 52/238.1
2002/0148179 A1* 10/2002 DeRuiter ..... E04B 2/7422 52/220.7
2002/0189180 A1* 12/2002 King ..... E04B 2/7422 52/243
2003/0070377 A1* 4/2003 Waalkes ..... A47B 21/06 52/481.2
2003/0089057 A1* 5/2003 Wiechecki ..... E04B 2/7427 52/238.1
2003/0145537 A1 8/2003 Bailey
2003/0154673 A1* 8/2003 MacGregor ..... A47B 83/001 52/239
2003/0155083 A1* 8/2003 MacDonald ..... E04B 2/7425 160/135
2003/0177713 A1* 9/2003 Walker ..... E04F 17/08 52/79.1
2003/0182885 A1* 10/2003 Gresham ..... E04B 2/7425 52/242
2003/0196388 A1* 10/2003 Edwards ..... A47B 96/00 52/36.1
2003/0196392 A1* 10/2003 Edwards ..... A47B 96/00 52/220.1
2003/0221384 A1* 12/2003 Burken ..... E04B 2/7425 52/238.1
2003/0226323 A1 12/2003 Travez et al.
2004/0020137 A1* 2/2004 Battey ..... E04B 2/7425 52/36.1
2004/0093805 A1* 5/2004 Underwood ..... A47B 46/005 52/36.1
2004/0130109 A1* 7/2004 Yu ..... E04B 2/7422 280/19.1
2004/0134143 A1 7/2004 Boyer
2004/0154233 A1* 8/2004 Hodges ..... E04B 2/7425 52/36.1
2004/0154267 A1* 8/2004 Burken ..... E04B 2/7422 52/782.1
2004/0154756 A1* 8/2004 MacDonald ..... E04B 2/7425 160/135
2004/0231248 A1* 11/2004 Walker ..... A61G 12/005 52/27
2005/0034378 A1* 2/2005 Underwood ..... A47B 46/005 52/36.1
2005/0034408 A1* 2/2005 Palumbo ..... E04B 2/7457 52/633
2005/0055888 A1* 3/2005 Gresham ..... A47B 83/001 52/36.1
2005/0086871 A1* 4/2005 MacGregor ..... A47B 83/001 52/36.1
2005/0144855 A1* 7/2005 Waalkes ..... A47B 21/06 52/36.1
2006/0010809 A1* 1/2006 Lafreniere ..... E04B 2/766 52/489.1
2006/0024996 A1* 2/2006 Johnson ..... H02G 3/00 439/215
2007/0022668 A1* 2/2007 Kasten ..... A61G 12/002 52/3
2007/0107335 A1* 5/2007 Laukhuf ..... E04B 2/7422 52/239
2007/0125008 A1* 6/2007 Gallant ..... A61G 7/00 52/36.4
2008/0010923 A1* 1/2008 MacGregor ..... A47B 83/001 52/239
2009/0064621 A1* 3/2009 Little, Jr. ..... E04B 2/7457 52/582.1
2009/0084064 A1* 4/2009 Little, Jr. ..... E04B 2/7457 52/745.05
2009/0090076 A1* 4/2009 Abusada ..... E04B 2/7425 52/239
2009/0241438 A1* 10/2009 Gallant ..... E04B 2/74 52/36.5
2010/0095604 A1* 4/2010 Newkirk ..... E04F 19/08 52/79.1
2010/0223857 A1* 9/2010 Sutton ..... A47B 46/005 52/27
2011/0072588 A1* 3/2011 Gallant ..... A61G 7/00 5/658
2011/0162291 A1* 7/2011 Hilliard ..... E04B 2/7422 52/27
2011/0197519 A1* 8/2011 Henriott ..... A47B 46/005 52/36.1
2011/0296778 A1* 12/2011 Collins ..... E04C 2/521 52/220.1
2012/0096780 A1* 4/2012 Metcalf ..... E04B 2/7448 52/173.1
2012/0258655 A1* 10/2012 Carnell ..... E04H 3/08 454/284
2012/0272595 A1* 11/2012 Gallant ..... E04B 2/74 52/220.7
2012/0291199 A1* 11/2012 Gallant ..... A61G 7/00 5/425
2012/0311937 A1* 12/2012 Parshad ..... E04B 2/7422 52/36.1
2012/0311946 A1* 12/2012 Liu ..... E04B 2/7425 52/239
2014/0069035 A1* 3/2014 Collins ..... E04C 2/521 52/173.1
2014/0075757 A1* 3/2014 Hager ..... E05B 65/006 29/897.32
2014/0075853 A1* 3/2014 Keller ..... E05B 65/006 52/79.7
2014/0075867 A1* 3/2014 Haan ..... E05B 65/006 52/238.1
2014/0075868 A1* 3/2014 Kerley ..... E05B 65/006 52/238.1
2014/0075869 A1* 3/2014 Hager ..... E05B 65/006 52/241
2014/0110361 A1* 4/2014 Newkirk ..... E04F 19/08 211/13.1
2015/0075085 A1* 3/2015 Newkirk ..... E04F 19/08 52/27

OTHER PUBLICATIONS

Amico Corporation, Horizontal Medical Wall System, Installation Instructions, downloaded from http://www.amico.com, 6 pgs. Date of Publication unknown, please consider as prior art until proven otherwise.

* cited by examiner

MODULAR WALL FOR DIVIDING ROOMS IN A HEALTHCARE FACILITY

This application is a continuation of U.S. patent application Ser. No. 14/141,879, filed Dec. 27, 2013, which is a continuation of Ser. No. 12/578,848, filed Oct. 14, 2009, which claims the benefit of U.S. Provisional Patent Application Ser. No. 61/196,241, filed Oct. 16, 2008, both of which are incorporated herein by this reference.

BACKGROUND OF THE INVENTION

The present disclosure is related to systems and methods for delivering services, energy, and data within a hospital room. More specifically, the present disclosure is related to a modular architectural room system for delivering gases, electrical energy, and data to a hospital room and an associated method of configuring and assembling the modular architectural room system.

Clinical care settings, such as a hospital room, for example, serve a two-fold purpose of delivering healthcare services. In the first instance, the hospital room serves as an area for delivery of medical care. In the second instance, the hospital room serves as a residence for a recuperating patient.

With regard to the delivery of healthcare services, the hospital room must include state of the art technology accessible to the healthcare provider during the delivery of care. As the acuity of a patient's illness or injury increases, the complexity of additional equipment required to assist with the delivery of care increases. The vital signs of a patient are taken on a regular basis. In a critical care/intensive care unit, other monitoring equipment and service delivery equipment is required. For example, vital signs monitoring may be required in conjunction with ventilation equipment. Generally, the support for the equipment is positioned at the head end of the bed in an architectural headwall unit. For example, gases such as oxygen and compressed air may be delivered to the patient room. A vacuum line may also be provided. Electrical service outlets may also be provided with certain devices being connected to power circuits including emergency back-up for critical devices. The architectural headwall units may also provide central lighting controls and may be configured to provide support for healthcare equipment such as monitoring devices and fluid collection canisters.

The delivery of gases and power and the support of healthcare equipment tend to cause the headwall area of a patient room to appear more clinically oriented than residential. In order to provide a more aesthetically pleasing environment for recuperation, hospitals are known to utilize structures within the room constructed employing wood grains and configured with gas and electrical outlets.

SUMMARY OF THE INVENTION

The present application discloses one or more of the features recited in the appended claims and/or the following features which, alone or in any combination, may comprise patentable subject matter:

According to one aspect of the disclosure, a structure for supporting patient care equipment in a patient room including a wall comprises a frame. The frame includes (i) a plurality of columns, each column including a plurality of first through-holes formed in the column. The first through-holes are spaced at a first regular interval along the longitudinal length of the column. The frame also includes (ii) a plurality of cross-members coupled to the columns to secure the columns together.

In some embodiments, a column comprises a channel including a web having a planar outer surface and a pair of legs extending perpendicularly from the web in a direction opposite the outer surface. The first through-holes are formed in the web.

In some embodiments, the legs of the column include a plurality of second through-holes formed in the legs. The second through-holes are arranged to form a repeating first pattern in the leg. The first pattern repeats at a regular interval along the length of the column.

In some embodiments, the structure further comprises a panel mounted to a plurality of columns to span the gap between the columns to enclose at least a portion of the frame. The panel has a rectangular shape and includes a pair of first mounting brackets positioned at opposite corners and a pair of second mounting brackets positioned at opposite corners different from the corners on which the first mounting brackets are positioned.

In some embodiments, the structure includes a plurality of panels positioned adjacent one another with the first mounting brackets of a first panel positioned adjacent the second mounting brackets of a second panel.

In some embodiments, the first and second panels are spaced apart to form a gap therebetween and fasteners that secure the panels to the frame are accessible in the gap. In some embodiments, the structure further includes a molding positioned in the gap between the panels to overlie the fasteners and seal the gap. In some embodiments, the molding is removable to access the fasteners. In some embodiments, the molding is secured to the respective panels by a frictional interference between the molding and the panels.

In some embodiments, the legs of the column include a plurality of third through-holes having a shape different from the shape of the first through-holes. Each of the third through-holes are positioned adjacent the first pattern of second through-holes such that the second and third through-holes cooperate to define a second pattern. The second pattern repeats at a regular interval along the length of the column.

In some embodiments, the second through-holes are square-shaped and the third through-holes are rectangular shaped. The first pattern includes second-though holes positioned side-by-side on the leg and the second pattern includes a third through-hole positioned between respective sets of side-by-side second holes in the first pattern.

In some embodiments, a panel includes a pair of first mounting brackets positioned at opposite corners and a pair of second mounting brackets positioned at opposite corners different from the corners on which the first mounting brackets are positioned. The first mounting brackets are configured to be secured to the frame with the first mounting brackets aligning with the square-shaped through-holes and the second mounting brackets formed to include a tab that is received the third through-holes.

In some embodiments, the structure further comprises a gas outlet mounted to a panel, a manifold positioned in the structure, and a flexible conduit connecting the manifold to the gas outlet to provide fluid communication between the manifold and the gas outlet.

In some embodiments, the structure further comprises an electrical power outlet mounted to a panel, a junction box positioned in the structure, and a cable removably coupled to the junction box transmitting electrical power from the junction box to the electrical power outlet.

In some embodiments, the structure further comprises a panel, a gas outlet mounted to the panel, a manifold supported on the structure, and a flexible conduit passing through one of the first through-holes to connect the manifold to the gas outlet to provide fluid communication between the manifold and the gas outlet.

In some embodiments, the structure further comprises a panel, an electrical power outlet mounted to the panel, a junction box positioned in the structure, and a cable removably coupled to the junction box transmitting electrical power from the junction box to the electrical power outlet, the cable passing through one of the first through-holes to connect the electrical power outlet to the junction box.

In some embodiments, a column further comprises a flange extending from each of the legs, the flanges spaced apart such that the column forms a channel and the space between the flanges defines an opening into the channel. In some embodiments, the flanges are formed to include a number of through-holes and the cross-member includes a plurality of through-holes that align with the through-holes in the flange so that a fastener may pass through the through-holes in the cross-member to secure the cross-member to the column.

In some embodiments, the structure further comprises at least one panel secured to the frame of the structure. The legs of the column include a number of through-holes that form a regular pattern along the length of the column. The at least one panel includes mounts that align with the through-holes in the leg of the column such that the panel may be secured to the columns via the through-holes in the legs of the columns.

In another aspect of the disclosure, a modular architectural room system for a room in a healthcare facility having a wall comprises a modular frame structure coupled to the wall. The modular frame structure includes a plurality of columns secured together by removable fasteners. A plurality of panels is coupled to the modular frame structure to form a surface. The panels are secured to the modular frame structure by removable fasteners. A service outlet is coupled to at least one of the panels. The panels are spaced apart by a distance such that a gap is formed between the panels. The removable fasteners securing the panels to the modular frame structure are positioned in the gap and recessed from the surface of the panels.

In some embodiments, the system further comprises a molding removably secured to the panels, the molding positioned in the gap between the panels to cover the fasteners.

In some embodiments, the system further comprises a plurality of service outlets positioned on at least two panels.

In some embodiments, the service outlets are gas outlets accessible by a caregiver to receive gas from a centralized gas distribution center in the healthcare facility. In some embodiments, the system further comprises a gas manifold supported by the modular frame structure and a conduit communicating gas from the manifold to a gas outlet. In some embodiments, the conduit passes through a through-hole formed in a member of the modular frame structure.

In some embodiments, the service outlets include electrical power outlets accessible by a caregiver to transfer electrical power from a central distribution location to the electrical power outlets. In some embodiments, the system further comprises a junction box supported by the modular frame structure and an electrical cable communicating electrical power from the junction box to an electrical power outlet. In some embodiments, the electrical cable passes through the through-hole formed in a member of the modular frame structure. In some embodiments, the electrical cable is removably coupled to a receptacle in the junction box. In some embodiments, the electrical cable passes through through-hole formed in a member of the modular frame structure.

In some embodiments, at least one of the panels is movable relative to the modular frame structure to expose a storage space located within the modular frame structure. In some embodiments, at least one of the panels pivots relative to the modular frame structure. In some embodiments, at least one of the panels slides relative to the modular frame structure.

In some embodiments, a service outlet is a data receptacle in communication with a centralized information management system.

In some embodiments, the system is configured to be expanded by adding additional members to the modular frame structure.

In some embodiments, at least a portion of the modular frame structure is positioned within the wall. In some embodiments, the modular frame structure is positioned outside the boundaries of the wall.

In some embodiments, the molding is secured to the panels by a frictional interference between the molding and the panels. In some embodiments, the molding includes a head, a shank extending from the head, and a plurality of barbs extending from the shank. In some embodiments, the barbs engage the panels and the bias of the barbs cause the barbs to maintain contact with the panels to secure the molding to the panels.

In some embodiments, the system comprises two part fastening assembly including a first fastener removable secured to a first member of the modular frame structure and a second fastener configured to engage the second fastener to secure the panels to the modular frame structure.

In some embodiments, the first fastener is a cage nut assembly including a deformable cage, the cage nut assembly positionable at a plurality of locations on the modular frame structure.

According to yet another aspect of the present disclosure, a modular architectural room system for a room in a healthcare facility having a wall comprises a column including a web having an outer surface and an inner surface, a pair of legs extending from the inner surface to form a u-shaped channel with the inner surface of the web positioned in the interior of the channel, and a pair of flanges extending inwardly from the legs to enclose a portion of the open side of the channel, wherein the column includes a plurality of regularly spaced through-holes positioned along the length of the column, the through-holes forming a first repeating pattern in the web, a second repeating pattern on each of the legs, and a third repeating pattern on each of the flanges.

In some embodiments, the through-holes formed in the web include a plurality of enlarged through-holes configured to permit cables and conduits to pass through the enlarged through-holes to transfer gas and electrical service through the column.

In some embodiments, the through holes formed in the web include a plurality of fastener receiving holes to receive fasteners therethrough to align adjacent columns and secure the adjacent columns to form a modular frame structure.

In some embodiments, the through-holes formed in the legs include pairs of square-shaped through holes spaced along the longitudinal length of the column.

In some embodiments, the through-holes formed in the legs include rectangular-shaped through holes positioned between the pairs of square-shaped through holes, the rectangular-shaped through-holes spaced along the longitudinal length of the column.

In some embodiments, the through-holes formed in the flanges are regularly spaced along the longitudinal length of the column.

In some embodiments, the through-holes formed in the legs include pairs of square-shaped through holes spaced along the longitudinal length of the column.

In some embodiments, the through-holes formed in the legs include rectangular-shaped through holes positioned between the pairs of square-shaped through holes, the rectangular-shaped through-holes spaced along the longitudinal length of the column.

In some embodiments, the system further comprises a plurality of columns and at least one cross-member fastened to a pair of columns to secure the columns and form a modular frame structure.

In some embodiments, the cross-member includes a plurality of tabs received in the rectangular-shaped slots formed in the legs of the column.

In some embodiments, the cross-member further includes a detent received in one of the square-shaped holes formed in the legs of the column to prevent the cross-member from moving relative to the column.

In some embodiments, the cross-member is configured to support a service outlet.

In some embodiments, the cross-member includes an enlarged through-hole configured to permit cables and conduits to pass through the enlarged through-hole to transfer gas and electrical service through the cross-member.

Additional features, which alone or in combination with any other feature(s), including those listed above and those listed in the claims, may comprise patentable subject matter and will become apparent to those skilled in the art upon consideration of the following detailed description of illustrative embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
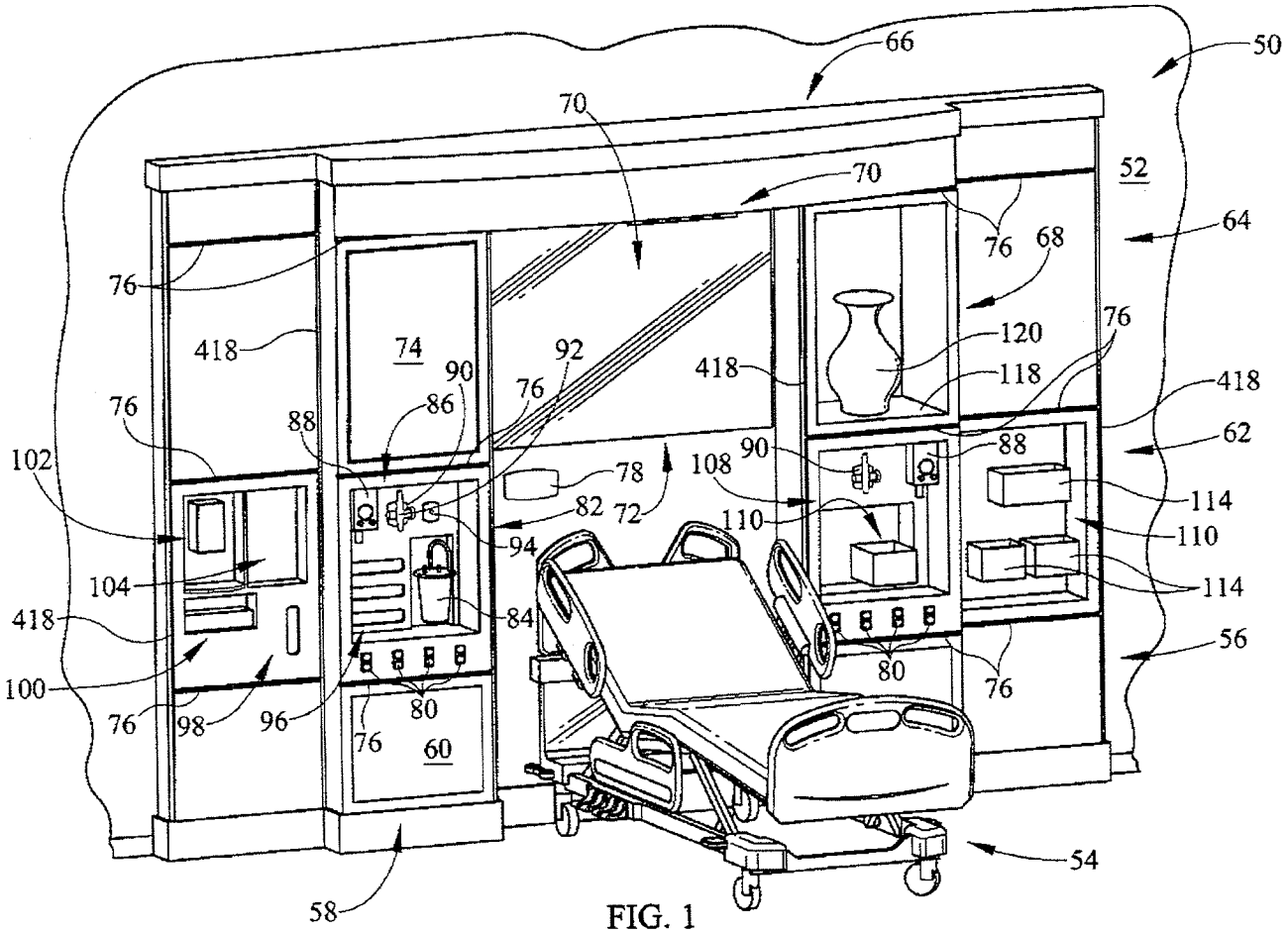
FIG. 1 is a perspective view of a modular architectural room system positioned in a patient room and configured as a head wall.

According to the present disclosure, a modular architectural room system 50 is positioned in a patient room. As shown in FIG. 1, the modular architectural room system 50 is configurable to store equipment used in a hospital room and support gas and electrical services. In the embodiment shown in FIG. 1, the modular architectural room system 50 is positioned at a wall 52 in a patient room at the head of a patient support apparatus 54. The modular architectural room system 50 serves multiple purposes within the patient room as can best be described by referring to the zones of the modular architectural room system 50. A base zone 56 is positioned below the normal ergonomic reach of a caregiver and serves to support the remainder of the modular architectural room system 50 while providing areas for storage such as an area 58 which is covered by a removable panel 60 with a storage space positioned behind the removable panel 60.

A care zone 62 is positioned above the base zone 56 and is within the normal ergonomic reach of a caregiver. As will be discussed below with regard to embodiments, care zone 62 is configurable such that activities performed by a caregiver, such as a nurse, for example, may be accomplished utilizing equipment and services supported on the modular architectural room system 50 within the care zone 62. In the discussion of the embodiments described below, it should be noted that the configurable nature of care zone 62 allows the modular architectural room system 50 to be customized to a particular patient room based on the expected acuity and needs of the patients to be treated in the particular patient room. For example, depending on the nature of the illness or injury to a particular patient, the patient may be housed in various departments within a hospital. In a lower acuity setting, such as a rehabilitation department, a patient may be mobile and relatively self-reliant thereby requiring lower skilled care and minimally sophisticated equipment at the bedside. In a high acuity department such as an intensive care unit, for example, sophisticated equipment may be positioned at the bedside requiring access to power circuits, gas outlets, data lines, and a centralized information management system. A configurable system, such as the modular architectural room system 50, may be designed and constructed in a manner which is appropriate for the particular environment while using common components. It should also be noted, as will be discussed below, modular architectural room systems disclosed herein are structured such that additional services may be added to a particular deployment of a system, such as the modular architectural room system 50, so that users may change the configuration of the modular architectural room system 50 as the needs of a facility change and technology advances.

The modular architectural room system 50 further includes an aesthetic zone 64 positioned above the care zone 62. The aesthetic zone 64 is configurable to provide an appropriate level of aesthetically pleasing environmental conditions based on the acuity of the patients normally treated in the particular room. The aesthetic zone 64 may include structural elements such as a curved crown 66, shown in FIG. 1, as well as shelves 68, lights 70, and wall hangings 72. Additional shelving may be added in the embodiment shown in FIG. 1 when a panel 74 is removed to expose an interior space behind the panel 74.

One aspect of a clinical environment that is of significant concern is the clean ability of equipment and a clinical environment. A related issue is the concern with infection control which is manifested in a need for equipment placed in a clinical setting to be relatively free of porous surfaces and the presence of areas which may permit biohazards to accumulate. For example, it is important that liquids, including cleaning liquids, not be permitted to enter areas of equipment within the system that cannot be cleaned.

In the embodiment shown in FIG. 1, the modular architectural room system 50 includes a horizontal molding 76 and a vertical molding 418 positioned between adjacent panels of the modular architectural room system 50. The moldings 76, 418 serve dual purposes of providing a decorative effect and preventing the ingress of liquids into areas of the modular architectural room system, thereby improving cleanability and infection control. The application of the moldings 76, 418 will be discussed in further detail below, however the aesthetic effect of horizontal molding 76, 418 is illustrated in FIG. 1, wherein the moldings 76, 418 provide a visual effect by breaking up panel surfaces with linear break lines providing an aesthetically pleasing effect.

It should also be noted that the modular architectural room system 50 and the other modular architectural room systems discussed below, are configurable to allow equipment and services in a care zone, such as the care zone 62 of the modular architectural room system 50, to be positioned such that key equipment and services are positioned nearest the patient support apparatus 54 while equipment that is not key to the delivery of care to the patient but is used by the caregiver is positioned away from the patient support apparatus 54. In the embodiment shown in FIG. 1, a nurse call system interface 78 is positioned in the care zone 62 near the patient support apparatus 54.

The modular architectural room system 50 further includes a number of electrical power outlets 80 positioned in the care zone 62 relatively near the patient support apparatus 54 such that monitoring and other equipment may be positioned adjacent the patient support apparatus 54. In a storage space 82 of the care zone 62, a vacuum canister 84 is positioned to permit use of a vacuum system 86. The vacuum system 86 includes a regulator 88 engaged with a vacuum service outlet (not shown) which is connected to a central hospital vacuum line. The storage space 82 further includes a pressurized air outlet 90 and a regulator 92 connected to the pressurized air outlet 90. The pressurized air outlet 90 is connected to a central hospital pressurized air system and is used to operate clinical devices which run from pneumatic power. An oxygen outlet 94, which is connected to a central hospital oxygen system, is positioned in the storage space 82 so that patients requiring oxygen may be provided oxygen from the centralized hospital oxygen system. The storage space 82 also includes a number of storage drawers 96 which may be used to store gloves, bandages, swabs and the like for easy access by a caregiver. While this discussion of the pressurized air outlet 90, the oxygen outlet 94 and the vacuum outlet refer to specific uses of the particular gas delivery outlets in the embodiment shown in FIG. 1, the outlets may each be positioned in a similar manner and the remaining discussion will make reference to a generic gas outlet 90 without limitation to the type of gas being delivered through the outlet.

Additional items are available in the care zone 62 yet are spaced apart from the patient support apparatus 54. For example, a waste receptacle 98, a sharps disposal 100, and a hand sanitizer dispenser 102 are all positioned in the care zone as shown in FIG. 1. Equipment, such as a ventilator bag, for example, may be stored in a storage space 104 positioned in the care zone 62. Another storage space 108 is positioned in the care zone adjacent the patient support apparatus 54 on the side opposite storage space 82. The storage space 108 includes additional medical gas outlets 90 similar to the outlets included in the storage space 82. The storage space 108 also includes a storage receptacle 110 which may be used to store supplies. A storage space 112 outboard from the storage space 108 includes a number of additional storage receptacles 114 for the storage of medical supplies.

In the aesthetic zone 64, a storage space 116 includes a shelf 118 on which items may be displayed. In the embodiment shown in FIG. 1, a vase 120 is shown. It should be understood that this space may be used to display personal items for the patient under care or other decorative items or store medical supplies. The curved crown 66 forms a header over a space 70 in which the patient support apparatus 54 is received.

Figure 28:
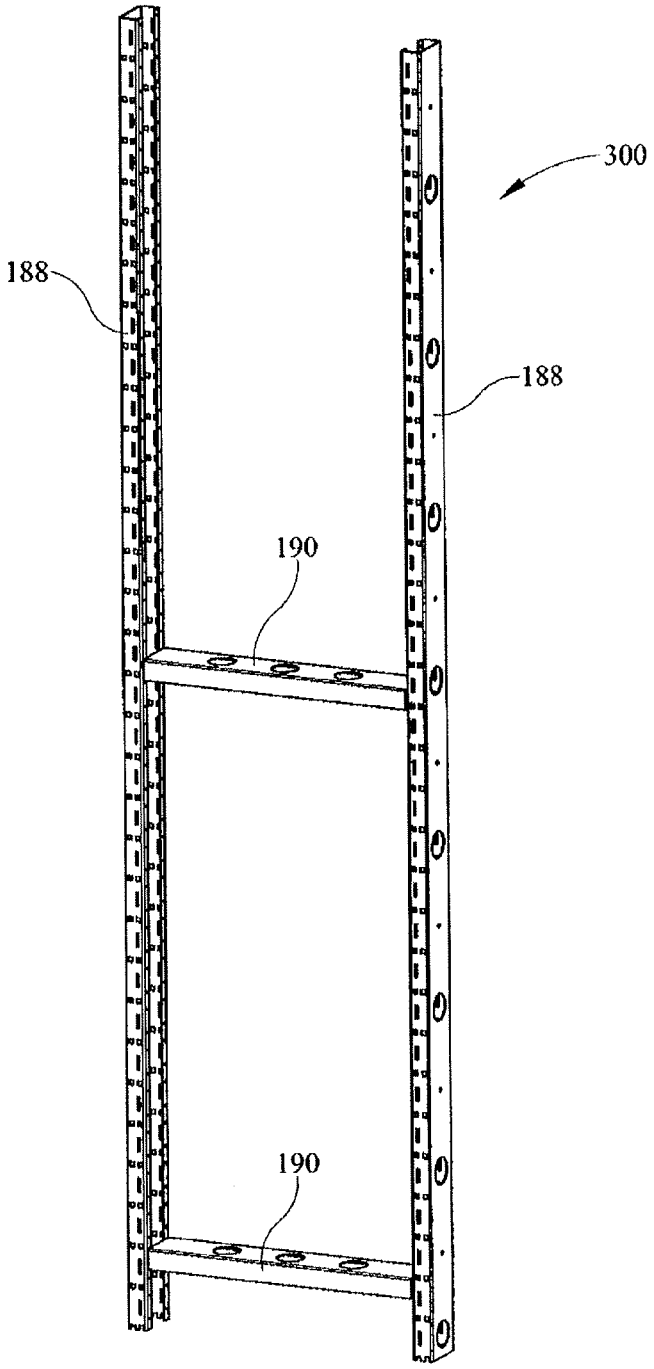
FIG. 28 is a perspective view of a support structure used to configure modular architectural room systems of the present disclosure.
Figure 29:
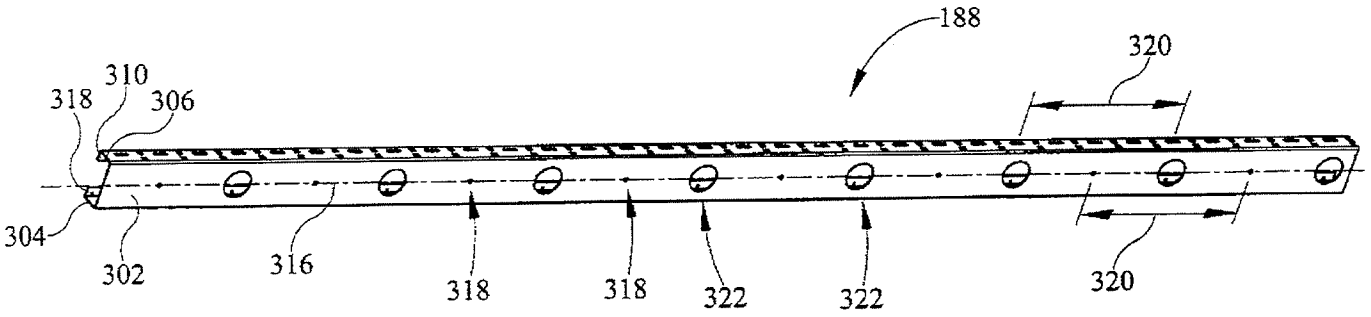
FIG. 29 is a perspective view of a column of the support structure of FIG. 28.

The embodiments of architectural support systems disclosed herein are all assembled utilizing basic structural components as exemplified in FIG. 28. A frame 300 shown in FIG. 28 is comprised of a pair of columns 188 secured together by two cross-members 190, 190. Referring now to FIG. 29, column 188 is a roll-formed steel channel having a web 302 and a pair of legs 304, 306 which extend perpendicularly from the web 302. Each leg 304, 306 includes a respective flange 308, 310 which extends inwardly from each respective leg 304, 306 to form flange surfaces 312, 314 which are generally parallel to a surface 316 of an outer portion of web 302.

The web 302 includes a plurality of through-holes 318 centered in the web 302 and formed along the longitudinal length of column 188 at a regular interval 320 which corresponds to an interval between through-holes formed in other structural elements of the modular architectural support systems disclosed herein. The spacing of through-holes 318 facilitates the attachment of other support structures as required to configure a particular embodiment of a modular architectural room system. The web 302 is also formed to include a plurality of access holes 322 which are also spaced apart at an interval 320. The access holes 322 provide an opening for routing of flexible hoses and flexible electrical lines between adjacent frame structures 300. The through-holes 318 may be used to fasten the adjacent frame structures 300 to one another by the use of bolts and nuts or other fastening system to secure one column 188 to a second column 188 with surfaces 316 of the adjacent columns 188 in contact.

Figure 30:
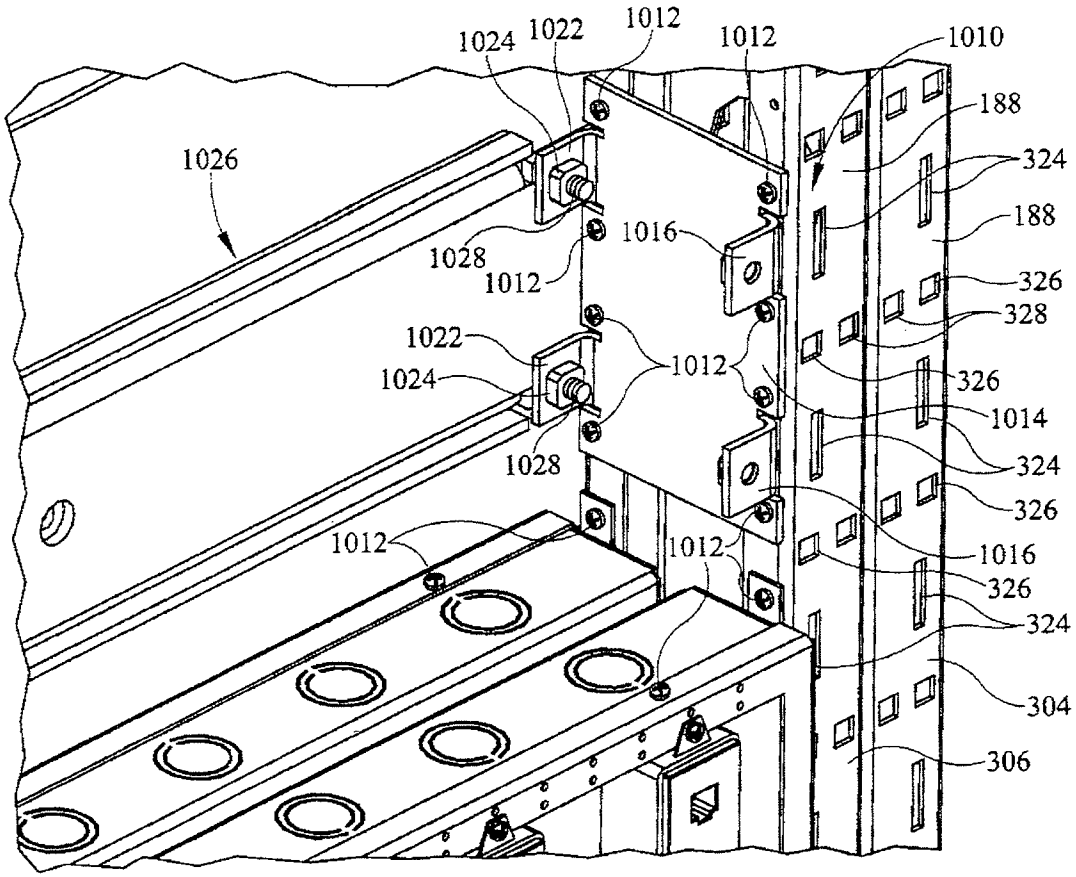
FIG. 30 is a perspective view of a portion of the support structure according to the present disclosure, FIG. 30 showing the mounting of a support arm used to support large accessories.
Figure 31:
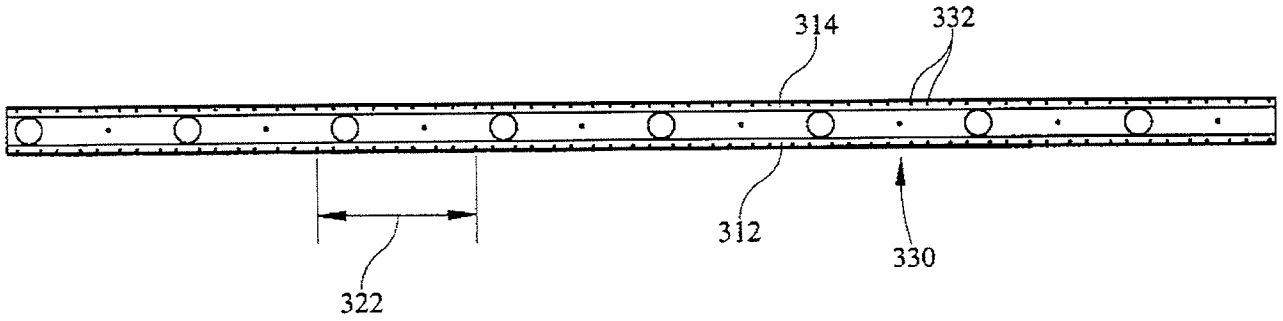
FIG. 31 is a side view of the column of FIG. 29.

Each of the legs 304, 306 include a plurality of through-holes which form a regular pattern used for mounting supports used in the configuration of modular architectural room systems. Referring now to FIG. 30, a pair of columns 188 is shown joined together as described above. A leg 306 is visible on a column 188 positioned on the left of the two joined columns 188. The leg 304 of the column 188 on the right is visible. Each of the legs 304, 306 includes a plurality of slotted through-holes 324. Each leg 304, 306 includes a square-shaped through-hole 326 near the respective flanges 308, 310. A similar square-shaped through-hole 328 is formed in each of the legs 304, 306 near the web 302 of each of the respective columns 188. As will be discussed in further detail below, the regular pattern of through-holes 324, 326, 328 is used to mount structures to form an outer surface support structure for the modular architectural room systems described herein.

The flanges 312 and 314 include regular patterns 330 of through-holes 332 formed therein. It should be noted that the regular patterns 330 are spaced at regular intervals 320 thus having the same spacing as through-holes 322 and 318. The through-holes 332 are used to mount the cross-members 190 to columns 188 as well as to mount certain support structures which span between columns 188 when a particular embodiment of a modular architectural room system is assembled.

Figure 35:
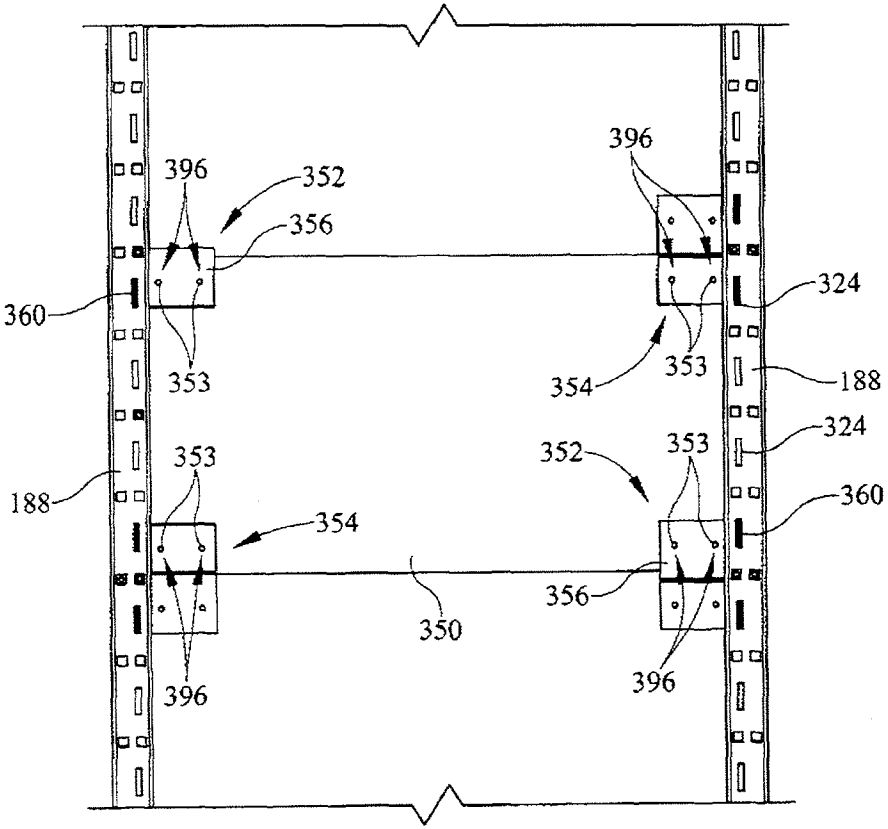
FIG. 35 is a perspective view of a portion of a modular architectural room system showing the mounting of an illustrative panel to a column of the support structure of FIG. 28.

Referring now to FIG. 35, a panel 350 is supported on a pair of columns 188 by a pair of first support brackets 352 and pair of second support brackets 354 each of which is secured to a respective column 188. The support bracket 354 includes a main portion 356 and an extension 358 coupled to main portion 356. A tab 360 extends perpendicularly away from main portion 356 and is sized to be received in one of the slotted holes 324 of the column 188. A cap-screw 362 (seen in FIG. 36) passes through an aperture in the extension 358 and is received in a cage nut assembly 364 to secure the panel bracket 354 to the column 188. A bracket 352 is secured to the column 188 in a similar manner.

Figure 32:
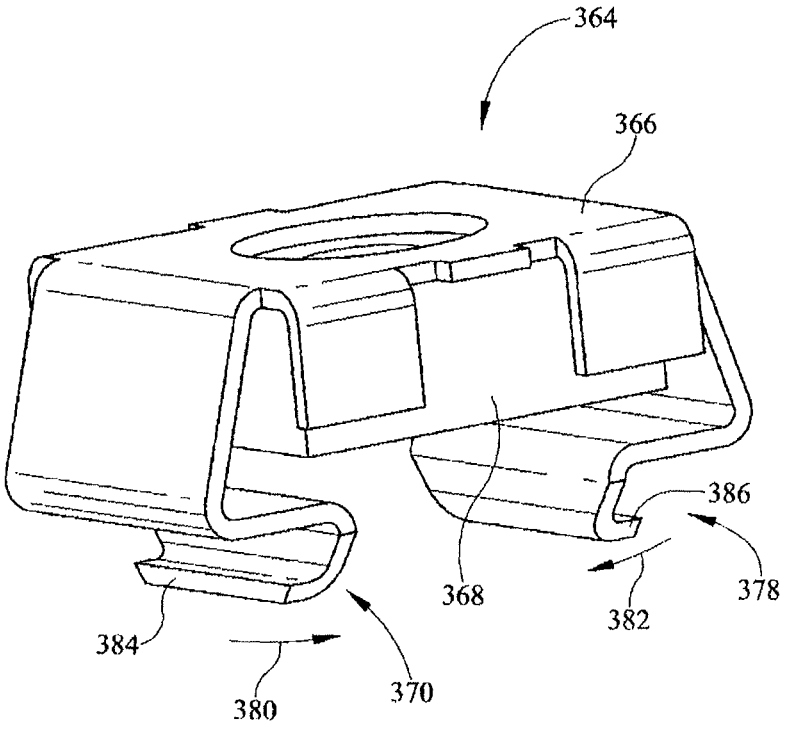
FIG. 32 is a perspective view of a fastener used in the support structure of FIG. 28.
Figure 33:
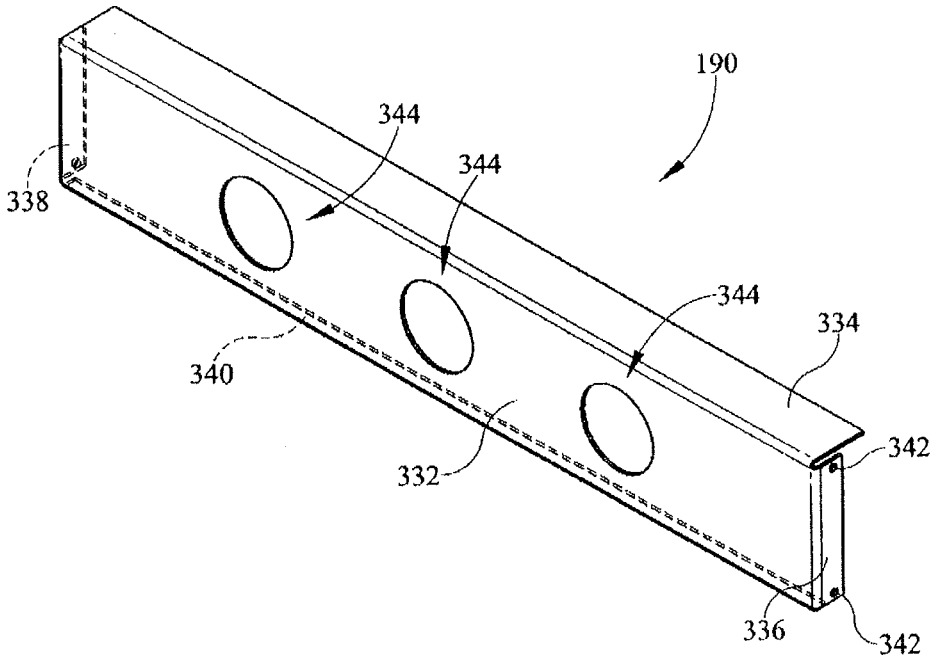
FIG. 33 is a perspective view of a cross-member of the support structure of FIG. 28.
Figure 36:
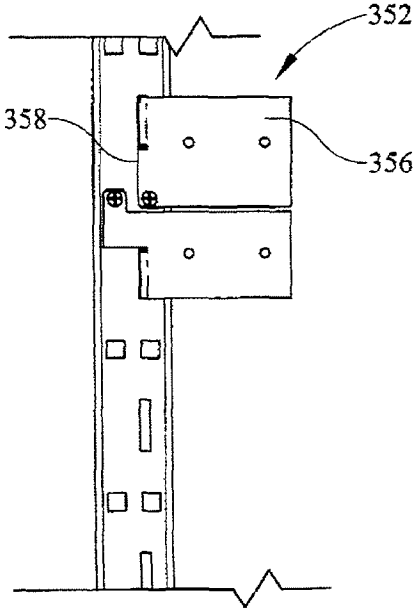
FIG. 36 is a perspective view with portions removed showing the mounting of an illustrative panel including the fastener of FIG. 32.

Referring to FIG. 32, the cage nut assembly 364 includes a cage 366 and a square nut 368 received within the cage 366 as shown in FIG. 32. The cage 366 includes two legs 370 and 378 which are configured to be received in either a square-shaped through-hole 326 or a square-shaped through-hole 328 formed in the legs 304 and 306 of the columns 188. The legs 370 and 378 may be deflected in the directions of the arrows 380 and 382 shown in FIG. 32. The leg 370 includes a lip 384 and the leg 378 includes a lip 386 such that when legs 370 and 384 are deflected, lips 384 and 386 may be positioned through one of the square-shaped through-holes 326 or 328. When the deflection is released, the lips 384 and 386 extend beyond the edge of the square-shaped through-holes 326 or 328 so that the bias of the legs 370 and 378 maintain the lips 384 and 386 in engagement with the edges of the square-shaped through-holes 326 and 328 to retain the cage nut assembly 364 on the column 188. The cage 366 includes two pairs of tabs 388 and 390 positioned on opposite sides of the cage 366 such that the legs 370 and 378 and the two pairs of tabs 388 and 390 retain the nut 368 within the cage 364. The bias of the legs 370 and 378 may be overcome by a finger grip so that a user may install the cage nut assembly 364 in any position along the length of the column 188. A cap-screw 362 is engages the nut 368 to secure the panel bracket 354 to the frame 300. The lower bracket 352 includes a through-hole through a main portion 392 of the lower bracket 352. The lower bracket 352 also includes a tab 394 which extends perpendicularly from the main potion 392 in a manner similar to the manner in which tab 360 extends from main portion 356 of upper bracket 354. The tab 394 is also configured to be received in a slotted hole 324 formed in the legs 304 and 306 of the columns 188. As can be seen in FIG. 36, the extension 358 is configured to allow an upper bracket 354 supporting a panel below a lower panel bracket 352 to be secured in a square-shaped through-hole 328 adjacent a square-shaped through-hole 326 supporting the lower panel bracket 352.

Each of the upper and lower panel brackets 354 and 352 respectively include a pair of through-holes 396. A fastener 353 is inserted through the holes 396 to secure the panel 350 to the brackets 352 and 354.

Figure 40:
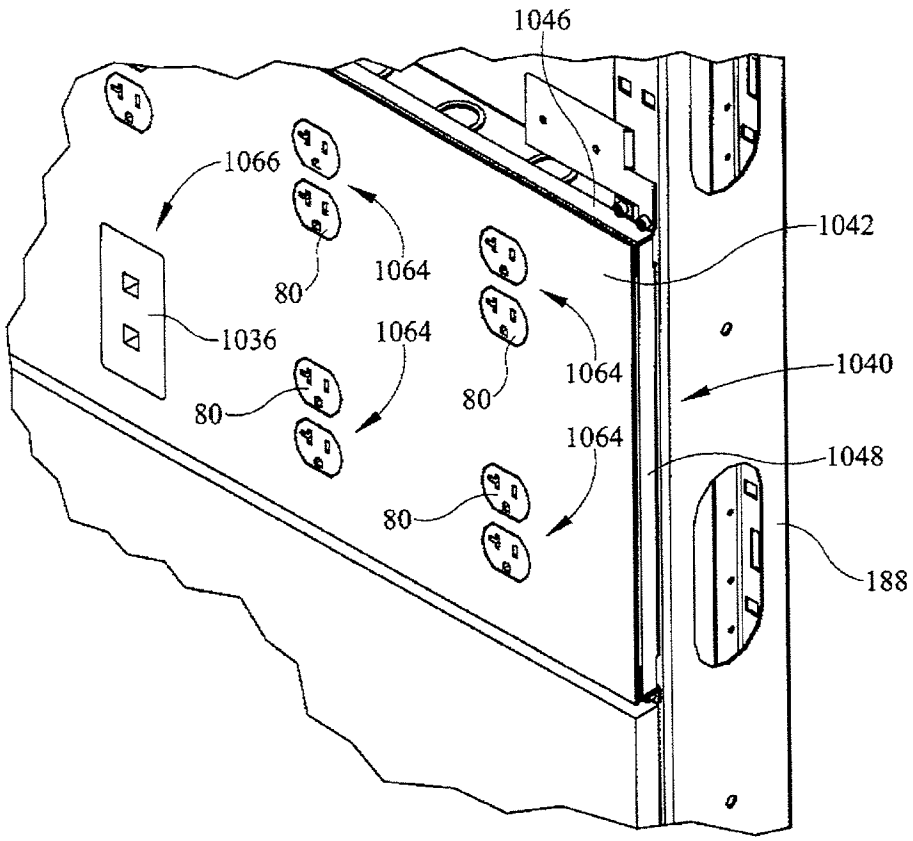
FIG. 40 is a perspective view of a structure employing the panel of FIGS. 37-39.
Figure 41:
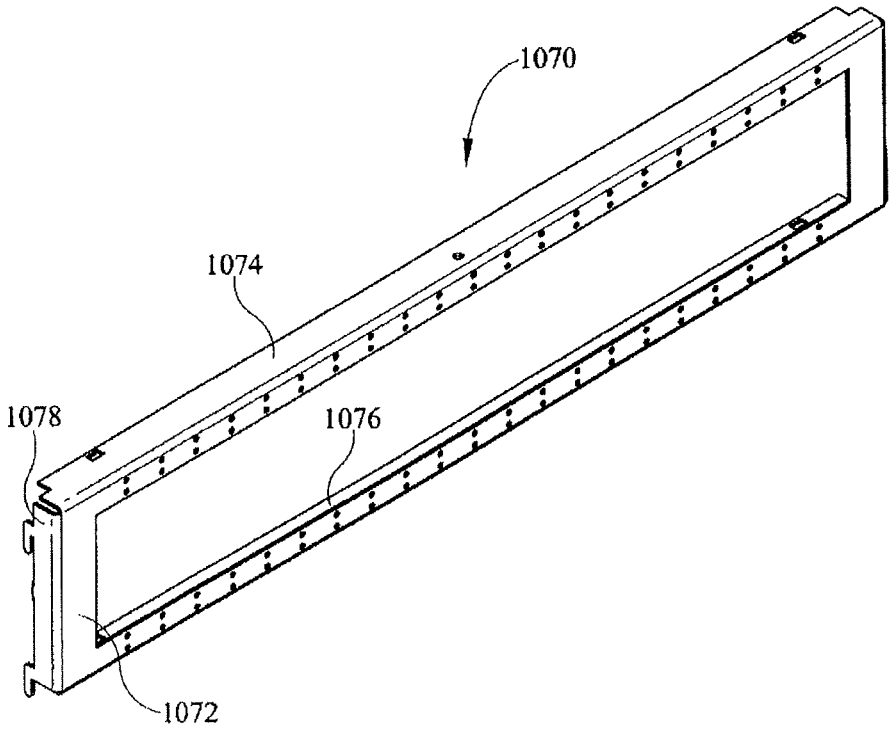
FIG. 41 is a perspective view of an embodiment of a mounting rail for mounting gas outlets and electrical outlets according to the present disclosure.

The cross-member 190 is a formed metal component that includes a main portion 332, a support flange 334 coupled to main portion 332, and a pair of side flanges 336 and 338 as shown in FIG. 40. The cross-member 190 also includes a flange 340 coupled to the main portion 332 opposite support flange 334. The side flanges 336 and 338 are also coupled to the main portion 332 and each include a pair of through-holes 342 configured to align with a pair of holes 332 formed respectively in the flanges 312 and 314 of the column 188. The cross-member and 190 is fastened to the columns 188 with fasteners passing through through-holes 342 in a cross-member 190 and holes 332 in column 188. The cross-member 190 also includes through-holes 344 formed in the main portion 332 providing a path for gas conduits and electrical lines to pass through the through-holes 344 to be routed throughout the modular architectural room systems disclosed herein. The support flange 334 serves to provide support for panel structures which may be mounted on the modular architectural room systems of the present disclosure. The cross-member 190 is secured to the columns 188 forming a frame 300 as shown in FIG. 28 to stiffen the frame 300.

Referring again now to FIG. 30, several illustrative support structures are shown which are used to support panels and equipment on a frame 300 of a modular architectural room system. A mounting plate 1010 is mounted to a column 188 through a plurality of fasteners 1012 which are illustratively embodied as screws. The screws 1012 engage the holes 332 in the column 188 to secure the mounting plate 1010 to the frame 300. The mounting plate 1010 includes a plate body 1014 and a plurality of tabs 1016 which extend outwardly from the plate body 1014. Each of the tabs 1016 include an aperture 1018 formed through the tab 1016. An outer surface 1020 of the tab 1016 faces outwardly away from the frame 300. An inner surface 1022 on the tab 1016 faces inwardly, opposite the outer surface 1020. A threaded member 1024 is secured to the inner surface 1022 of tab 1016 and is configured to receive a fastener 1028 to secure a support bar 1026 to the mounting plate 1010. Each support bar 1026 is secured at opposite ends spanning a gap between two columns 188 with the support bar 1026 secured by two fasteners 1028 at each end as shown in FIG. 34.

Figure 34:
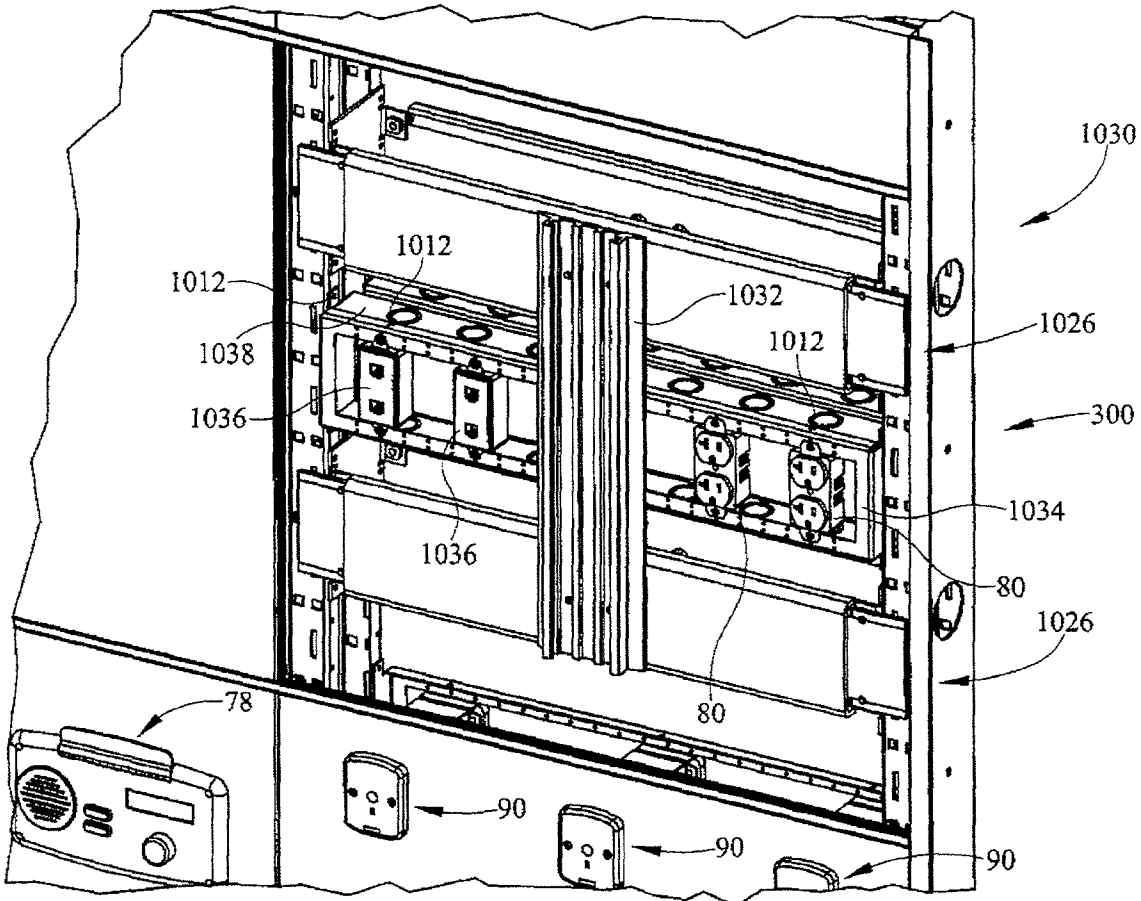
FIG. 34 is a perspective view of a portion of a modular architectural room system according to the present disclosure, the embodiment shown in FIG. 34 including an accessory mount supported from a pair of support arms.

As shown in FIG. 34, a portion of a modular architectural room modular architectural room system 1030 includes a pair of support bars 1026 coupled to a frame 300, the two support bars 1026 are spaced vertically apart. An accessory mount 1032 is coupled to the support bars 1026 and positioned to support accessories on the modular architectural room system 1030. The accessory mount 1032 is illustratively embodied as an M-Series Wall Mount available from GCX Corp. of Petaluma, Calif. The support bars 1026 and accessory mount 1032 are configured so that a panel cover may be positioned to hide support bars 1026 with only the accessory mount 1032 exposed when the modular architectural room system 1030 is assembled.

The modular architectural room system 1030 also includes a nurse call system interface 78 and a number of gas outlets 90. As shown in FIG. 34, modular architectural room system 1030 has a panel cover omitted exposing a mounting rail 1034 on which two electrical power outlets 80 are mounted. The modular architectural room system 1030 also includes two data receptacles 1036 mounted to the rail 1034. The rail 1034 is mounted to two columns 188 of a frame 300 of modular architectural room system 1030 with fasteners 1012 in a manner similar to the manner in which mounting plate 1010 is secured to the columns 188. In the embodiment shown in FIG. 34, an enclosure 1038 is secured to the rail 1034 with fasteners 1012. The enclosure 1038 provides isolation of the electrical power outlets 80 and data receptacle 1036 from receptacles mounted within the frame 300 and facing opposite the receptacles shown in FIG. 34.

The gas outlets 90 are mounted to a rail 1034 in a manner similar to the manner in which the electrical power outlets 80 and 1036 are mounted. In the embodiment shown in FIG. 34, modular architectural room system 1030 is configured to occupy a space in a studded wall with the accessories shown in FIG. 34 facing into a first patient room and matching accessories accessible in another patient room on the other side of the wall so that to patient rooms may be serviced with one modular architectural room system 1030.

Figure 17:
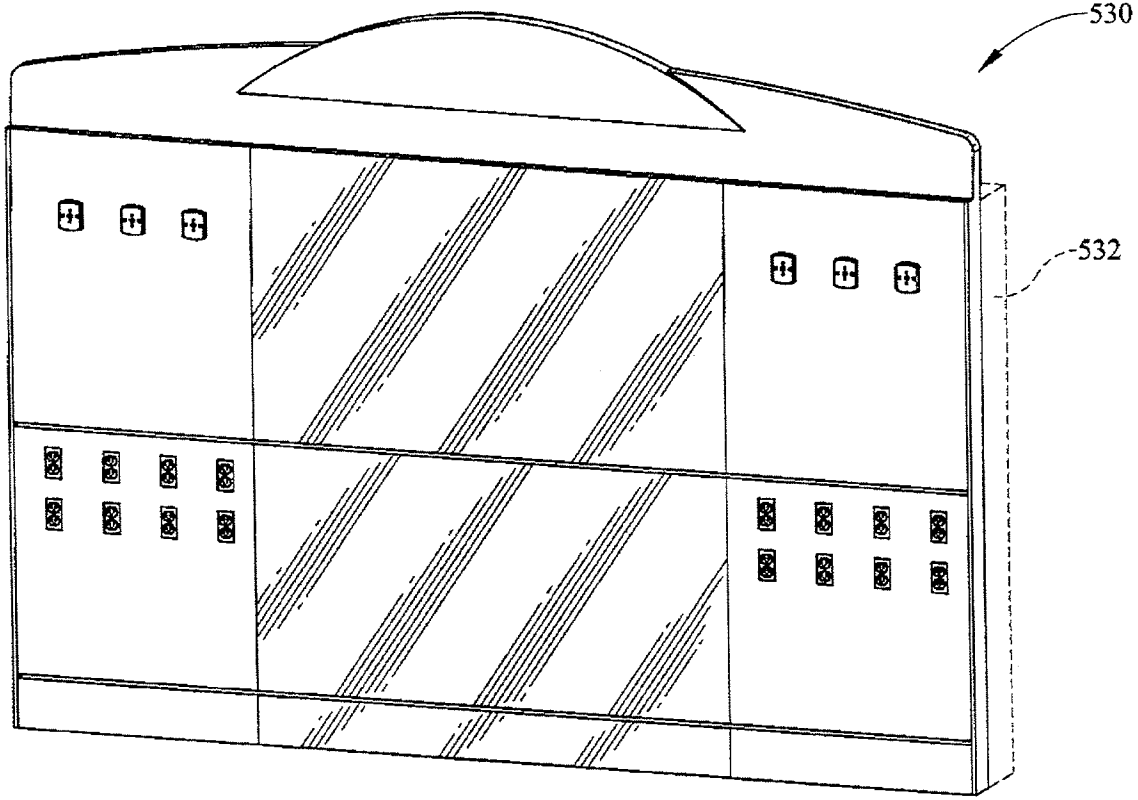
FIG. 17 is a perspective view of a flush mounted modular architectural room system.

With reference to the manner of installing modular architectural room systems, it should be understood that different applications require different configurations. Mounting configurations may vary within a specific system based on zones. In the embodiment of a modular architectural room system 530 shown in FIG. 17, the system is flush mounted. In a flush mounted system such as the embodiment of modular architectural room system 530, the visible portion of the system extends minimally outwardly from a wall. As shown in FIG. 17, a utility space 532 is shown in phantom. The utility space 532 is located within a wall (not shown) such that gas conduits and electrical lines may be routed within the wall. In addition, a portion of the outlets supported on the modular architectural room system 530 may extend into the utility space 532 within the wall. A flush mounted system, such as the modular architectural room system 530, extends into a patient room minimally. This configuration is appropriate when space is at a premium and a wall on which the modular architectural room system 530 is mounted is appropriately configured to allow the routing of gases and electrical services.

Figure 18:
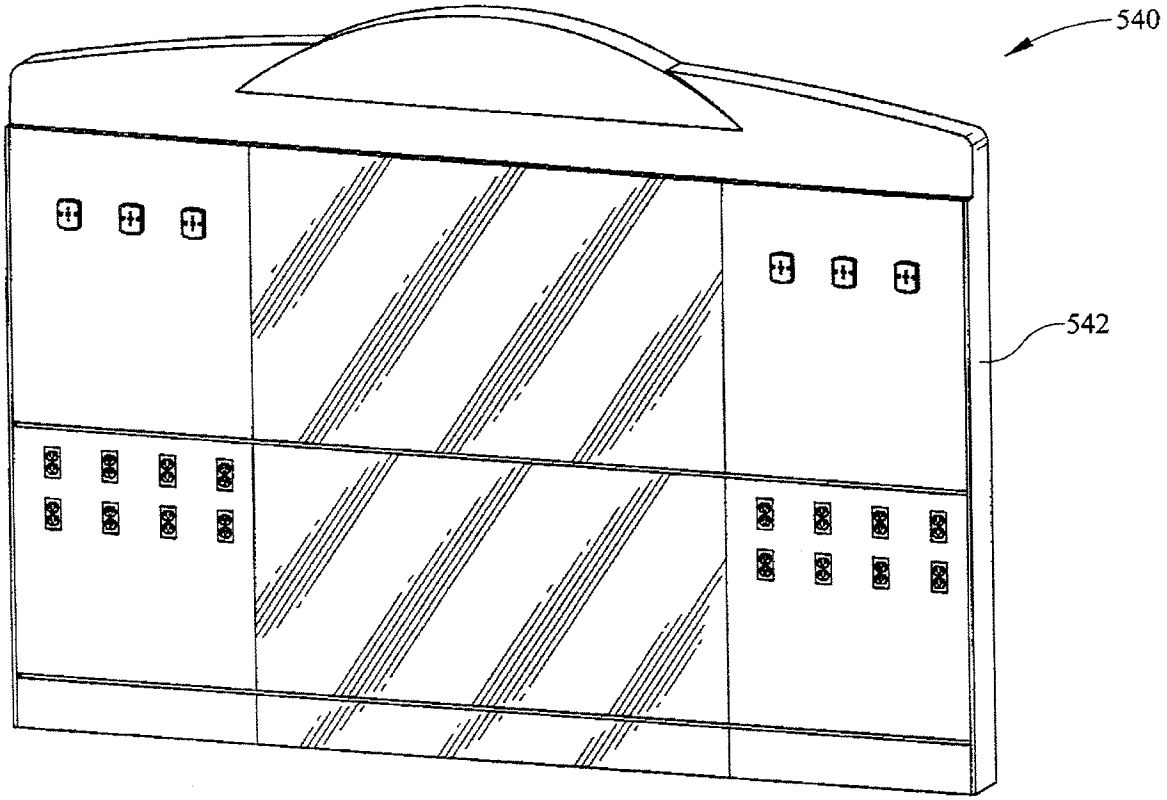
FIG. 18 is a perspective view of a surface mounted modular architectural room system.

In the embodiment shown in FIG. 18, a modular architectural room system 540 is a surface mounted system. In this illustrative configuration, modular architectural room system 540 has a perimeter wall 542 with sufficient thickness to space the surface of the modular architectural room system 540 away from a wall (not shown) on which the modular architectural room system 540 is mounted. As compared to the embodiment shown in FIG. 17, modular architectural room system 540 provides for routing of gases and electrical service within the modular architectural room system 540 and not within the wall. It is contemplated in such a system that gas and electrical service may be delivered from the main source line through the ceiling and into the modular architectural room system 540. The routing of gases and electrical service may be facilitated by the use of manifolds and junction boxes as described above. In a surface mounted configuration such as the modular architectural room system 540, some room is taken from the patient room to facilitate the routing of gases and electrical service.

Figure 19:
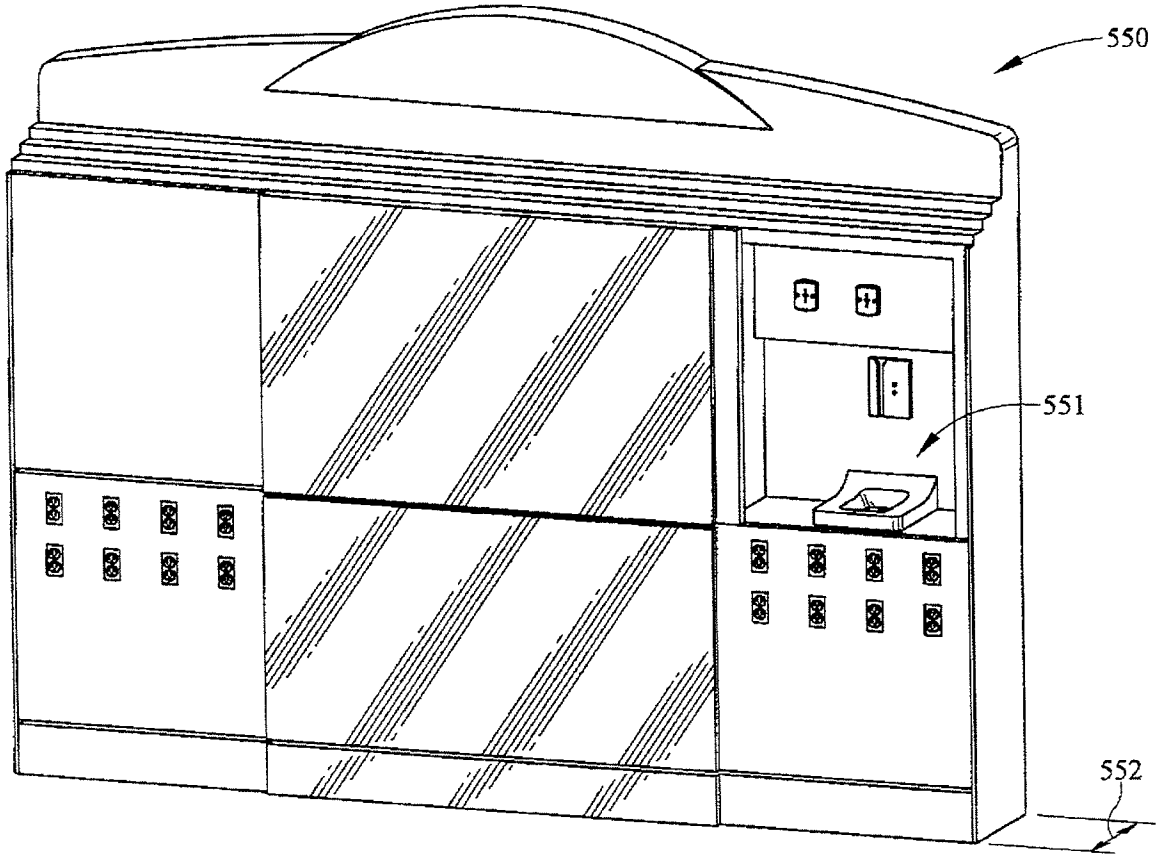
FIG. 19 is a perspective view of a wall-mounted cabinet embodiment of a modular architectural room system according to the present disclosure.

In yet another embodiment of a modular architectural room system 550 shown in FIG. 19, the modular architectural room system 550 is configured as a cabinet in which gases, electrical service, and plumbing is managed within the system 550 thereby requiring additional thickness away from a wall in the patient room as indicated by the arrow 552. For example, the modular architectural room system of 550 is configured to include a sink 551 integrated into the modular architectural room system 550.

Figure 2:
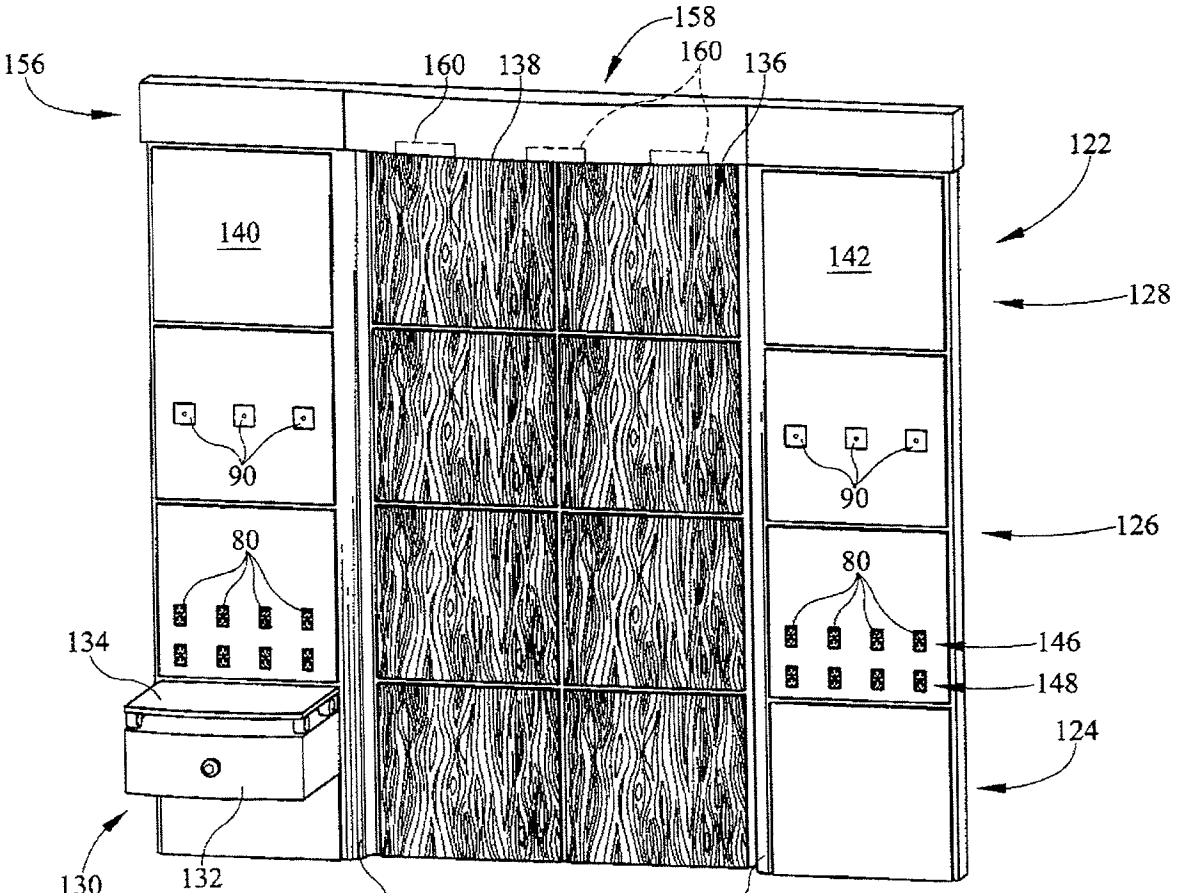
FIG. 2 is a perspective view of another embodiment of a modular architectural room system.

Referring now to FIG. 2, yet another embodiment of modular architectural room system 122 includes a base zone 124, a care zone 126, and an aesthetic zone 128. The modular architectural room system 122 is shown to include a storage assembly 130 including a drawer 132 and a shelf 134 supported above the drawer 132 in the base zone 124. The modular architectural room system 122 includes a space 136 into which a portion of a patient support apparatus 54 may be positioned. A surface 138 of the space 136 is spaced apart from a surface 140 and a surface 142 positioned on adjacent sides of the space 136. A pair of moldings 144 are each a transition surface from the surfaces 140 and 142 to the surface 138. In the embodiment shown in FIG. 2, the modular architectural room system 122 includes a row 146 of electrical power outlets 80 which are connected to an emergency backup system within the hospital. These types of outlets are known in the art to be used for critical care equipment such as life-support equipment, for example. A second row 148 of electrical power outlets 80 are not connected to the emergency backup supply and would be used for non-critical care devices. The backed-up electrical power outlets 80 are colored orange to designate the emergency back-up circuit is connected to the electrical power outlets 80 in row 146. The electrical power outlets 80 such as those shown in the second row 148 would not be colored orange as they are not connected to emergency electrical power.

Also included in the care zone 126 are two sets of gas outlets 90 positioned on either side of the space 136. The modular architectural room system 122 is configured with all of the electrical and gas outlets are exposed at all times. This exemplifies a relatively simple configuration of modular architectural room system as compared to the embodiment shown in FIG. 1. In addition, a header 156 is positioned at the top of the modular architectural room system 122 with a curved portion 158 positioned over the space 136 and including a number of lights 160 which are each independently operable to vary the amount of light in the patient room. The panels in the space 136 have a wood grain surface treatment which is different from the surface treatment of the other panels of the modular architectural room system 122.

It should be understood that the storage assembly 130 is part of a modular system of storage structures which may be used in different embodiments of modular architectural room systems. The storage assembly 130 may be positioned on either side of the space 136 and in any of a number of positions on the modular architectural room systems of the present disclosure.

Figure 3:
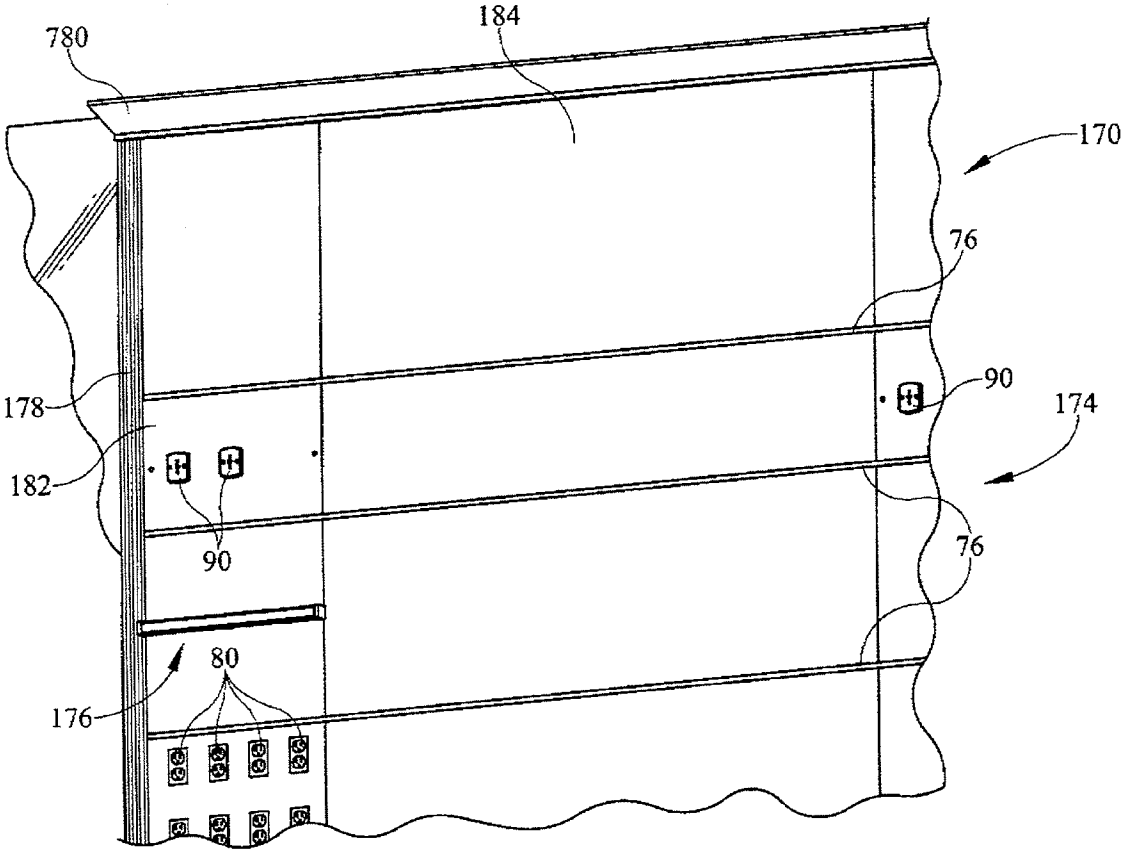
FIG. 3 is a perspective view of a portion of yet another embodiment of a modular architectural room system according to the present disclosure.

Referring now to FIG. 3, yet another embodiment of modular architectural room system 170 is shown to include a number of gas outlets 90 positioned in a care zone 174. The modular architectural room system 170 further includes an accessory support rail 176 which is configured to support a number of clamp mechanisms for supporting medical equipment. The modular architectural room system 170 further includes a metal trim piece 178 positioned on a lateral side of the modular architectural room system 170 to provide a distinctive aesthetic look. The modular architectural room system 170 further includes a crown molded trim piece 180 positioned on top of the modular architectural room system 170.

Figure 4:
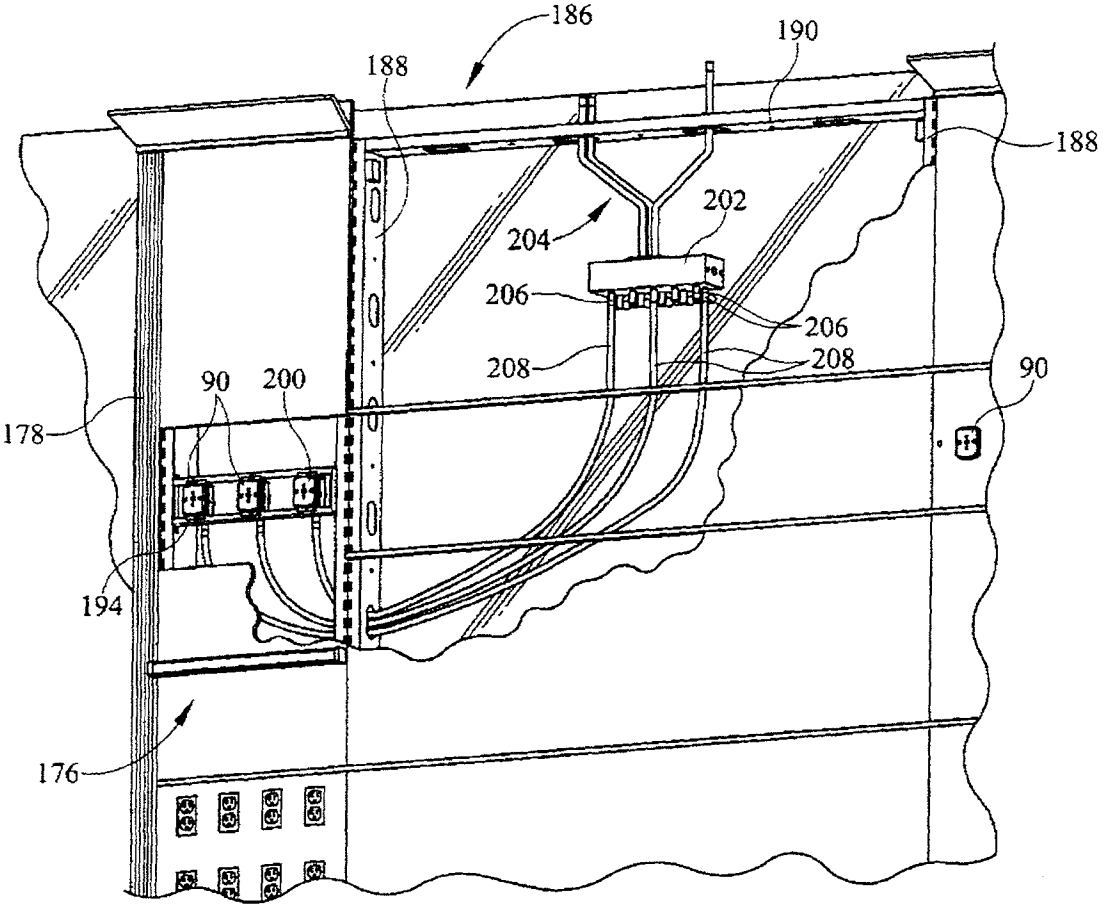
FIG. 4 is a perspective view of the system of FIG. 3 with portions removed and portions cutaway to show the structure of the system.

The modularity of the architectural room systems disclosed herein can be exemplified by the addition of another gas outlet 172 to the modular architectural room system 170. As shown in FIG. 3, the modular architectural room system 170 includes a panel 182 with two gas outlets 90. Referring now to FIG. 4, when panel 182 and a second panel 184 (as seen in FIG. 3) are removed, a frame structure of the modular architectural room system 170 is exposed. The modular architectural room system 170 includes a frame 186 having a plurality of support columns 188 supporting a header 190. As seen in FIG. 4, a gas outlet support rail 194 spans a pair of columns 188 and supports some of the gas outlets 90. A new gas outlet 90 designated by a reference designator 200 is added to the modular architectural room system 170 by mounting the gas outlet 200 onto the support rail 194 and routing a flexible gas line 208 from the gas outlet 200 to a gas manifold 202 supported in the space behind the panel 184. The gas manifold 202 is connected to the central hospital gas supply systems via a group of conduits 204. The gas manifold 202 includes a number of ports 206 which are configured to receive the flexible gas line 208 for each of the respective gas outlets 172. As shown in FIG. 4, the gas manifold 202 has unused ports 206 which provide for future expansion of gas outlets 90. It should be noted that each gas outlet is plumbed to a specific port 206 associated with the particular service being provided by gas outlet 90 whether that be vacuum, compressed air, or oxygen. It should also be noted that other gas services, such as nitrogen, for example, may also be routed to any of the gas outlets described in this disclosure, depending on the needs of the facility.

Figure 5:
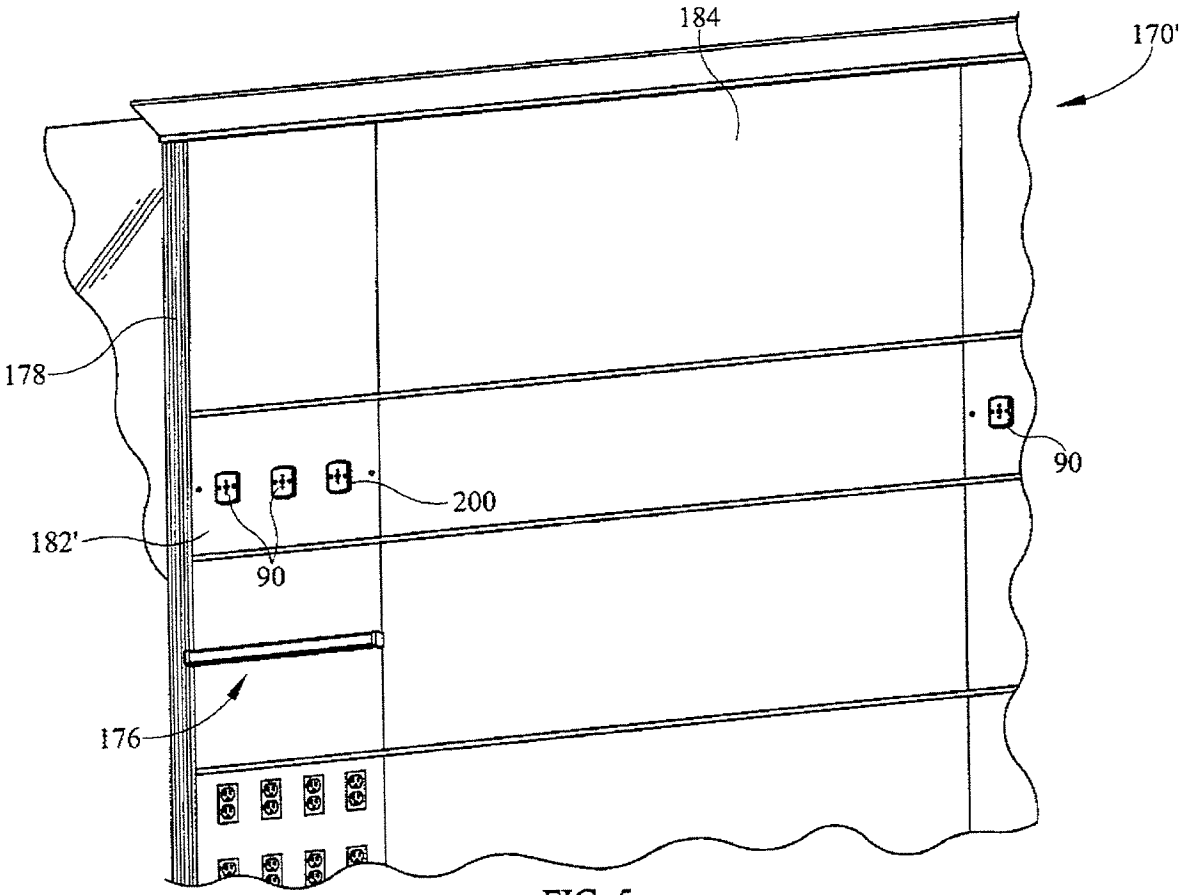
FIG. 5 is a perspective view of the system of FIG. 3 with an additional gas outlet added within the scope of the present disclosure.

Once the gas outlet 200 is mounted to the support rail 194, the panel 182 can be modified to allow for addition of the gas outlet 200 by knocking out a respective portion of the panel 182. As will be described in further detail below, panels such as panel 182 of the present disclosure may have a number of knockouts formed within the panel to allow the panel to be modified on site to configure a particular system. As used herein, the term knockout refers to a partially cutout piece in metal or plastic that can be forced out when a hole is needed. This also allows for upgradeability as disclosed in FIGS. 3-5. Referring again now to FIG. 4, the knockout 210 for the new gas outlet 200 is removed and the panel 182, as modified, is mounted to columns 188. The panel 184 is also replaced and the upgraded system 170' now includes a gas outlet 200 as shown in FIG. 5.

Figure 6:
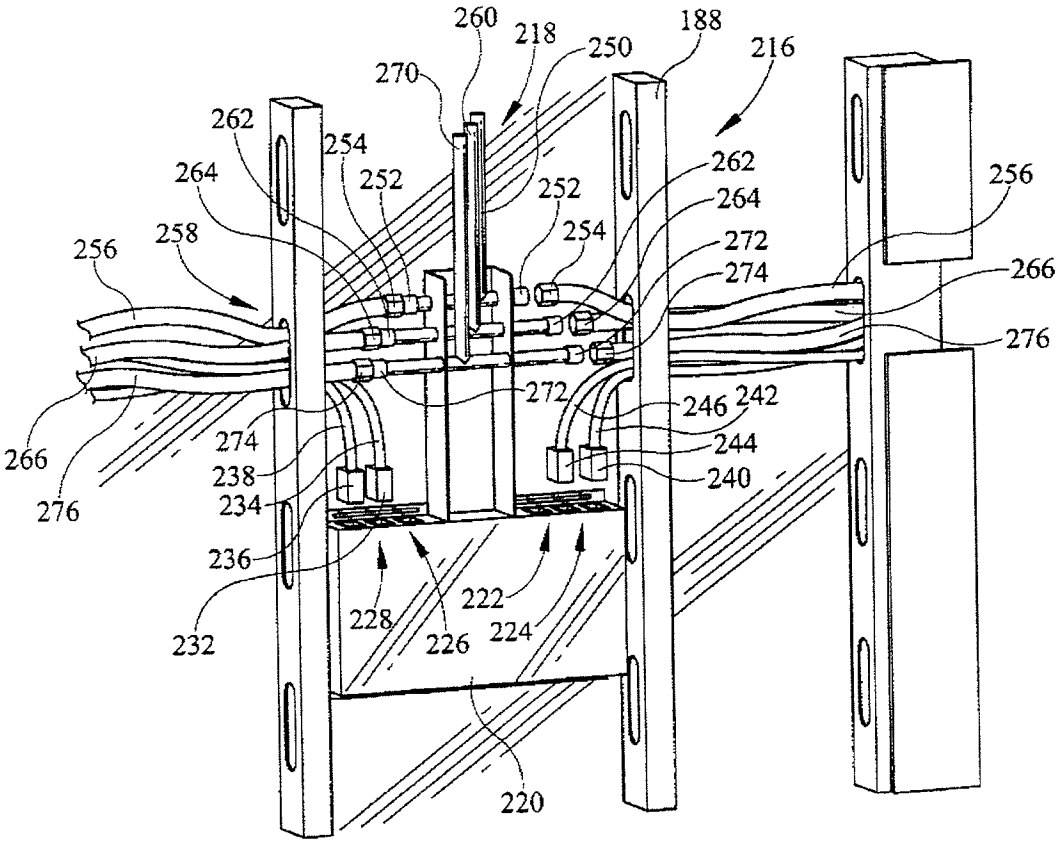
FIG. 6 is a perspective view of a portion of a modular architectural room system with a portion of the system opened to expose a gas manifold.

Referring now to FIG. 6, an illustrative embodiment of a central modular gas and power distribution system 216 is shown to include a gas manifold 218 and an electrical junction box 220. It should be understood that gas manifold 218 is one embodiment of gas manifold and may be replaced with other embodiments such as a gas manifold 202. The electrical junction box 220 is supported between two columns 188 in a modular architectural room system as discussed above. The electrical junction box 220 receives a central electrical service from a backed-up electrical service and a non-backed-up electrical service and provides distribution of each of those services. For example, the electrical junction box 220 includes a receptacle 222 configured to mate with a plug 244 on a non-backed-up electrical line 246. The receptacle 222 is coupled to the non-backed-up central electrical service. Engaging the plug 244 with receptacle 222 connects the electrical line 246 to the central non-backed-up service. The electrical line 246 is connected to a standard electrical power outlet 80. Similarly, outlet 224 on electrical junction box 220 is coupled to an electrical service line and is configured to receive a plug 240 on a backed-up flexible electrical line 242 which may be coupled to another electrical power outlet 80. Another non-backed-up outlet 226 is shown to correspond to a plug 232 on a non-backed-up electrical line 234. An electrical outlet 228 is configured to receive a plug 236 of a flexible backed-up line 238.

Utilizing expandable electrical junction boxes and gas delivery systems, a room which is initially configured to provide care for lower acuity patients may be upgraded to increase the acuity supported in the room. This allows a facility to reduce the initial cost of construction of certain rooms in the facility by minimizing the number of electrical and gas outlets installed. In addition, as will be discussed below, the structure of the modular architectural rooms systems allows various panels to be removed and replaced to reconfigure the look of the room without the need for replacement of the core structure supporting the head wall of the room. It is contemplated that this will allow facilities to modernize their rooms without the need for removal and replacement of the structures supporting the delivery equipment. As such, the cost of upgrades and modernization of rooms may be minimized by replacing only surface panels. In addition, the repair of gas and electrical outlets is simplified.

The columns 188 include a number of apertures 258 through which the electrical lines 242, 246, 234, and 238 may be routed when configuring or upgrading a particular modular architectural room system. The electrical junction box 220 is supported from a channel 248 which is also configured to support the gas manifold 218. In the embodiment shown in FIG. 6, the gas manifold 218 includes an incoming vacuum line 250 which is plumbed in a T configuration having a pair of ports 252 which are configured to be engaged by the connectors 254 on respective flexible vacuum lines 256. Coupling of the connectors 254 to the ports 252 causes a port 252 to open thereby allowing fluid communication between the vacuum line 250 and the flexible line 256. Similarly, a compressed air line 260 includes ports 262 configured to be engaged by the connectors 264 of the flexible compressed air lines in 266. The gas manifold 218 also includes an oxygen line 270 with ports 272 configured to be engaged by connectors 274 of flexible oxygen lines 276. Each of the flexible lines may be connected to a respective gas outlet.

Figure 7:
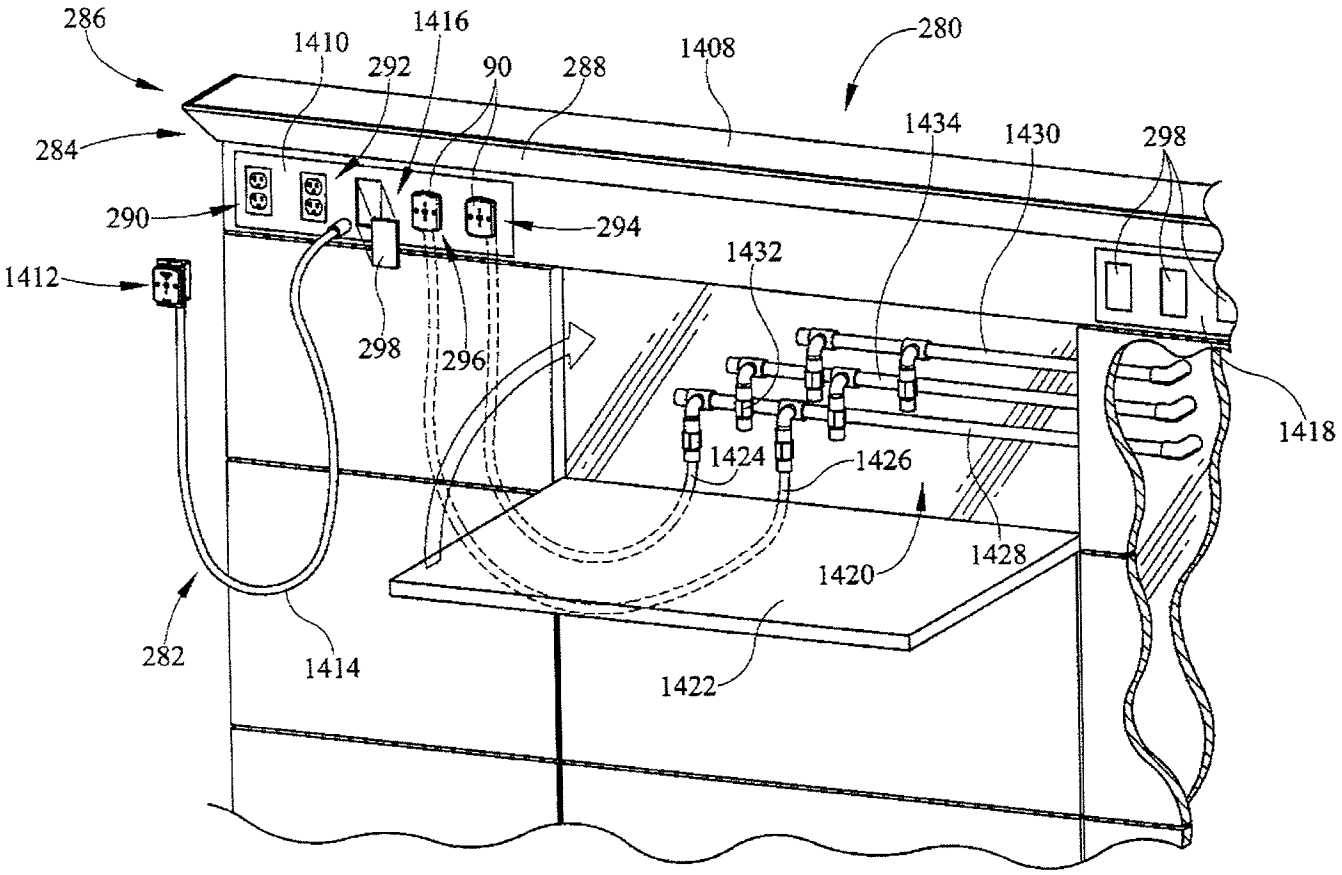
FIG. 7 is a perspective view of a portion of a modular architectural room system having an integrated manifold system and electrical junction box.

In another embodiment of a modular architectural room system 280 shown in FIG. 7, the modular architectural room system 280 includes a base zone 282, a care zone 284, and an aesthetic zone 286. In the embodiment shown in FIG. 7, the care zone 284 and the aesthetic zone 286 are configured such that the modular architectural room system 280 is a waist high wall unit. The care zone 284 is comprised of a single row of service outlets and service outlet blanks, and the aesthetic zone 286 is comprised of a cap 288 which provides a shelf surface 1408 at approximately waist height of a caregiver. In the embodiment shown in FIG. 7, the modular architectural room system 280 includes an electrical outlet 290, an electrical power outlet 292, a vacuum outlet 294, and a compressed air service outlet 296. A knockout panel 298 is removed from a service outlet support 1410 such that the modular architectural room system 280 can be upgraded with an oxygen service outlet 1412. The oxygen service outlet 1412 is coupled to a flexible hose 1414 which is fed through an opening 1416 formed by the removal of knockout panel 298.

An additional service outlet support 1418 includes a plurality of knockout panels 298 which may be removed to upgrade the modular architectural room system 280. The modular architectural room system 280 includes a preconfigured gas manifold 1420 positioned behind a panel 1422. A flexible compressed air hose 1424 and a flexible vacuum hose 1426 are each shown coupled to the respective manifold lines 1428 and 1430. Addition of the oxygen service outlet 1412 includes coupling the flexible hose 1414 to a port 1432 on an oxygen supply line 1434 of the manifold 1420. Upon completion of the assembly of the hose 1414 to the port 1432, the panel 1422 is replaced. The manifold 1420 includes multiple ports for each of the gas services provided; the manifold is coupled to the central hospital service supply lines upon installation of the modular architectural room system 280 within the patient room.

Figure 8:
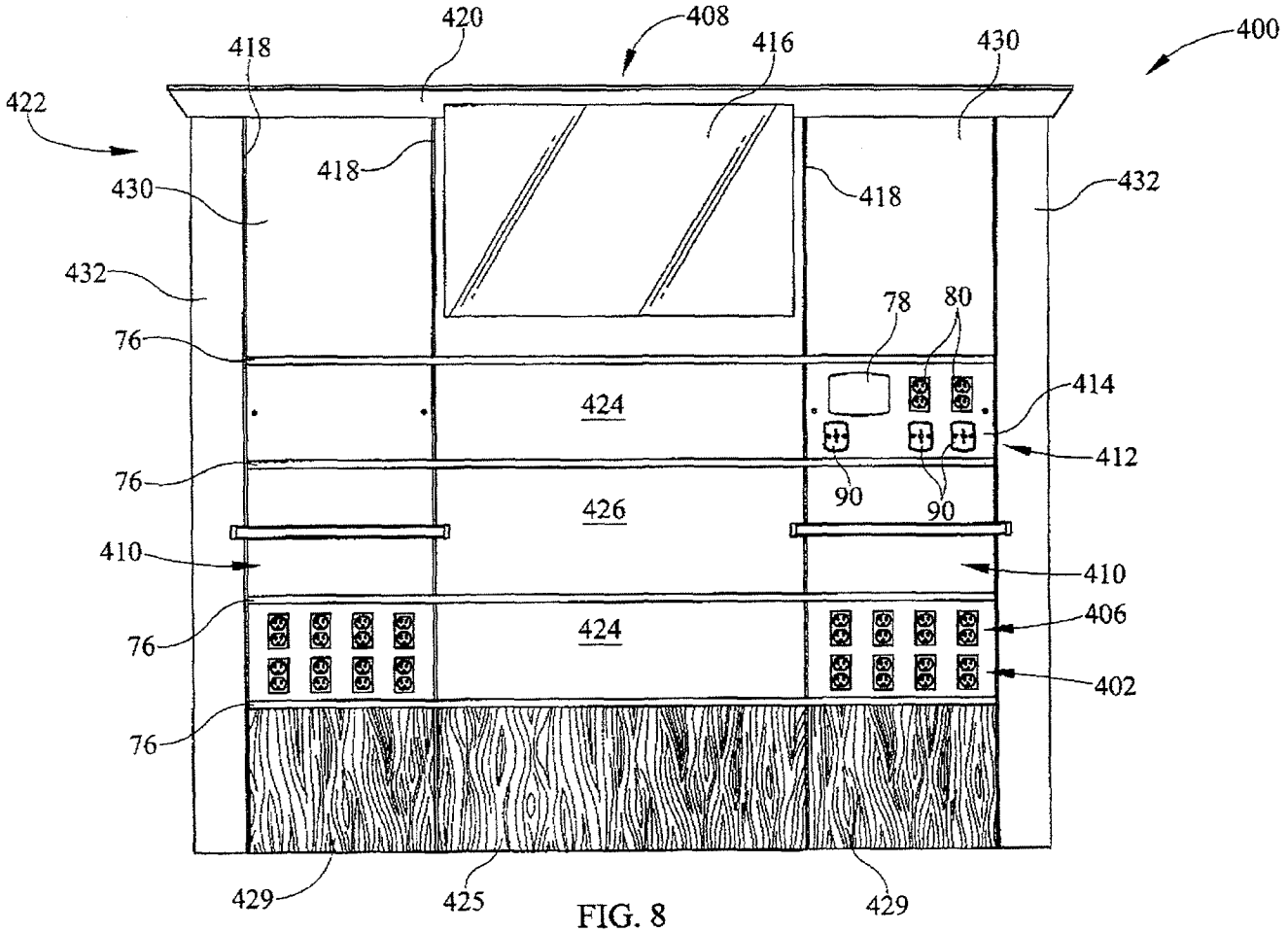
FIG. 8 is a is a front elevation view of yet another embodiment of a modular architectural room system.

In another embodiment of a modular architectural room system 400 shown in FIG. 8, the modular architectural room system 400 is configured for a critical care environment and has a row 402 of electrical outlets 80 positioned at the bottom of a care zone 404. A row 406 of electrical power outlets 80 is positioned above the row 402. Positioned on opposite sides of a bed zone 408 are two Fairfield rails 410. Additional electrical power outlets 80 are positioned above the Fairfield rail 410 shown on the right of FIG. 8. A row 412 of gas outlets 90 are also positioned on a panel 414. A nurse call system interface 78 is also positioned on panel 414.

The modular architectural room system 400 is configured to be positioned in a critical care environment. In such an environment, patient care includes continuous monitoring of patient vital statistics. In some cases, patient vital statistics are represented graphically such as in the case of an EKG or a blood oxygen saturation level. The modular architectural room system 400 includes a display 416 which may be coupled to monitoring equipment to display vital patient statistics and/or patient diagnostic images such as ultrasound, x-ray, CAT images, video feeds from laparoscopic devices and other clinical images. In the embodiment shown in FIG. 8, the display 416 is an LCD. In other embodiments, the display 416 may be a different device such as, for example, an OLED device. The large size of the display 416 permits vital patient statistics and patient diagnostic images to be visualized more easily by caregivers.

The modular architectural room system 400 includes a combination of functional and aesthetic aspects. For example, the modular architectural room system 400 includes a plurality of the horizontal moldings 76 which create a "reveal" effect in the modular architectural room system 400. Additional vertical moldings 418 are positioned between vertical edges of panels in modular architectural room system 400 also creating a vertical "reveal" effect in the modular architectural room system 400. The reveal effect provides the appearance that the panels are spaced apart. Additionally, the modular architectural room system 400 includes a crown molding 420 positioned on top of aesthetic zone 422 of modular architectural room system 400. To break-up the surface of the wall, the modular architectural room system 400 includes a number of different sized panels 424, 425, 426, 428, 429 and 430 which covers the frame structure of the modular architectural room system 400. The panels 425 and 429 have a wood grain surface treatment. The panels 424, 426, 428 and 430 have a solid color surface treatment. The modular architectural room system 400 also includes a pair of elongates end caps 432 positioned on the two lateral sides of the modular architectural room system 400. In the embodiment shown in FIG. 8, the caps 432 are aluminum extrusions. In other embodiments, caps 432 may be formed of other materials or include some other surface preparation. For example, the panels 424, 426, 428, and 430 as well as the end caps 432 may all include a laminate structure having a wood grain effect or other aesthetic effect. Some of the panels may have a surface treatment which is different from the surface treatment of other panels to create a color contrast between panels.

Figure 9:
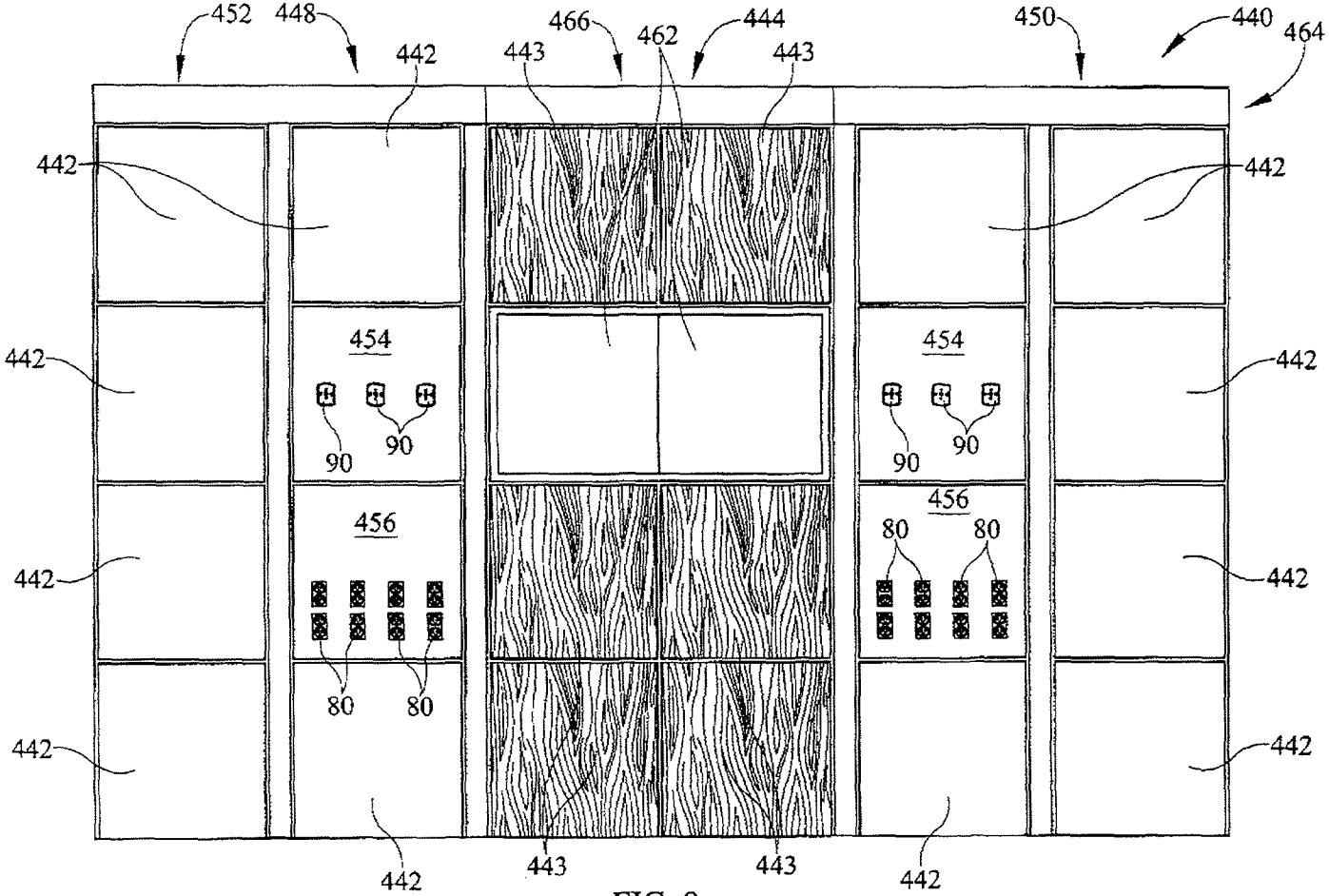
FIG. 9 is a front elevation view of still yet another embodiment of a modular architectural room system.

Another embodiment of modular architectural room system 440 shown in FIG. 9 includes a number of panels 443 positioned in a bed region 444. The panels 443 have a wood grain surface treatment. Two accessory regions 446 and 448 are positioned on lateral sides of bed region 444. The modular architectural room system 440 further includes two tertiary regions 450 and 452 positioned laterally outwardly from the accessory regions 446 and 448 respectively. The accessory regions 446 and 448 and the tertiary regions 450 and 452 have a surface treatment that is different from the surface treatment of the panels 443 in the bed region 444. The modular architectural room system 440 is configured with a gas panel 454 positioned in each of the accessory regions 446 and 48 respectively. Each panel 454 includes a number of gas outlets 90. The modular architectural room system 440 also includes a panel 456 positioned in each of the accessory regions 446 and 448 respectively. Each panel 456 includes two rows 458 and 460 of electrical power outlets 80. The modular architectural room system 440 is configured to include a pair of display panels 462 positioned in the bed region 444 and configured to display vital patient statistics and/or patient diagnostic images.

Figure 10:
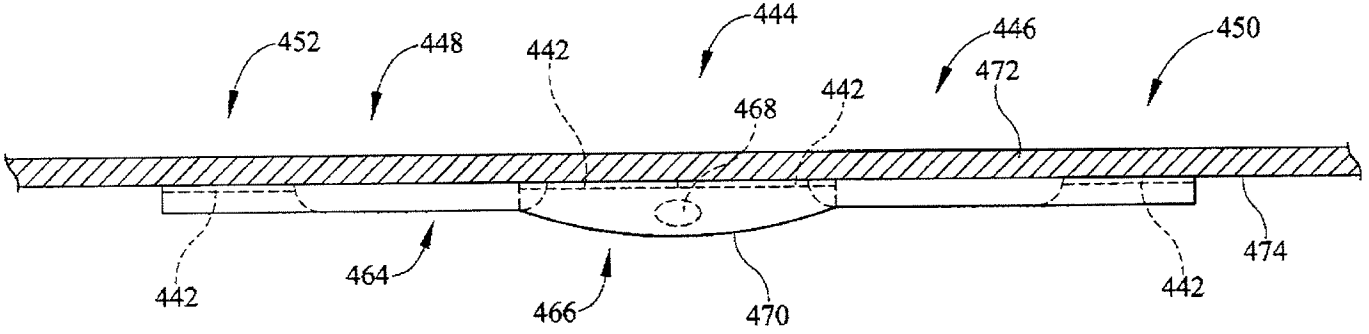
FIG. 10 is a top view of the modular architectural room system of FIG. 9, FIG. 10 showing a wall on which the system of FIG. 9 is mounted, the wall and cross-section.

The modular architectural room system 440 includes a header 464. The header 464 includes an overhang 466 positioned above the panels 442 and the display panels 462 in the bed region 444. The overhang 466 includes a light fixture 468 which is positioned to illuminate the bed region 444 below the header 464. As shown in FIG. 10, the overhang 466 has a curved front surface 470 which extends outwardly over the bed region 444, and the panels 442 and 462. The accessory regions 446 and 448 extend outwardly from a stud wall 472 so that there is sufficient room between the outer surface of the panels 442, 454, and 456 to allow gas conduits and electrical lines to be routed. The panels 442 in the tertiary regions 450 and 452 are flat panels positioned directly adjacent a surface 474 of the studded wall 472. The zones are separated by curved members 476 which provide for the aesthetic transition between the accessory regions 446 and 448 and the flat panel zones including the tertiary regions 450, 452 and bed region 444. In this configuration, The modular architectural room system 440 uses decorative flat-panel construction in zones 450 and 452 and surface mounted arrangements in zones 446 and 448 provide for mounting of the outlets 80, 90 outside of the studded wall 472. This prevents the issue of utilities such as gas conduits and electrical lines having to be routed around outlets recessed into the studded wall 472. Service lines such as gas conduits and electrical lines, for example, within the studded wall 472 may be routed freely and additional outlets may be added within the accessory regions 446 and 448 without re-routing services within studded wall 472.

Figure 11:
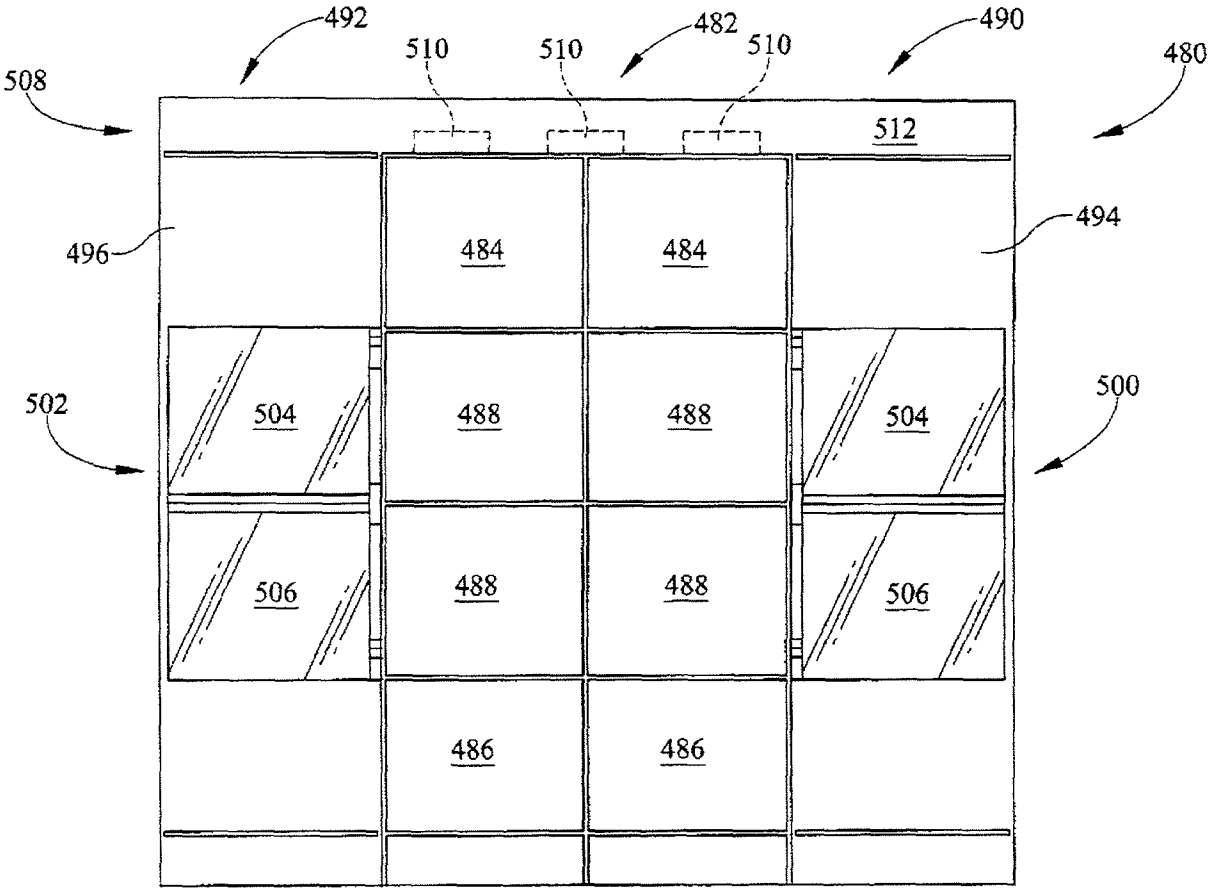
FIGS. 11-13 are front elevation views of still another embodiment the modular architectural room system, the system including a storage space with vertically movable doors.

In yet another embodiment of a modular architectural room system 480 shown in FIG. 11, a bed region 482 includes a pair of flat panels 484 and a pair of smaller flat panels 486. Four reflective panels 488 are positioned in the bed region and reflect a minimal amount of light while not providing a complete mirror surface. The modular architectural room system 480 includes two accessory regions 490 and 492 positioned on lateral sides of the bed region 482. The accessory regions 490 and 492 include surface-mounted wall portions 494 and 496 respectively. The wall portions 494 and 496 are continuous surfaces and the accessories associated with accessory regions 490 and 492 are positioned within the surface-mounted wall portions 494 and 496. As shown in FIG. 11, wall portions 494 and 496 each include accessory regions 500 and 502, respectively. The accessory regions 500 and 502 each include a pair of vertically movable doors 504 and 506. The doors 504 and 506 are integrally connected via a mechanism (not shown) which causes the doors 504 and 506 to move in unison to expose accessories positioned behind the doors 504 and 506 as indicated in FIG. 12.

Figure 12:
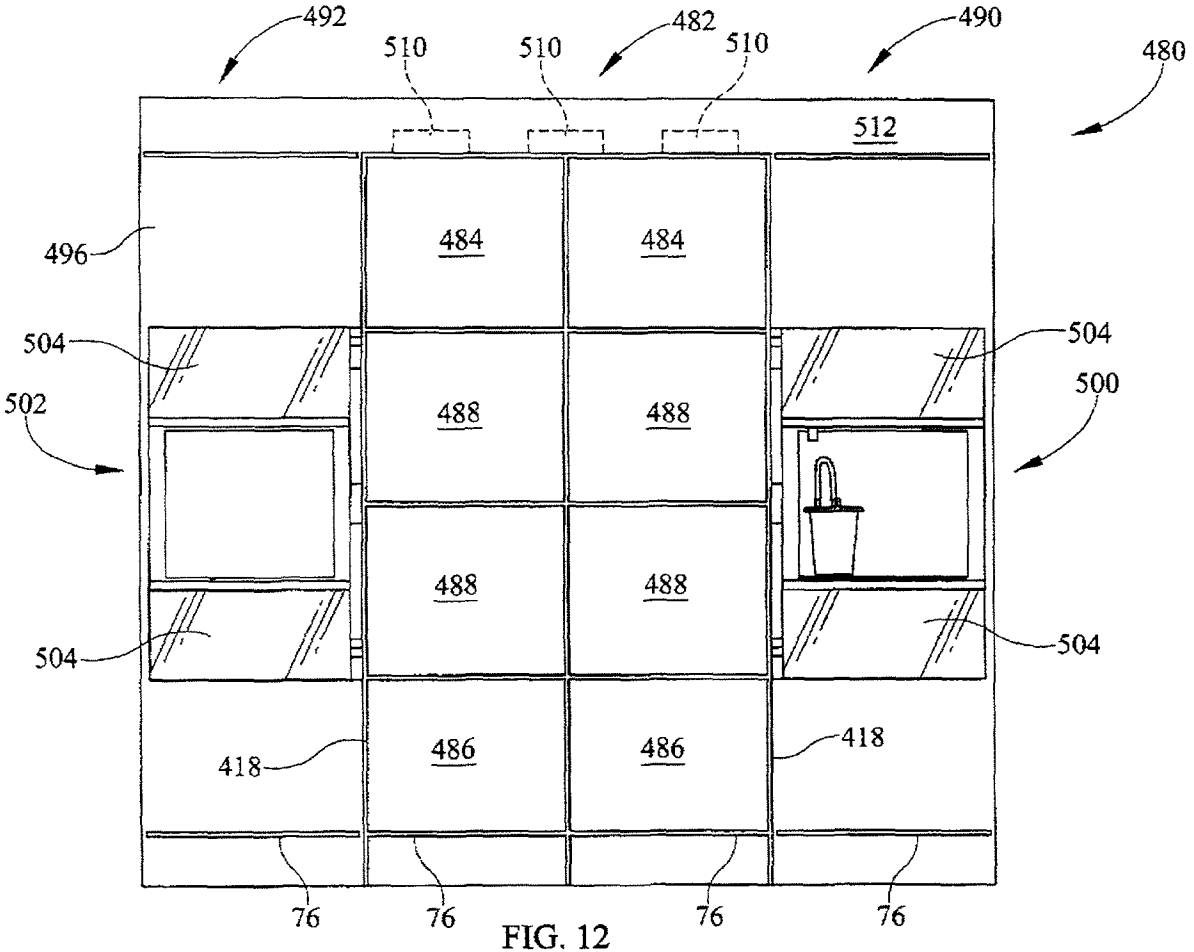

Referring to FIG. 12, the doors 504 and 506 are partially opened to expose a portion of the accessories and outlets within the respective accessory regions 500 and 502. The doors 504 and 506 are recessed within a portion of the wall portions 494 and 496 such that the doors 504 and 506 are out of view when fully opened. The doors 504 and 506 are flexible members which are gathered on respective rollers (not shown). In other embodiments, the doors 504, 506 may slide behind the surfaces of wall portions 494 and 496. Any of a number of accessories may be positioned behind the doors 504 and 506 in the embodiment shown in FIG. 13.

It should be understood that wall portions 494 and 496 extend outwardly away from a studded wall positioned behind the modular architectural room system 480. The modular architectural room system 480 includes a header 580 which includes a number of lights 510 which are positioned in the header 580 above the bed region 482 and illuminate the bed region 482. A front surface 512 of the header 508 is coplanar with the outer surfaces of the respective wall portions 494 and 496. However, the panels 484, 486, 488 within the bed region 482 are configured as flat panels such that the surface 512 of the header 508 is spaced apart from the surfaces of the panels 484, 488, 486. The lights 510 are positioned within header 508 such that they illuminate a space below 508 within the zone 482.

Figure 14:
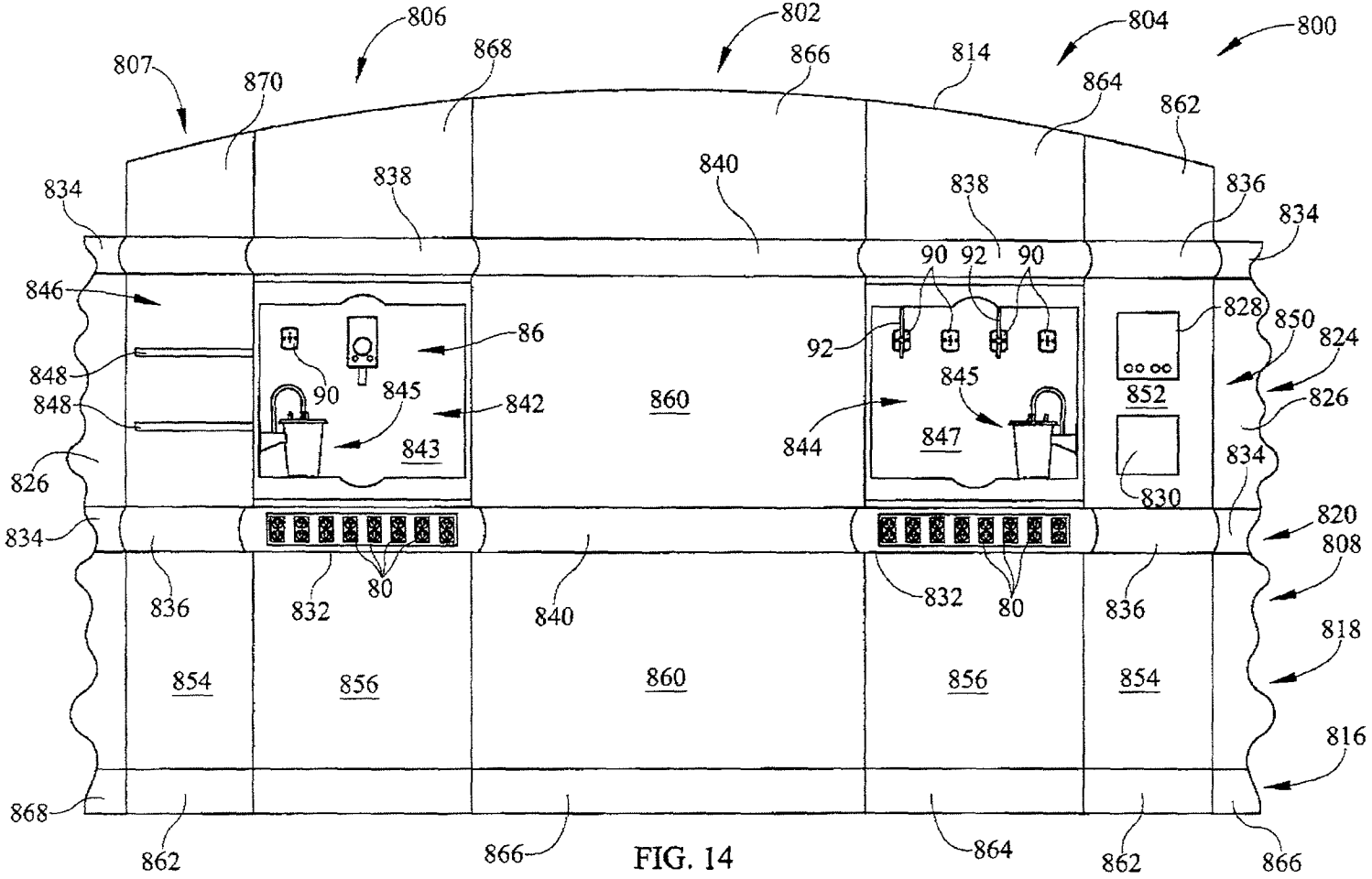
FIG. 14 is a front elevation view of another embodiment of a modular architectural room system.

Yet still another modular architectural room system 800 shown in FIG. 14 includes a bed region 802 with accessory regions 804 and 806 positioned on the lateral sides of the region 802. In the embodiment shown in FIG. 14, modular architectural room system 800 is configured with the bed region 802 having flush mounted panels. The accessory regions 804 and 806 are cabinet structures as disclosed above. The modular architectural room system 800 includes a tertiary region 805 positioned adjacent the accessory region 804 away from the region 802. Another tertiary region 807 is positioned adjacent the accessory region 806. The tertiary regions 805 and 807 are surface mounted sections. All of the regions 802, 804, 806, 805, and 807 are mounted to a wall 826. The differences in the depths of the regions allow each of the regions to serve separate functions.

The regions of system 800 are separated vertically into a base zone 818, a care zone 810, and an anesthetic zone 812. The base zone 818 includes a lower section 816. The lower section 816 includes a number of molding pieces 862, 864, 866, 864, and 862 spanning across the regions 805, 804, 802, 806, 807 respectively. Two complementary molding pieces 868 are positioned on the wall 826 adjacent the tertiary regions 805 and 807. The molding pieces 862, 864, 866, and 868 have a first surface treatment. The tertiary regions 805 and 807 each include a panel 854 in the base zone 818. Each of the accessory regions 804 and 806 includes a panel 856 in the base zone 818. A panel 860 is positioned above the molding piece 866 in the bed region 802 of base zone 818. Each of the panels 854, 856, and 860 have a surface treatment and color which is different from the color of the molding pieces in lower section 816 and provide a contrast to lower section 816. The panels used in the embodiments of the modular architectural room systems disclosed herein may include veneered surface treatments, laminated surface treatments, painted surface treatments, fabric surface treatments, and other textured surface treatments within the scope of this disclosure.

The care zone 810 includes a row 820 of molding pieces spanning across regions 802, 804, 805, 806, and 807. Each of the tertiary regions 805 and 807 include a molding piece 836. Each of the accessory regions 804 and 806 include a molding 837 configured with a number of electrical power outlets 80 positioned in the face of the molding 832. Yet another molding piece 840 is positioned in the bed region 802 of care zone 810.

The tertiary region 805 of care zone 810 includes a communications center 850 including a user interface 828 and a user interface 830 positioned on a panel 852. The user interface 828 is configured as a head wall communications module capable of downloading data from a bed and other peripheral devices for display in the patient room and transfer to a central hospital information system. The user interface 830 is as a bar code scanning system allowing caregivers to scan barcodes of patient data and medication data for input into the central hospital information system.

The accessory regions 804 and 806 in care zone 810 are configured to include storage spaces 844 and 842 respectively. Storage space 842 is configured with a back wall 843 on which is mounted to gas outlets 90 with a regulator 88 positioned on one of the gas outlets in the embodiment. The storage space 842 is configured such that a shelf (not shown) is formed in the storage space 842 for the mounting and storage of accessories. For example, a vacuum canister 845 is shown positioned in storage space 842.

Figure 13:
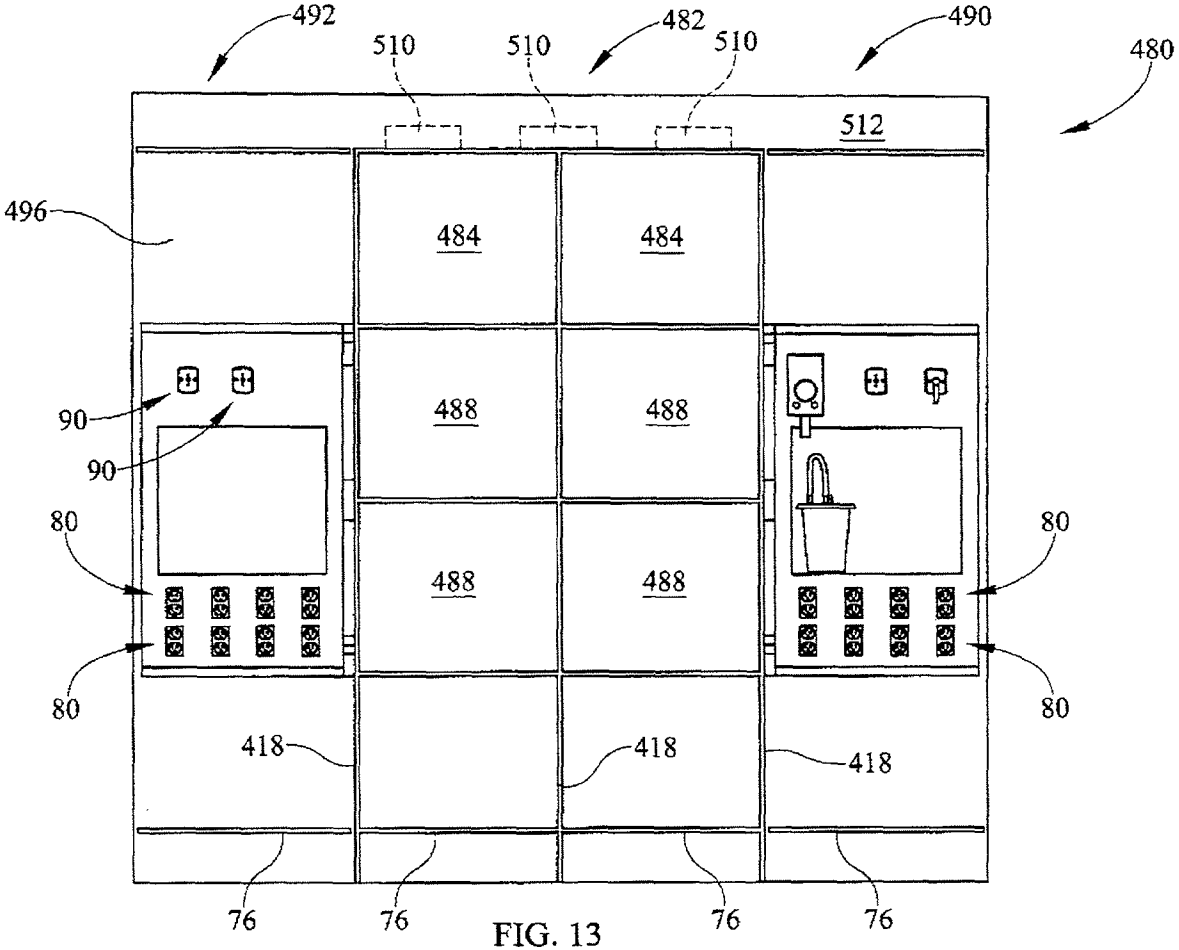

The storage space 844 is configured similarly to the storage space 842 with a back wall 845 and a number of gas outlets 90 positioned on the back wall 847. In the embodiment shown in FIG. 14, two regulators 92 are positioned on two of the gas outlets 90. A vacuum canister 845 is also shown in the storage space 844. It should be understood that any of a number of accessories may be positioned within the storage spaces 842 and 844. The storage spaces 842 and 844 may be configured with closable doors as shown in the embodiment of FIGS. 11-13.

The care zone 810 includes another row 822 of molding pieces positioned on the modular architectural room system 800 across the top of care zone 810. In the embodiment shown in FIG. 14, the molding pieces 832 in the accessory regions 804 and 806 are replaced with two molding pieces 838 which are similar to molding pieces 832 with the electrical power outlets 80 omitted.

The aesthetic zone 812 is configured with a number of panels spaced across the regions 805, 804, 802, 806, and 807 respectively. The tertiary region 805 includes a panel 862 having a textured surface treatment. A panel 870 in the tertiary region 807 is a mirror image of the panel 862 and has a matching surface treatment. The accessory region 804 includes a panel 864 with a surface treatment that matches the panels 862 and 870. The accessory region 806 has a panel 868 which is a mirror image of the panel 864 and has a similar surface treatment. The bed region 802 includes a panel 866 having a surface treatment which is textured and different from the remaining panels 864, 862, 868, 870 in the aesthetic zone 812. The variation in textures across the panels provides an architectural effect of contrasts that is possible with the use of modular panels that may be placed across the frame structure of the various modular architectural room systems disclosed herein. The panels 870, 868, 866, 864, and 862 cooperate to define an upper surface 814 of the aesthetic zone 812. The upper surface 814 is generally arch shaped to provide a unique architectural effect.

The tertiary region 807 is configured to include shelves 848 in the care zone 810. The shelves 848 extend outwardly from a flush mounted panel 858 to form a storage space 846. This can be contrasted to the surface mounted panel 852 of the tertiary region 805. The combination of elements within modular architectural room system 800 as shown in FIG. 14 provides an illustrative example of the potential combination of elements and structures of the present disclosure. The modular architectural room system 800 is a very stylized version of a modular architectural room system and illustrates the flexibility of the system disclosed herein.

Figure 15:
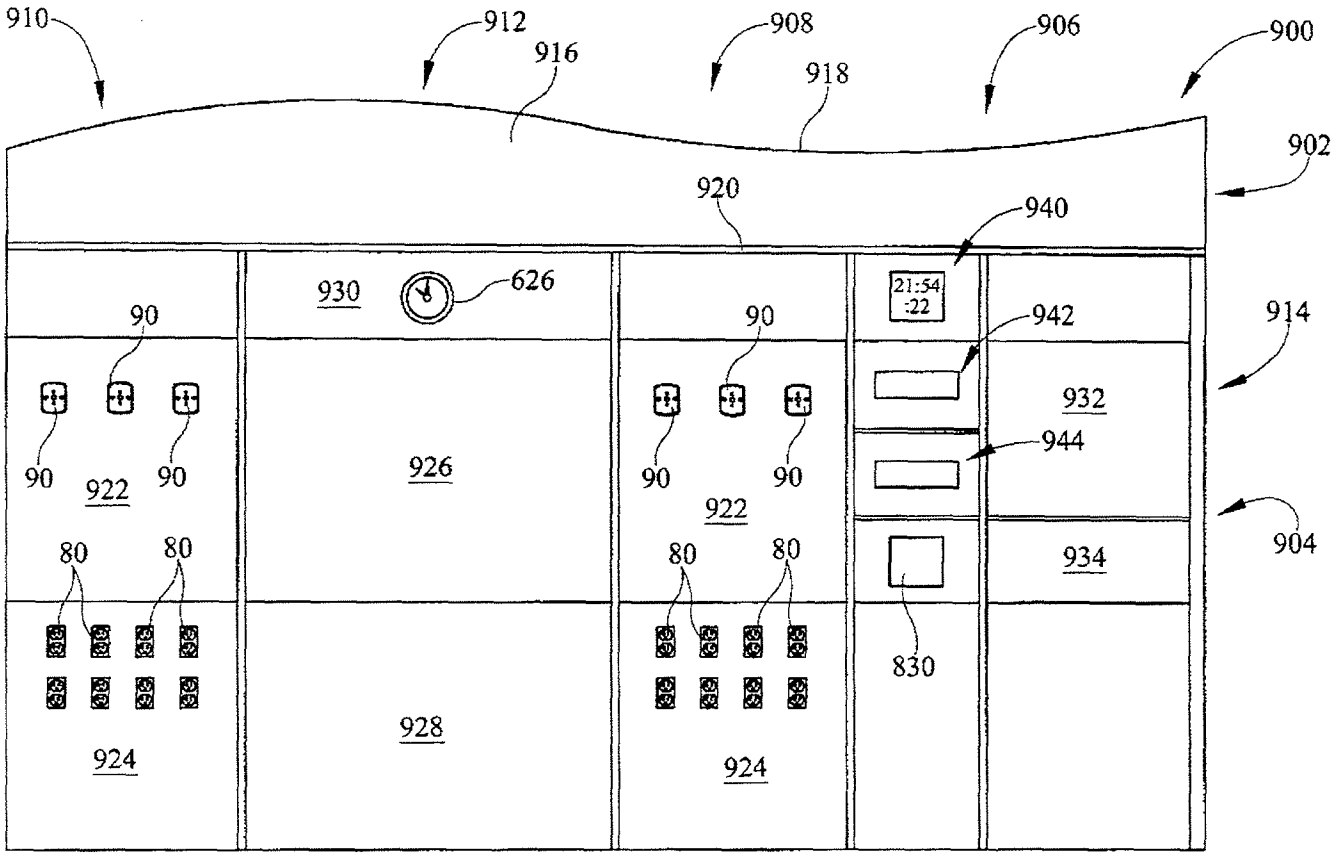
FIGS. 15-16 are front elevation views of yet still another embodiment of a modular architectural room system, the system having a storage space for a bedside charting system, the storage space being closable.
Figure 16:
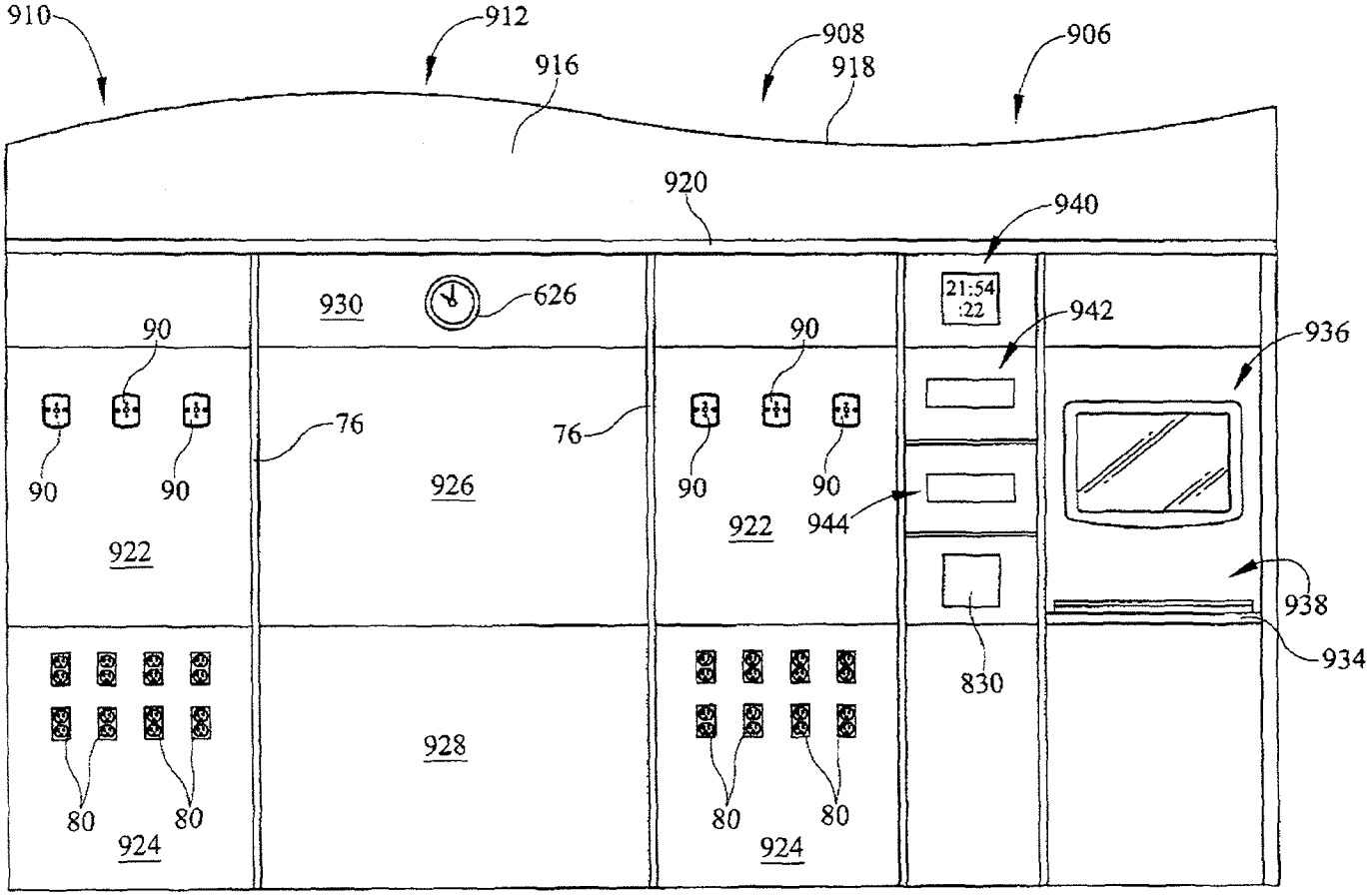

Still yet another embodiment of a modular architecture room system 900 for a patient room shown in FIGS. 15 and 16 includes a care zone 904 and an aesthetic zone 902. The aesthetic zone 902 includes a single panel 916 which spans across a tertiary region 906, two accessory regions 908 and 910, and a bed region 912. The panel 916 includes an arcuate surface 918 which undulates over the top of the panel 916 to provide a unique architectural effect. The aesthetic zone 902 also includes an indirect lighting structure 920 which is configured to illuminate upwardly from the indirect lighting structure 920 provide indirect lighting in the patient room. The accessory regions 908 and 910 each includes a panel 922 having gas outlets 90 mounted on the panel 922. Positioned immediately below the panels 522 are panels 924 which include a plurality of electrical power outlets 80. The bed region 912 includes a pair of panels 926 and 928 with the panel 928 positioned below the panel 926. A clock 626 is positioned on a panel 930 in the bed region above panel 926.

The modular architectural room system 900 includes a single tertiary region 906. The tertiary region 906 includes a storage space 914 having a door 932 and shelf 934 which may be opened to expose a computer monitor 936 and a keyboard 938. The keyboard 938 is positioned on the shelf 934 so that when the shelf 934 is lowered, the shelf 934 serves as a support for the keyboard 938. The modular architectural room system 900 also includes a user interface 830 as discussed above. A stat clock 940 is also positioned in the tertiary region 906. A sharps disposal 942 and a refuse disposal 944 are also positioned in the tertiary region 906.

With the understanding of the modular structure of the present disclosure should be understood that any of a number of combinations of elements maybe arranged to create a room system to fit various needs, architectural tastes, and clinical environments. The discussion of additional embodiments below should be understood to be illustrative nature. Any of a number of distinct modular architectural room systems may be created using the principles described herein.

Figure 37:
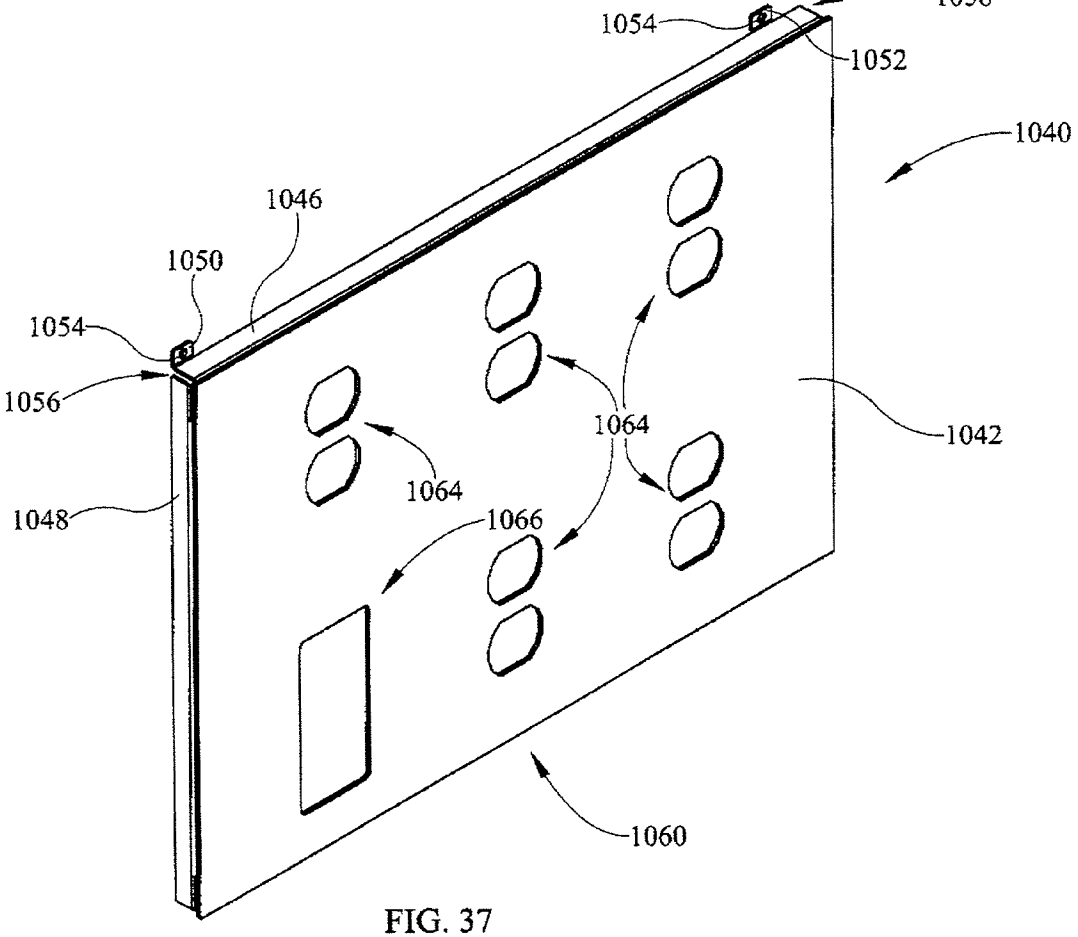
FIG. 37 is a perspective view of one embodiment of a panel used in the modular architectural room systems of the present disclosure.
Figure 38:
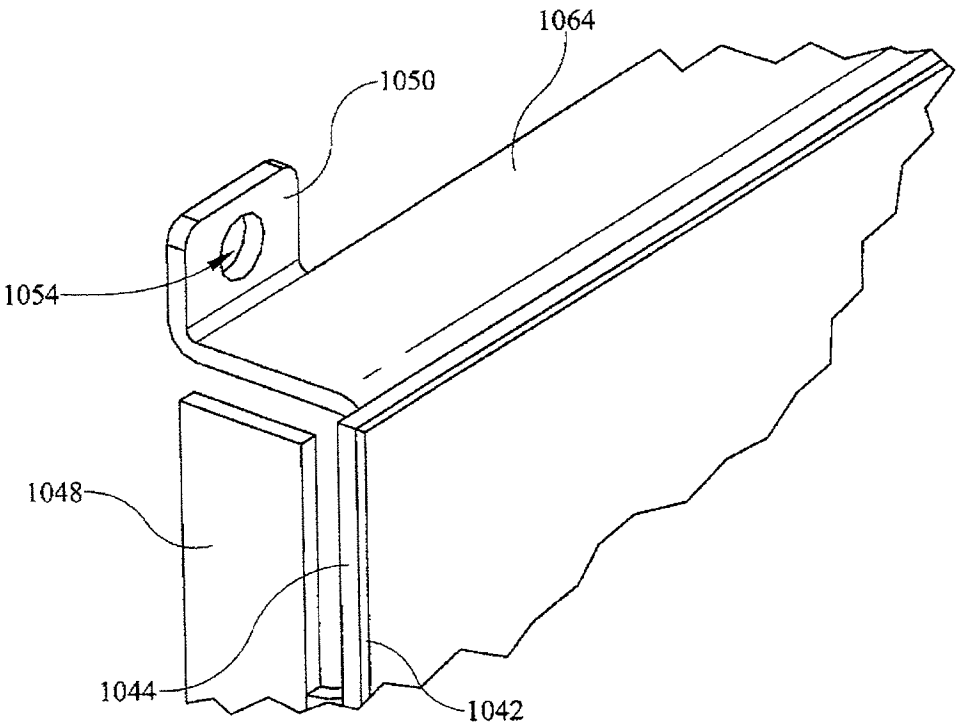
FIG. 38 is a perspective view of the panel of FIG. 37 enlarged to show the mounting of a facing to the support structure.

In an illustrative embodiment of a panel 1040 for covering receptacles mounted in a structure of a modular architectural room system disclosed herein is shown in FIG. 37. The panel 1040 is configured to be mounted to two columns 188 such that adjacent panels 1040 positioned in a side-by-side duration have little to no gap between the adjacent panels 1040. In the embodiment shown in FIG. 37, the panel 1040 includes a laminate facing 1042 mounted on a metal sheet 1044 (best seen in FIG. 38). The laminate facing 1042 covers any exposed fasteners used to secure the sheet 1044 to brackets 1046 and 1048 which are secured to the sheet 1044. Each panel 1040 includes two of the brackets 1046, one positioned along an upper edge as shown in FIG. 37 and a second bracket 1046 positioned along a lower edge and not visible in FIG. 37. The bracket 1046 includes a pair of tabs 1050 and 1052 with each tab 1050 and 1052 including an aperture 1054. The tab 1050 is positioned along an edge 1056 of the bracket 1046. The bracket 1052 is inset slightly from the opposite edge 1058. Thus, when a panel 1040 is positioned vertically above another panel 1040, the tab 1050 on a lower edge 1060 to the top panel 1040 is positioned adjacent the edge 1058 of the lower panel 1040 so that the tab 1050 of the upper panel 1040 is adjacent to the tab 1052 of the lower panel 1040.

Figure 39:
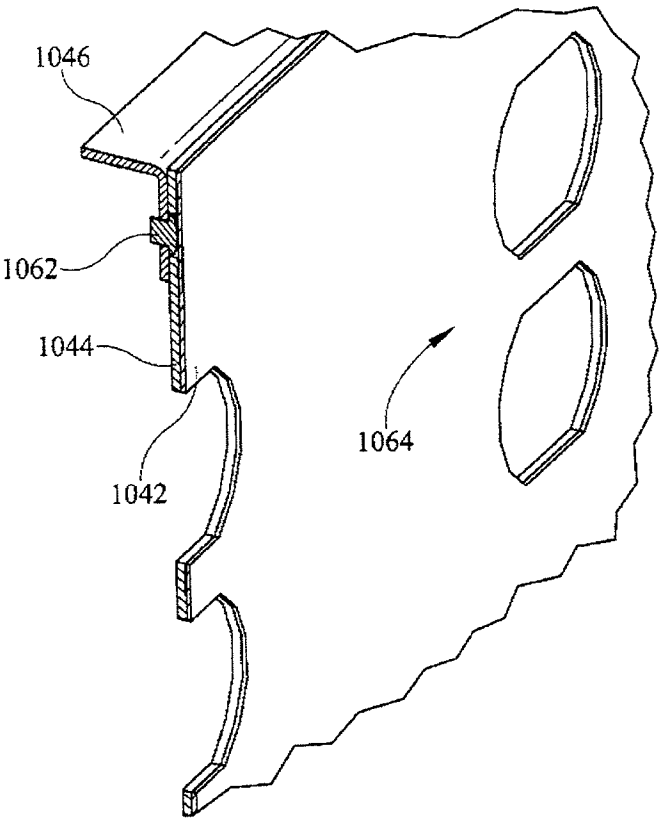
FIG. 39 is a cross-sectional view of a portion of the panel of FIG. 37 showing the fastening of a panel sheet to a bracket.

The bracket 1048 shown in FIG. 37 is secured to the sheet 1044 and butts against a bracket 1048 of a laterally adjacent panel 1040 when two panels 1040 are positioned in a side-by-side configuration. The sheet 1044 is secured to brackets 1046 and 1048 as shown in FIG. 39. The sheet 1044 includes a countersunk aperture through which a fastener 1062 secures the sheet 1044 to the bracket 1046. The sheet 1044 is coupled to the bracket 1048 in a similar manner. The facing 1042 is applied to the panel 1040 after the brackets 1046 and 1048 are secured to the sheet 1044.

In some embodiments, the sheet 1044 may be formed to include the structures of brackets 1046 and 1048 integrally such that sheet 1044 and the pairs of brackets 1046 and 1048 are a unitary structure. When so formed, the facing 1042 may be applied prior to the forming process such that the openings 1064 for electrical power outlets 80 and opening 1066 for data receptacles 1036 are formed through the facing 1042 and the sheet 1044 in one operation, eliminating the need to fit the facing 1042 to the sheet 1044 to align the openings 1064 and 1066.

Figure 48:
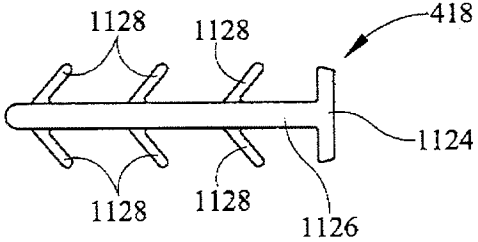
FIG. 48 is a side view of a third embodiment of a molding used to fill gaps between adjacent panels of the modular architectural room systems of the present disclosure.
Figure 49:
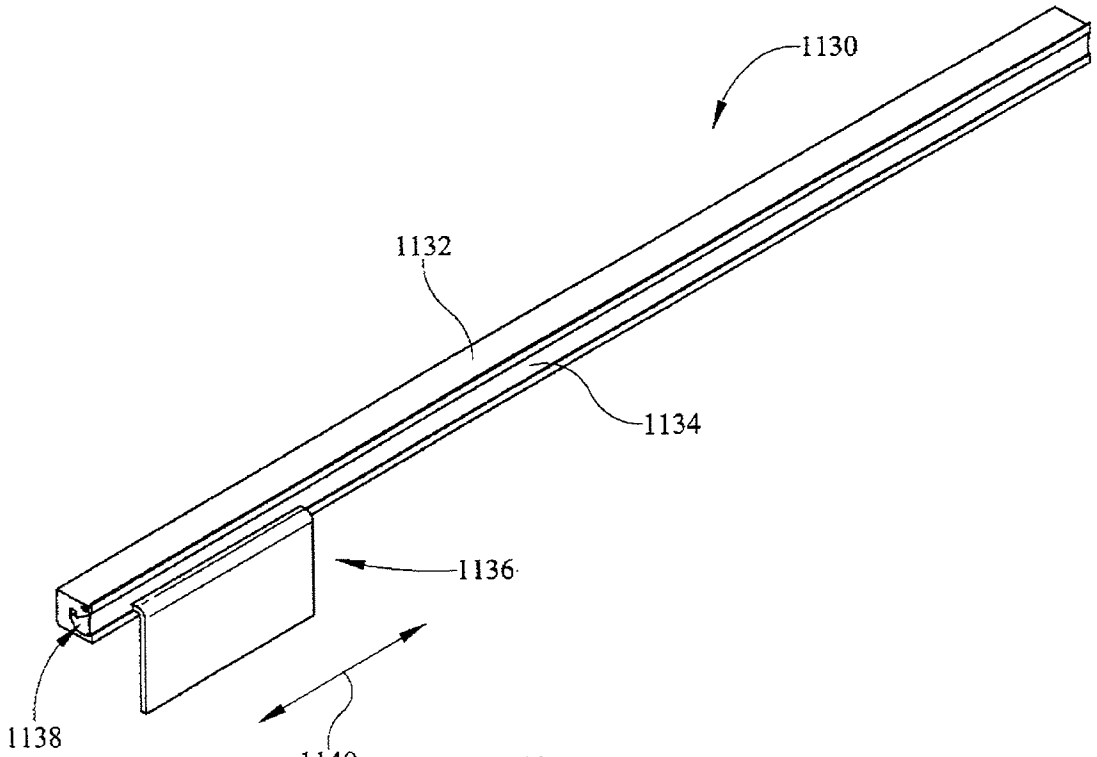
FIG. 49 is a perspective view of an adjustable accessory support rail, the support rail configured to be mounted to the modular architectural room systems of the present disclosure.
Figure 50:
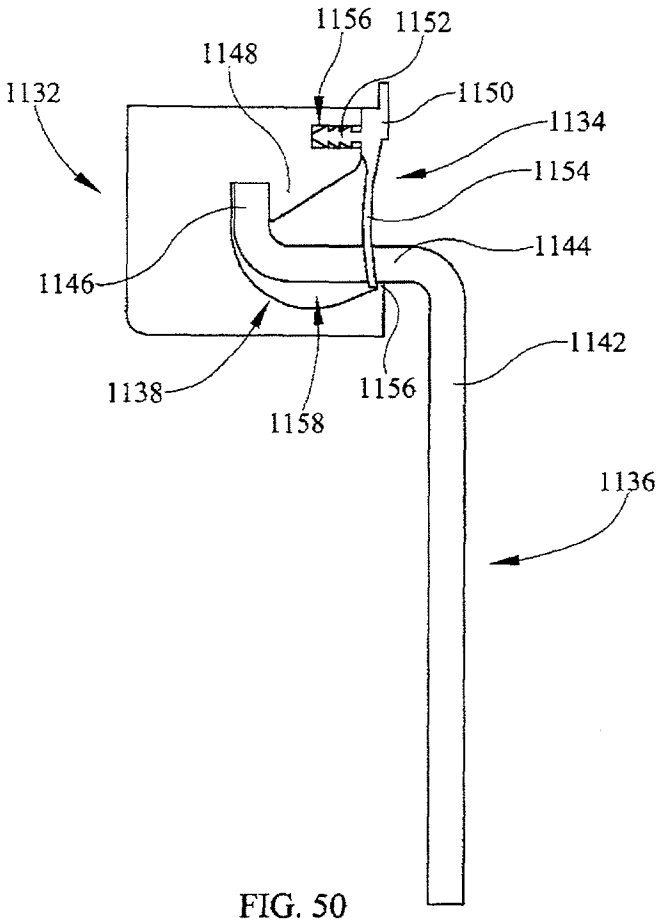
FIG. 50 is a side view of the adjustable accessory support rail in FIG. 49.

A mounting rail 1070 shown in FIGS. 48-50 is another embodiment similar to the embodiment of mounting rail 1034 discussed above. The mounting rail 1070 is configured to engage two spaced apart columns 188 to secure the rail 1070 to the columns 188 without the need for additional fasteners. The rail 1070 is configured to receive gas outlets 90 and electrical power outlets 80 to support the electrical power outlets 80 and gas outlets 90. The rail 1070 is formed from a unitary sheet of metal and includes a face 1072, an upper flange 1074, and a lower flange 1076, the flanges 1074 and 1076 extending perpendicularly away from the face 1072. The rail 1070 also includes a mounting flange 1078 positioned at one end of the face 1072 and extending generally perpendicularly away from the face 1072 in the same direction as the upper and lower flanges 1072 and 1074. A second mounting flange is positioned at the opposite end of the face, but is not visible in the figures.

Figure 42:
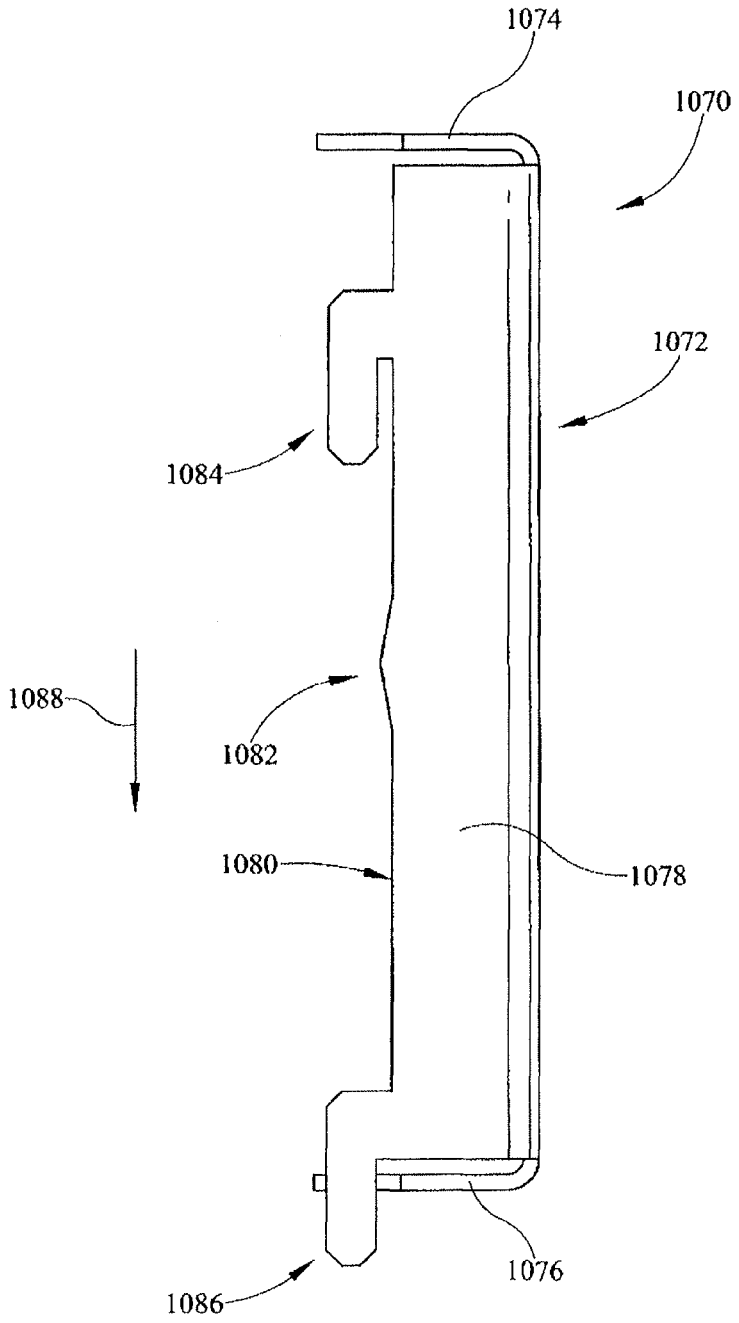
FIG. 42 is a side view of the mounting rail of FIG. 41.
Figure 43:
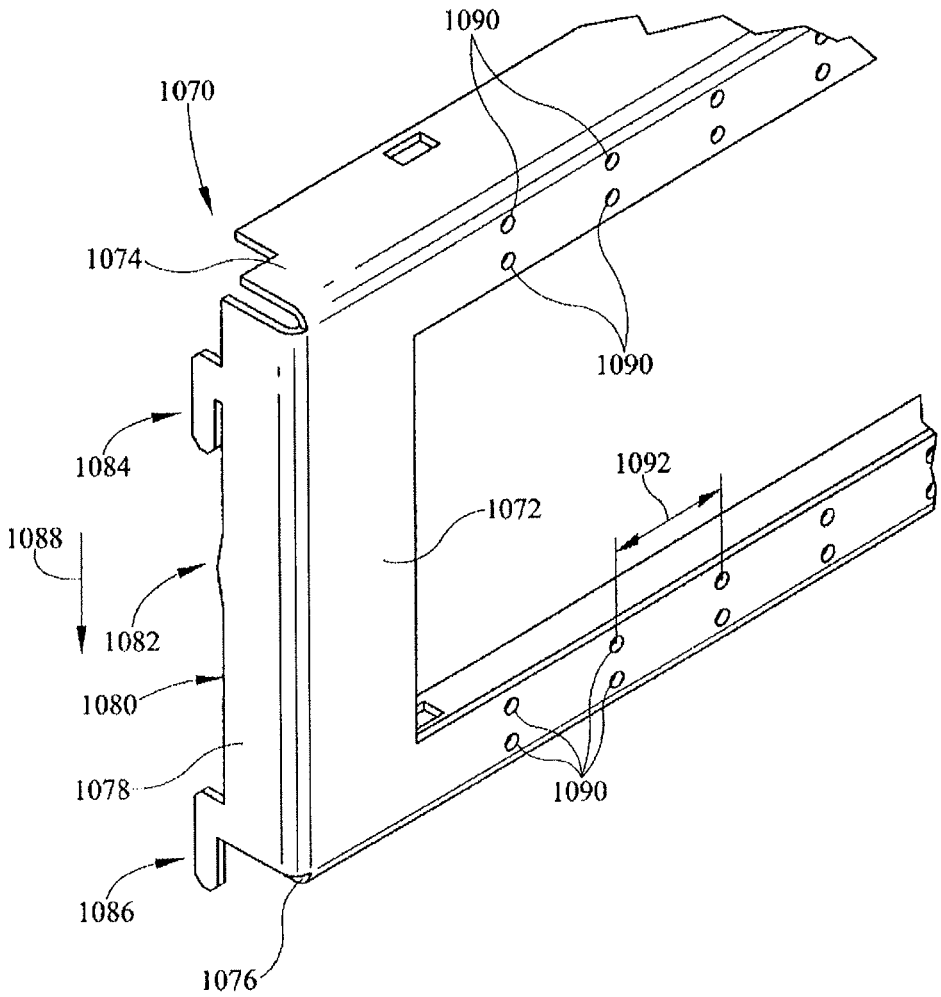
FIG. 43 is an enlarged perspective view of the mounting rail of FIG. 41 with portions removed.

The mounting flange 1078 is formed with an edge 1080 positioned at the rear of the flange 1078. A detent 1082 is formed in the edge 1080 and engages a square-shaped through-hole 328 in a column 188 as will be described below. The flange 1078 is also formed to include a pair of downwardly extending tabs 1084 and 1086 which are spaced apart by an interval that is equal to the interval between two slotted holes 324 in a column 188. To assemble the rail 1070 to a pair of columns 188, the tabs 1084 and 1086 on each of the mounting flanges 1070 are inserted into the respective slotted holes 324. The detent 1028 will engage the surface of the web of the column such that there is interference between the detent and the column 188. Moving the rail 1070 downwardly in the direction of the arrow 1088 in FIG. 42 engages the tabs 1084 and 1086 with the web 306 of the column 188. When the rail 1070 is in the proper position, the detent 1082 engages a square-shaped through-hole 328 of the column 188 as a detent to resist movement of the rail 1070 relative to the column 188.

The rail 1070 includes a plurality of holes 1090 formed in the face 1072. The holes 1090 are formed in two rows above and two rows below an opening 1092 in the face 1072. The columns of holes 1090 are aligned vertically such that four holes 1090 are in each column. The columns are spaced by a distance 1092. The holes 1090 are used to mount components such as gas outlets 90 and electrical power outlets 80. The spacing 1092 is half of the standard spacing for electrical outlets. This permits a user to evenly space an even or an odd number of electrical power outlets 80 and gas outlets 90 across the distance of the rail 1070. This spacing convention may be applied to any of the mounting structures disclosed herein.

Figure 44:
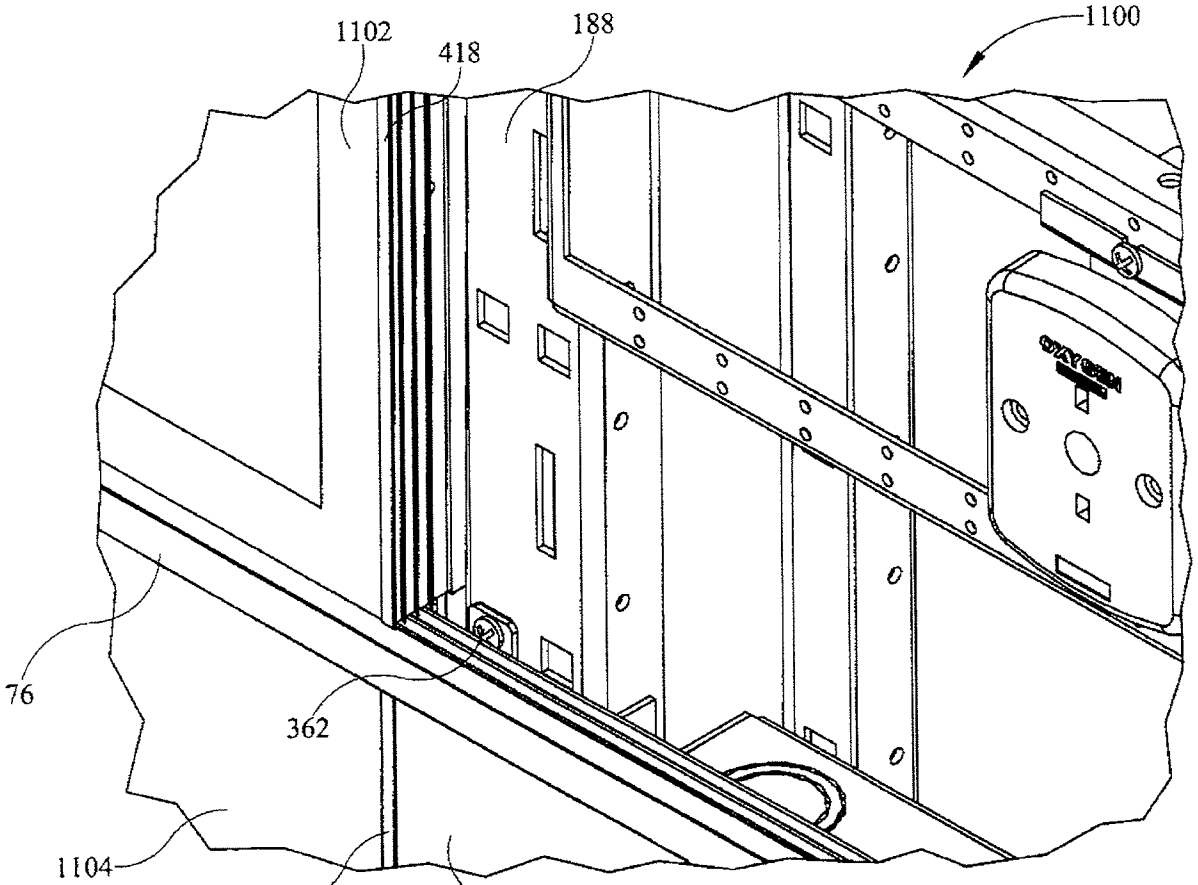
FIG. 44 is a perspective view of a portion of a modular architectural room system according to the present disclosure, the system having a panel omitted to expose molding strips used to fill gaps between adjacent panels.
Figure 45:
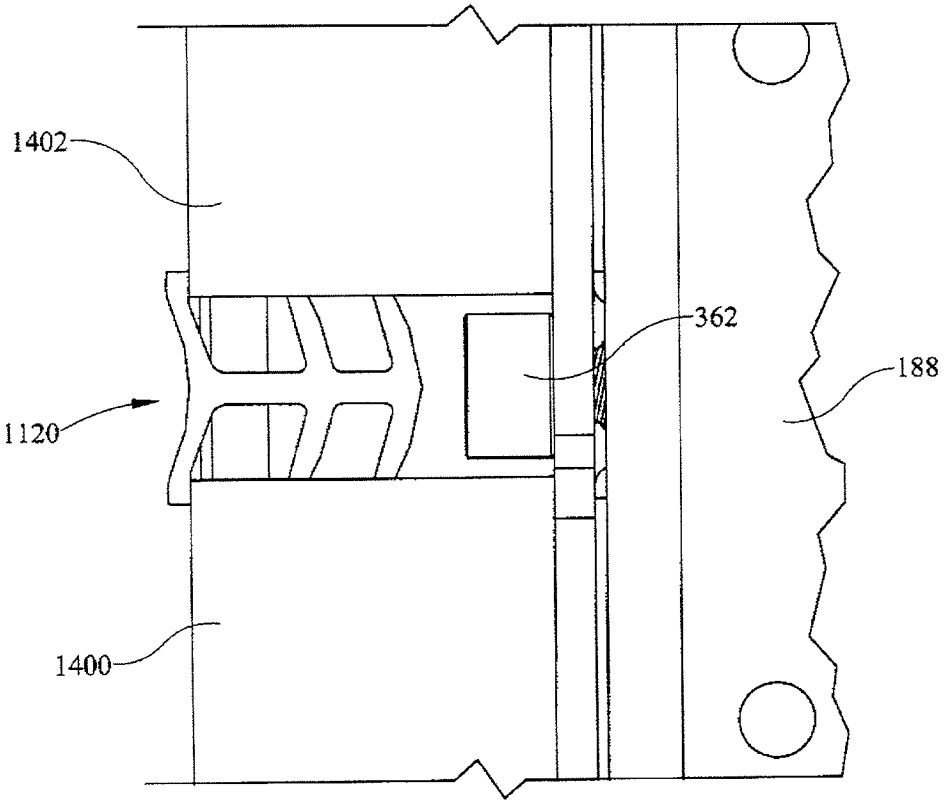
FIG. 45 is a side view of a portion of a modular architectural room system with a molding positioned in a gap between adjacent panels to cover fasteners used to secure the panels to a column of a support structure of the system.
Figure 47:
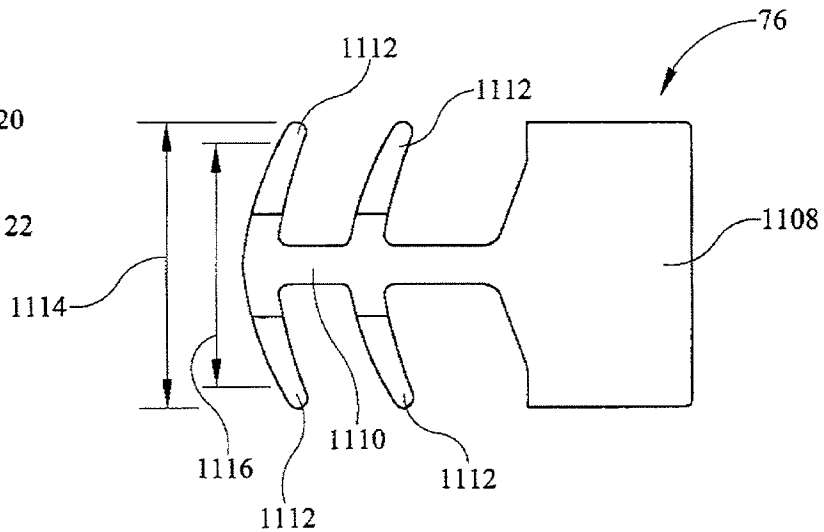
FIG. 47 is a side view of a second embodiment of a molding used to fill gaps between adjacent panels of the modular architectural room systems of the present disclosure.
Figure 46:
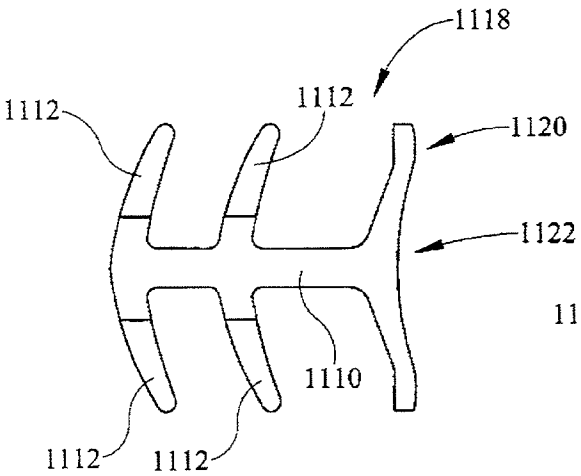
FIG. 46 is a side view of a first embodiment of a molding used to fill gaps between adjacent panels of the modular architectural room systems of the present disclosure.

Depending on the arrangement of the panels and accessory supports mounted on the modular architectural rooms systems of the present disclosure, gaps may be formed between adjacent structures. According to the present disclosure, moldings, such as the horizontal molding 76 or vertical molding 418, may be used to fill the gaps. An illustrative portion of a system 1100 shown in FIG. 44 is a perspective view of an intersection of four panels with one of the panels removed for clarity. A first panel 1102 is positioned vertically above a second panel 1104 with a gap between the panels 1102 and 1104 filled with a horizontal molding 76. The horizontal molding 76 extends beyond the panels 1102 and 1104 and runs above a third panel 1106. A fourth panel, horizontally adjacent panel 1102 and vertically above panel 1106, is removed to show the horizontal molding 76. A vertical molding 418 is positioned between horizontally adjacent panels 1104 and 1106. Another vertical molding 418 is positioned adjacent the first panel 1102 and the omitted panel.

Referring to FIG. 54, the horizontal molding 76 includes a head 1108 and a shank 1110 which extends from the head 1108. A number of barbs 1112 extend outwardly from the shank 1110 and are configured to engage surfaces of adjacent panels to frictionally secure the horizontal molding 76 in place. The horizontal molding 76 is easily removed by pulling on the head 1108 to remove the horizontal molding 76 from the gap. The barbs 1112 extending from opposite sides of the shank 1110 define a first width 1114. When the horizontal molding 76 is inserted into a gap, the barbs 1112 deflect to define a second width 1116 narrower than the first width 1114. The barbs 1112 are biased due to deflection of the barbs 1112 when the barbs 1112 are inserted into a gap between panels. The bias urges the barbs 1112 against the panels to frictionally retain the barbs 1112 in the gaps.

The horizontal molding 76 has a first configuration with the head 1108 being oversized and providing a visual effect that mimics a reveal about the adjacent panels. This provides an aesthetic effect while reducing issues of cleanability and infection control. Another molding 1118 has a similar shank 1110 and barb 1112 structure as the horizontal molding 76, but has a head 1120 which includes a depression 1122 to provide a visual effect different from the effect of the horizontal molding 76.

Figure 52:
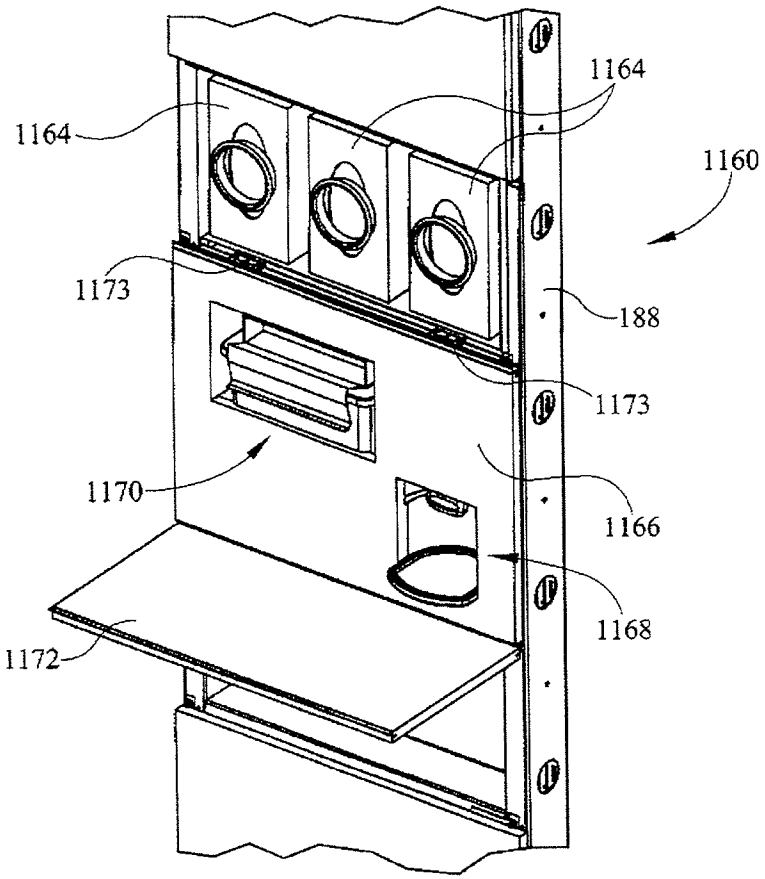
FIG. 52 is a perspective view similar to FIG. 51 with a panel removed to show the hinge structure used in the embodiment shown in FIG. 51.

The molding 418 is shown in FIG. 48 and has a similar shank and barb structure to the horizontal moldings 76 and 1118, but is configured to fill a narrower gap. The molding 418 includes a head 1124 and a shank 1126 which extends from the head 1124. A number of barbs 1128 extend outwardly from the shank 1126 and are configured to engage adjacent panels to frictionally retain the molding 418 in a gap. The moldings 76, 418 and 1118 are illustrative only. Any of a number of head configurations may be used to vary the visual effect of an installed molding. Also, while the horizontal molding 76 is referred to as a horizontal molding and molding 418 is referred to as a vertical molding, either molding and variations of the moldings may be used to fill gaps filled between adjacent panels in a modular architectural room system. The molding 1120 is shown positioned between two panels 1400 and 1402 in FIG. 52.

An accessory support assembly 1130 shown in FIGS. 49 and 50 is configured to be mounted in a gap between panels or on a support structure such as the support bar 1026 of FIG. 34. The accessory support assembly 1130 includes a body 1132 and a molding 1134 secured to the body 1132 to cover a channel 1138 into which a support frame 1136 is inserted. The support frame 1136 is retained in the channel 1138 and movable along the body 1132 within the channel to be repositioned along the body 1132 as suggested by the arrow 1140 in FIG. 56.

Referring now to FIG. 57, the support frame 1136 includes a mounting plate 1142 onto which accessories may be mounted. In some embodiments, mounting plate 1142 may be formed with mounting holes to mount an accessory. In other embodiments accessories may be clamped to mounting plate 1142. The support frame 1136 also includes a support arm 1144 which extends from the mounting plate 1142. A catch 1146 extends from the support arm 1144 and is configured to engage a lip 1148 of the body 1132 to retain the support frame 1136 relative to the body 1132. The support frame 1136 is engaged with the body 1132 by extending the catch 1146 and a portion of the support arm 1144 into the cavity 1138 with the support frame 1136 rotated slightly from the engaged position shown in FIG. 57. The mounting plate 1142 is then rotated downwardly such that catch 1146 is received behind the lip 1148 of the body 1132. The support arm 1144 engages a support 1156 of the body 1132 so that the lip 1148 reacts against the catch 1146 and the support 1156 reacts against the support arm 1144 to retain the support frame 1136 on the body 1132.

The channel 1138 is formed so that a clearance space 1158 provides sufficient clearance for the catch 1146 and the support arm 1144 when the support frame 1136 is inserted into the body 1132. The molding 1134 includes a head 1150 and a barbed shank 1152 that extends from the head 1150. The shank 1152 is inserted into a channel 1156 formed in the body 1132. The shank 1152 frictionally retains the molding 1134 in a manner similar to the manner in which moldings 76, 418, and 1118 are retained as described above. The molding 1134 includes a shroud 1154 which extends downwardly to enclose channel 1138 formed in the body 1132. The shroud 1154 reduces the potential for contamination to enter and accumulate in the channel 1138. The shroud 1154 deflects when the support frame 1136 is engaged with the body 1132. Lifting the mounting plate 1142 disengages the catch 1146 from the lip 1148 and allows the support frame 1136 to be slid along the support 1156 of the body 1132 to a new location. Lowering the mounting plate 1142 re-engages the catch 1146 with the lip 1148 to secure the support frame 1136 in a new location.

Figure 51:
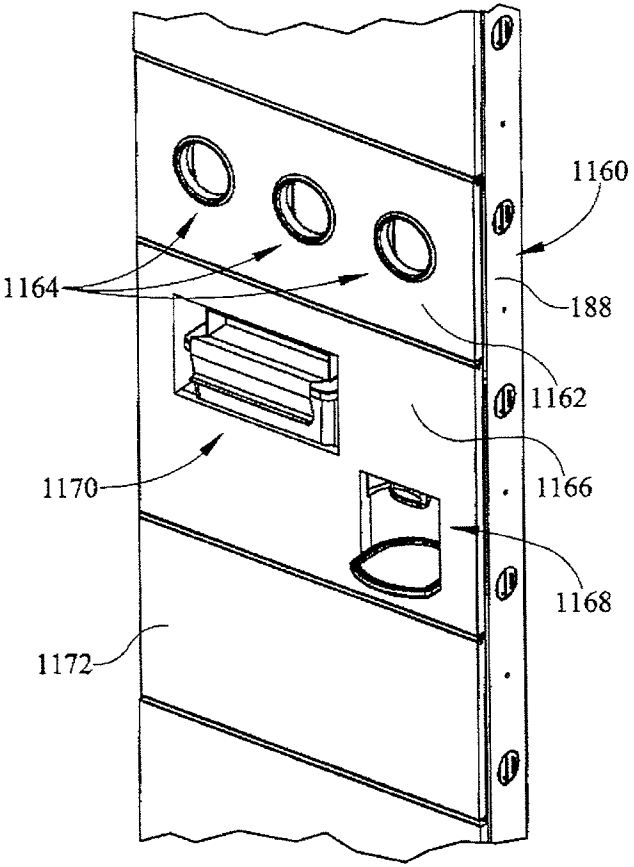
FIG. 51 is a perspective view of a portion of a modular architectural room system having panels which are movable to expose a storage space within the support structure.

In some embodiments, panels of modular architectural room systems may pivot to expose a storage space. For example, a portion 1160 of a modular architectural room system shown in FIGS. 51 and 52 includes a panel 1162 covering three storage containers 1164 is configured to provide access to the storage containers 1164 through the panel 1162. Similarly, a panel 1166 provides access to a sharps disposal 1170 and a hand sanitizer dispenser 1168 through the panel 1168. Yet another panel 1172 is pivotable upwardly to expose a storage space behind the panel 1172 as shown in FIG. 60. The panel 1162 and other portions of the structure of portion 1160 are omitted in FIG. 60 to show a pair of hinges 1173 which support the panel 1166 to allow the panel 1166 to pivot relative to the remainder of the portion 1160 to expose the disposal 1170 and dispenser 1168.

Figure 20:
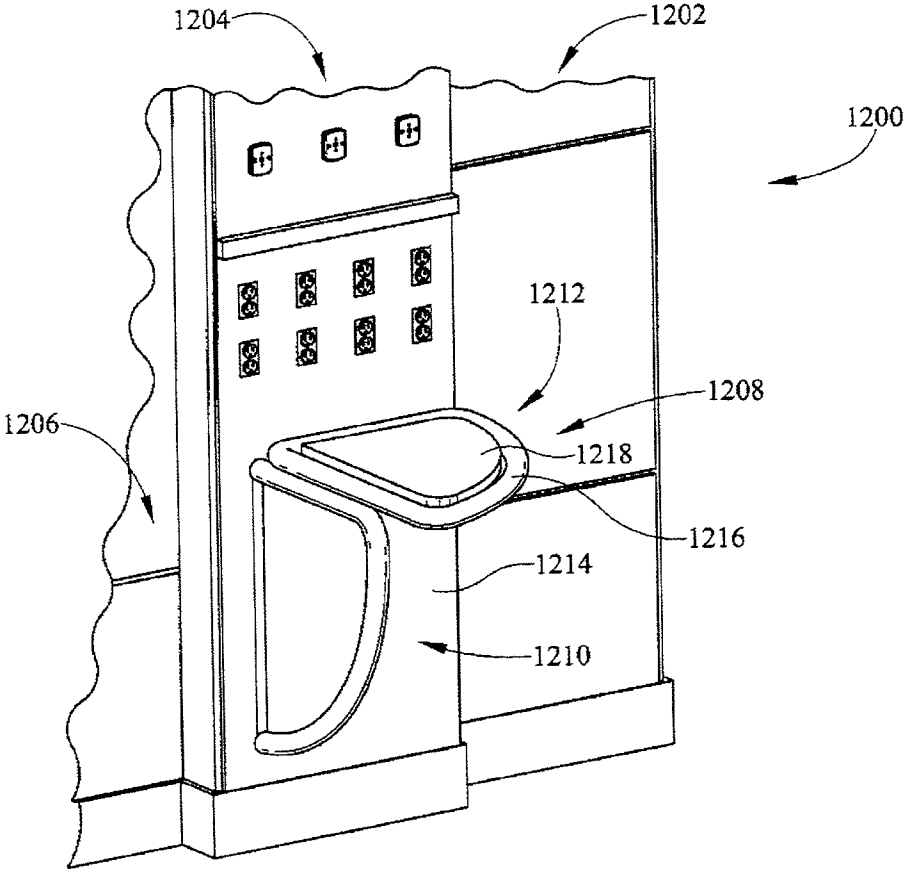
FIG. 20 is a perspective view of a portion of a modular architectural room system, the system including a handrail structure extending outwardly from a panel and configured used by a patient when exiting a bed.

The modular nature of the structures disclosed herein and the use of equipment supports such as support bar 1026 allow the systems of the present disclosure to be configured to provide patient supports used during movement about a room. For example, a portion of a modular architectural room system 1200 is shown in FIG. 20 to include a support 1208 mounted to a panel 1214. The modular architectural room system 1200 includes a tertiary region 1202, an accessory region 1204, and a bed region 1206. The support 1208 includes a horizontal platform 1212 supported on a bracket 1210. Both the bracket 1210 and the platform 1212 are secured to a structure in the accessory region 1204. The platform 1212 includes a grip rail 1216 which may be used by a patient to assist the patient in moving about a room. The platform 1212 also includes a table 1218 which is positioned in the accessory region 1204 such that the table 1218 may serve as a bedside table when a patient support apparatus is positioned in the bed region 1206.

Figure 21:
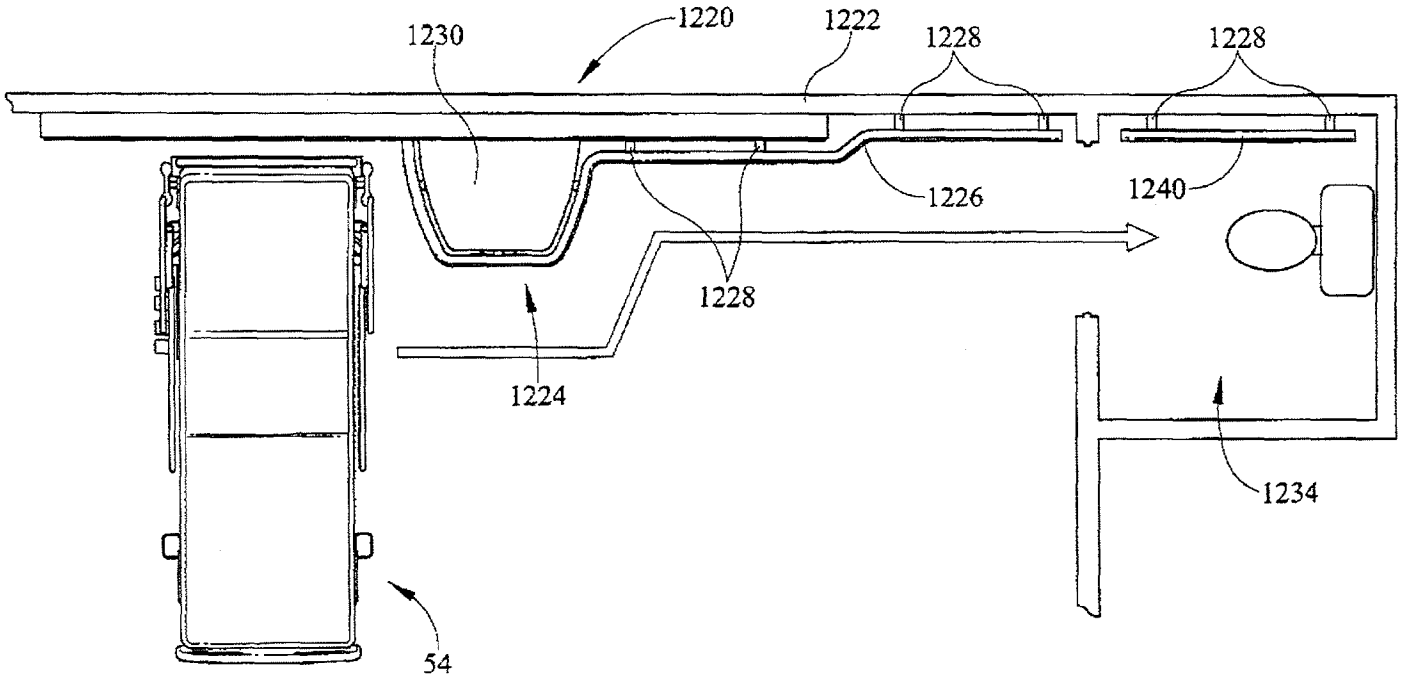
FIG. 21 is a top plan view of a portion of a patient room including a modular architectural room system supporting a support rail for a patient walking from a bed to another part of the patient room.
Figure 22:
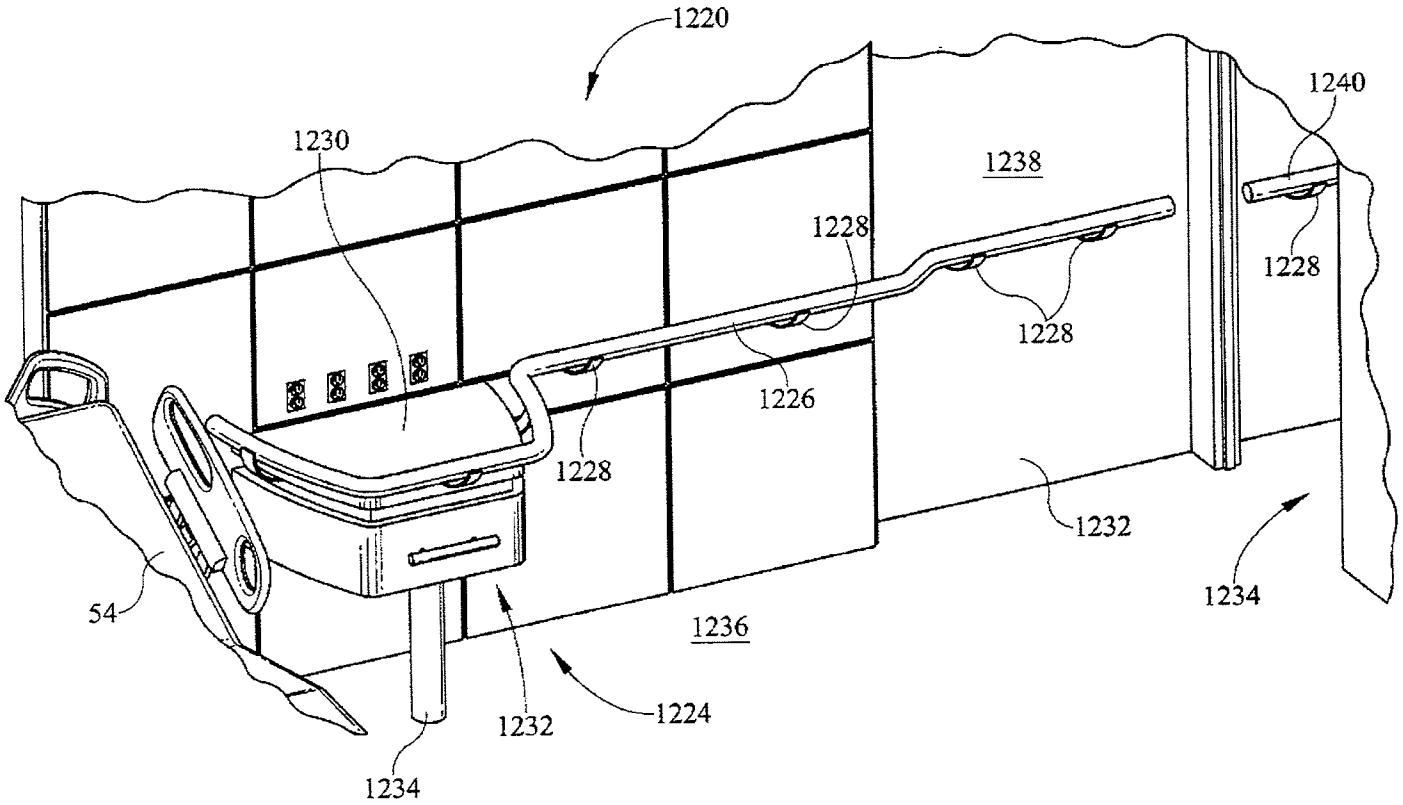
FIG. 22 is a perspective view of a portion of the modular architectural room system of FIG. 21.

In another embodiment shown in FIGS. 21 and 22, a surface mounted modular architectural room system 1220 is mounted to a studded wall 1222 and includes a storage system 1224 and a support rail 1226 supported from the storage system as shown in FIGS. 21 and 22. The storage system 1224 is a cabinet having a drawer 1232 and a table 1230 supported on the cabinet. The storage system 1224 also includes a support leg 1234 extending downwardly from the drawer to provide additional support to the storage system 1224.

The support rail 1226 is supported by brackets 1228 coupled to the storage system 1224, the structure of the modular architectural room system 1220, and the wall 1232. The support rail 1226 is positioned to be used by a patient when moving form the patient support apparatus 54 to another portion of the patient room. In the embodiment shown in FIGS. 21 and 22, the support rail 1226 is configured to be used by a patient moving to a restroom 1234. The restroom 1234 shares the wall 1222 and a second support rail 1240 is mounted on brackets 1228 secured to the wall 1222 within the restroom 1234.

In yet another embodiment, a modular architectural room system 1250 is configured to include a bed region 1252 and two accessory regions 1254 and 1256. A cabinet 1258 is supported on the modular architectural room system 1250 and movable relative to the modular architectural room system 1250. The cabinet 1258 includes a pivot column 1259 which is secured to the modular architectural room system 1250. The cabinet 1258 also includes support leg 1260 which engages the floor of the patient room to support the cabinet 1258.

Figure 23:
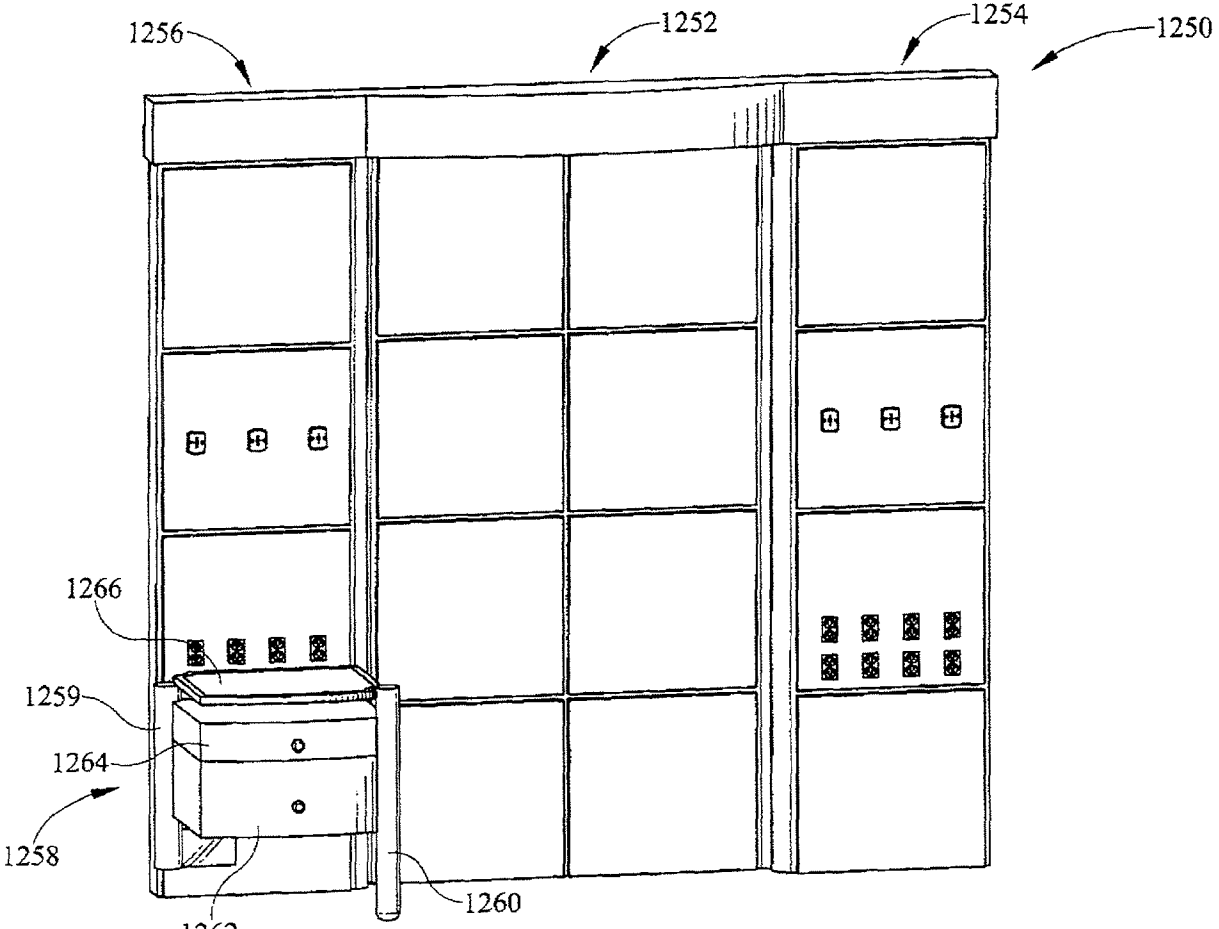
FIGS. 23-25 are perspective views of a storage structure supported from a modular architectural room system and movable relative to the modular architectural room system.
Figure 24:
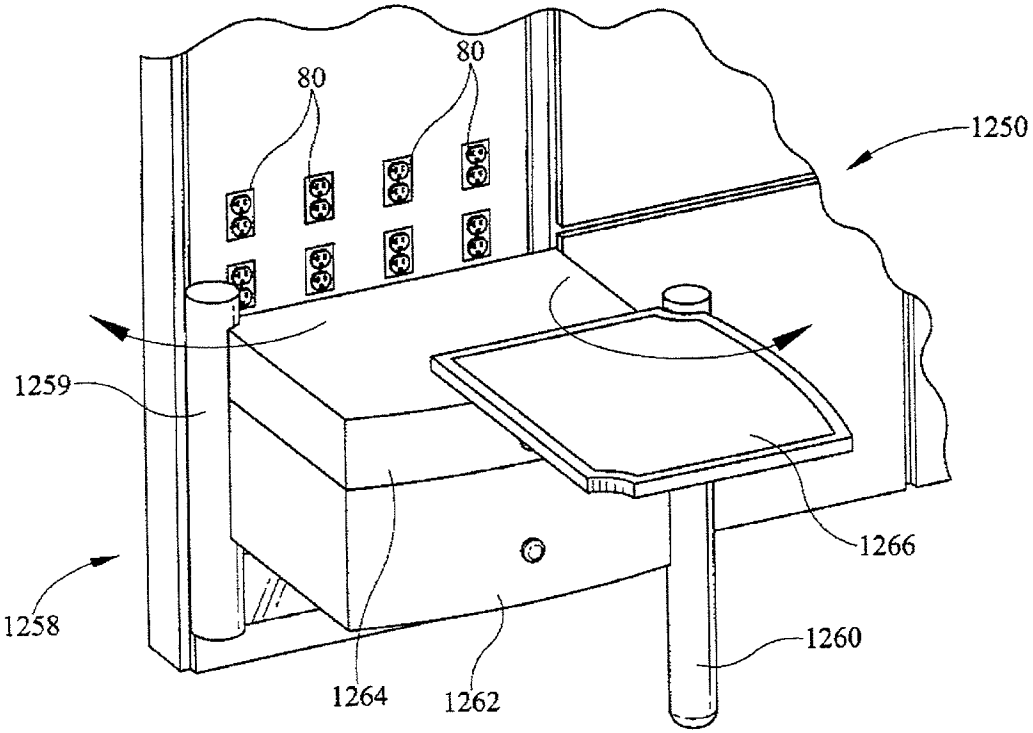
Figure 25:
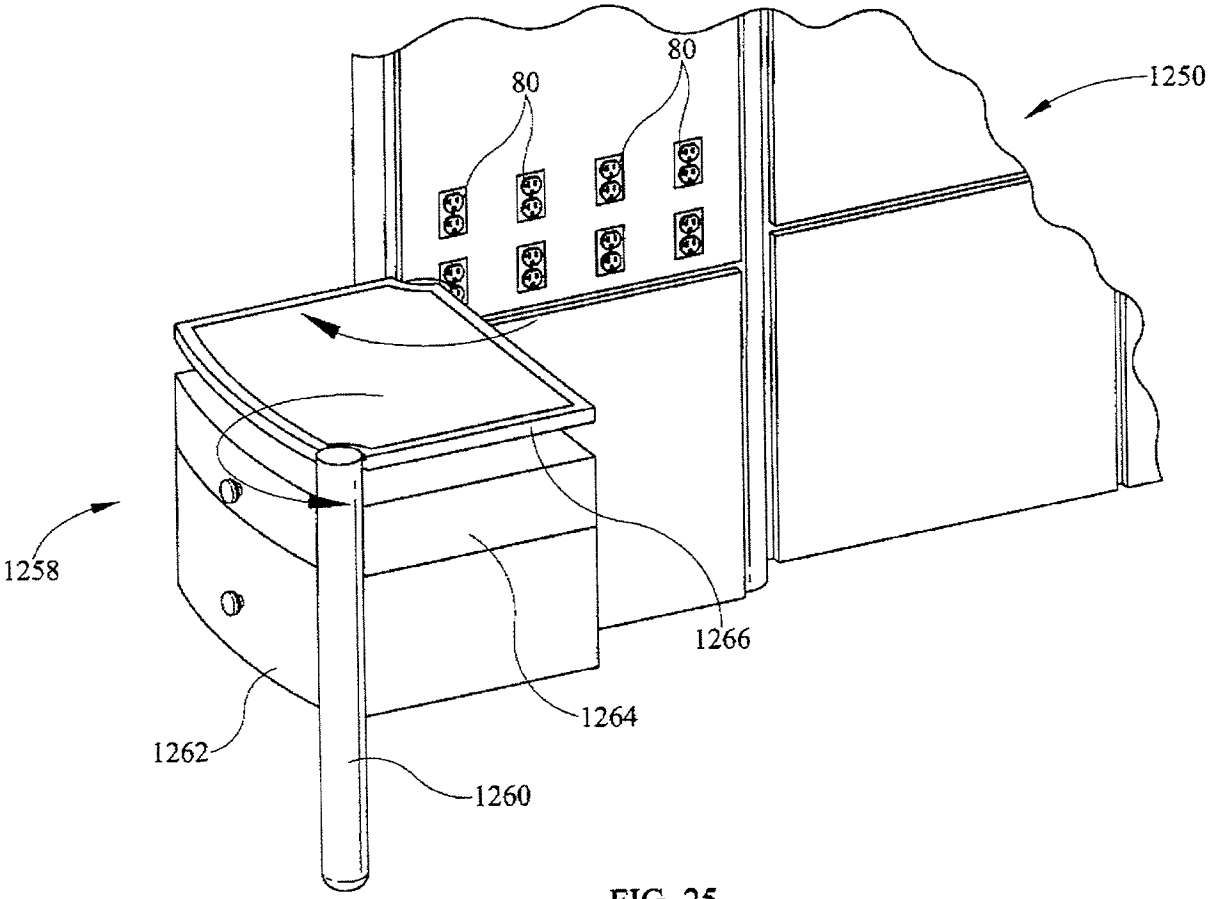

The cabinet further comprises two drawers 1264 and 1268. A table 1266 is supported on the support leg 1260 and is pivotable relative to the support leg 1260 between a first position shown in FIG. 23 and a second position shown in FIG. 24. In the second position, the table 1266 is positioned to be immediately adjacent a patient support apparatus when the patient support apparatus is positioned in the bed region 1252 of the system 1250. The cabinet 1258 is pivotable relative to the system 1250 between a first position shown in FIG. 23 and a second position shown in FIG. 25. The pivot column 1259 is coupled to a support bar 1026 (not shown) of the modular architectural room system 1250. Movement of the cabinet 1258 to the second position permits a user, such as a caregiver, to move the cabinet 1258 out of the way while attending to a patient.

Figure 26:
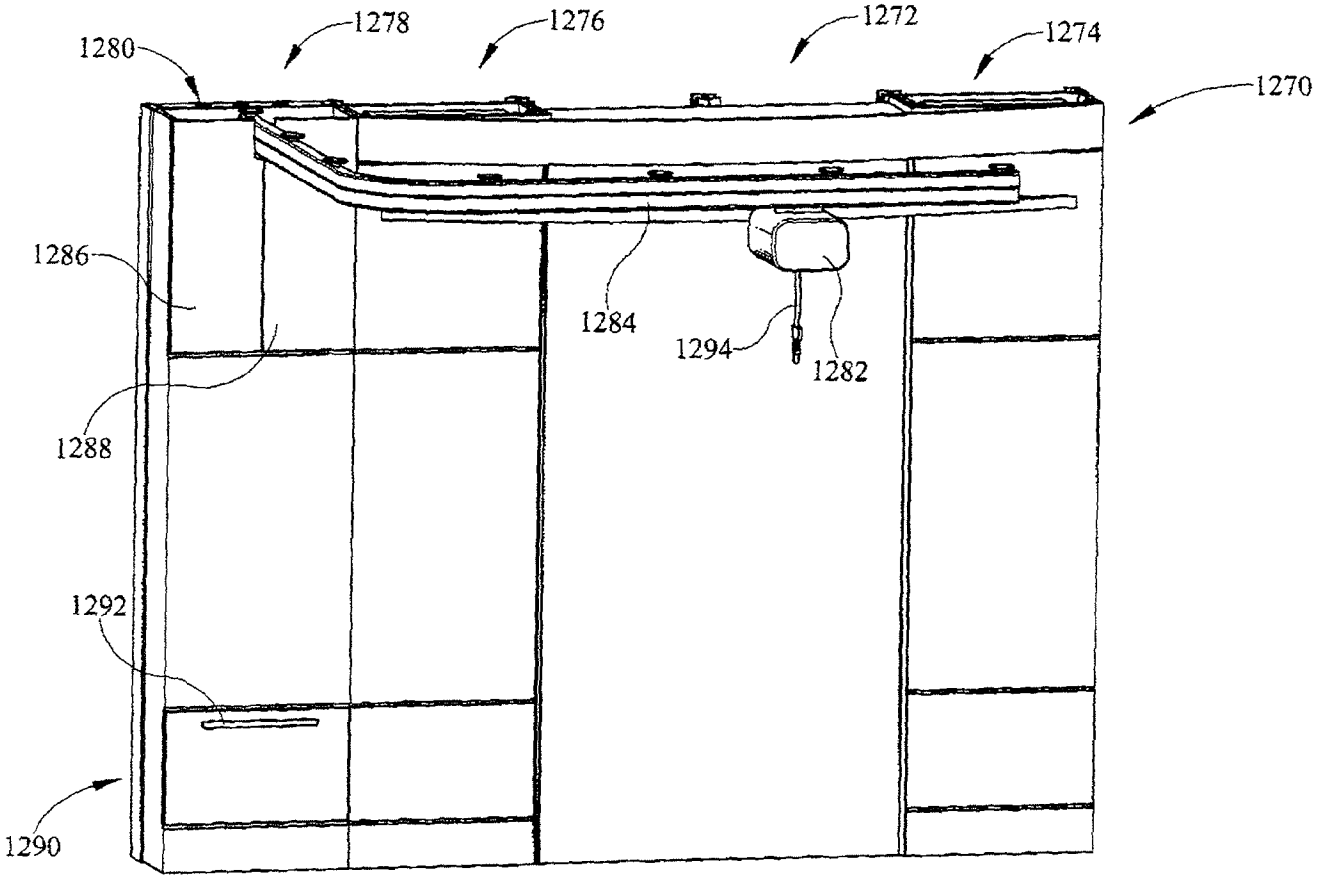
FIG. 26 is a perspective view of a modular architectural room system including a storage space for storing an accessory supported from a ceiling rail.

The structure of the modular architectural room systems disclosed herein may also provide storage for ceiling mounted accessories. In the embodiment shown in FIG. 26, a modular architectural room system 1270 is shown positioned in a room with a ceiling omitted to show details of the structure. The modular architectural room system 1270 includes a bed region 1272 and two accessory regions 1274 and 1276. The modular architectural room system 1270 further includes a tertiary region 1278 which includes a storage space 1280 configured to enclose a patient lift 1282 supported from a rail 1284. The rail 1284 is supported from a ceiling structure (not shown) and the patient lift 1282 moves along the rail 1284 between a storage position and a use position as shown in FIG. 26. The storage space 1280 includes two doors 1286 and 1288 which open to allow the patient lift 1282 to enter the storage space 1280. The doors 1286 and 1288 may be closed to hide the patient lift 1282. The modular architectural room system 1270 also includes a storage receptacle 1290 having a handle 1292 which is positioned and sized to store a harness (not shown) which couples to a tether 1294 of the patient lift 1282.

Figure 27:
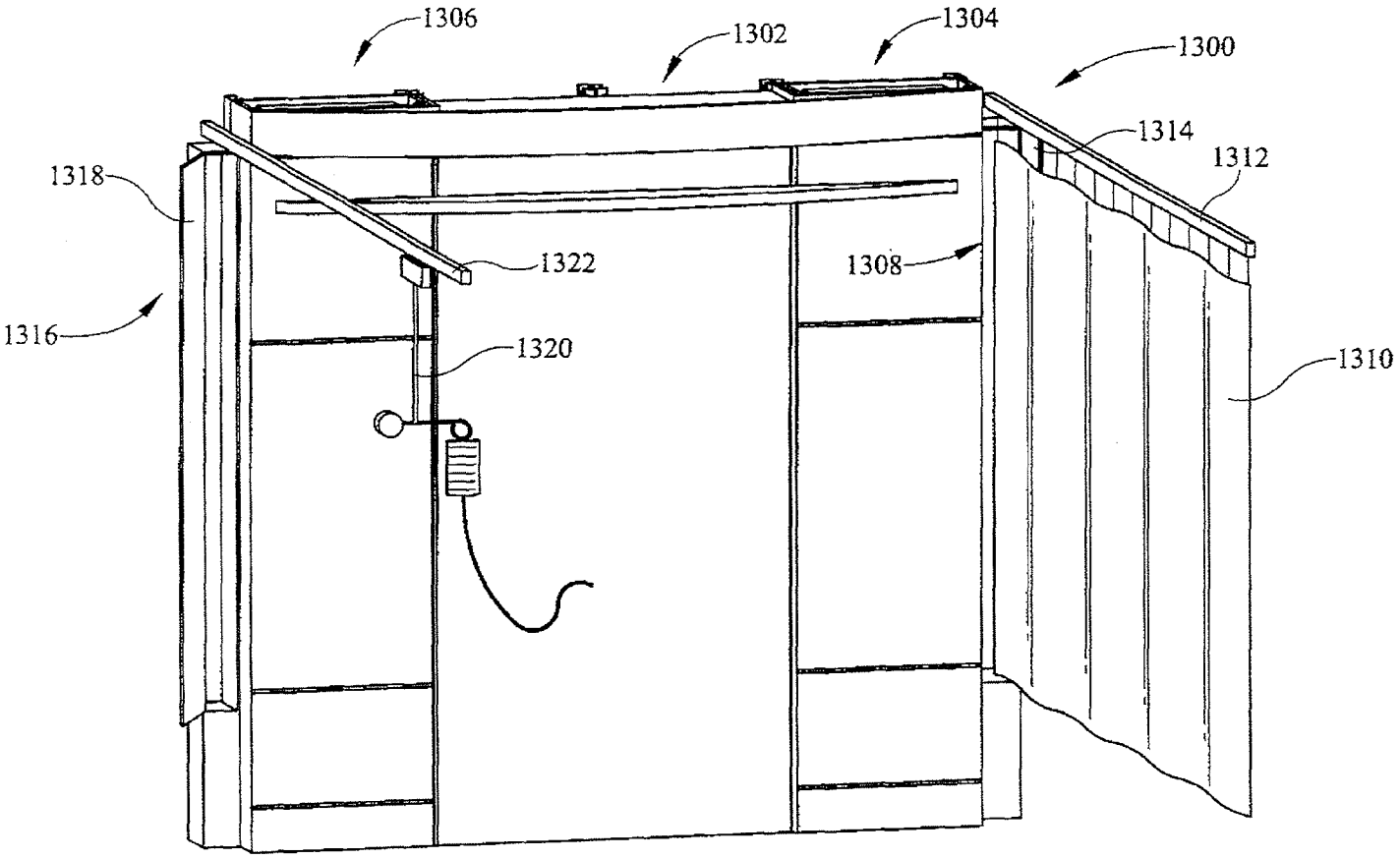
FIG. 27 is a perspective view of a modular architectural room system including storage receptacles for storing accessories supported from ceiling rails.

In another embodiment of a modular architectural room system 1300 shown in FIG. 27, the modular architectural room system 1300 includes a bed region 1302 and two accessory regions 1304 and 1306. The modular architectural room system 1300 further includes a storage receptacle 1308 positioned adjacent the accessory region 1304 and positioned to store a ceiling mounted privacy curtain 1310. The privacy curtain 1310 is supported on a ceiling mounted rail 1312. The curtain 1310 may be moved into the storage receptacle 1308 and a door 1314 of the receptacle 1308 may be closed to hide the curtain 1310. The system 1300 also includes a storage receptacle 1316 positioned adjacent the accessory region 1306. The storage receptacle 1316 includes a door 1318 and is positioned to store an IV hanger 1320 supported from a ceiling rail 1322.

Although certain illustrative embodiments have been described in detail above, variations and modifications exist within the scope and spirit of this disclosure as described and as defined in the following claims.

The invention claimed is:

1. A modular architectural wall comprising:

a modular frame structure including a plurality of columns and cross-members secured together by removable fasteners, the modular frame structure including a first side positioned to serve as a wall of a first room and a second side positioned to serve as a wall of a second room, a first plurality of panels secured to the first side of the modular frame structure, the first plurality of panels each having a surface facing the first room, the first plurality of panels removably secured to the first side of the modular frame structure such that the first plurality of panels is reconfigurable, a second plurality of panels secured to the second side of the modular frame structure, the second plurality of panels each having a surface facing the second room, the second plurality of panels removably secured to the second side of the modular frame structure such that the second plurality of panels is reconfigurable independently of the first plurality of panels, a plurality of service outlets mounted on the modular frame structure, wherein at least one panel of the first and second plurality of panels comprises a plurality of openings, wherein the plurality of service outlets are positioned behind the at least one panel, wherein each service outlet is aligned with an opening of the plurality of openings such that a portion of each service outlet is exposed through the opening, and a service delivery assembly positioned in a space, the space being defined between the first and second pluralities of panels, the service delivery assembly comprising at least one unused port; and wherein the wall is expandable by removing the at least one of the first or second pluralities of panels having the plurality of openings and replacing the at least one removed panel with a panel having at least one additional opening configured to receive at least one additional service outlet, wherein the at least one additional service outlet is in communication with the at least one unused port of the service delivery assembly.

2. The wall of claim 1, wherein the wall further comprises a molding removably secured to some of the first or second pluralities of panels, the molding having a head, a shank coupled to the head and extending perpendicular to the head, and a plurality of barbs extending outwardly from opposite sides of the shank, the plurality of barbs having ends separated by a first width, the molding positioned in a gap between adjacent panels such engagement with the adjacent panels causes the plurality of barbs to deflect inwardly toward the shank so that the ends of the plurality of barbs are separated by a second width, and the second width is less than the first width.

3. The wall of claim 1, wherein at least one of the first or second pluralities of panels is an outlet enclosure including a number of mount holes formed in the surface facing the first room and a number of through-holes formed in an upper surface perpendicular to the surface facing the first room, the mount holes arranged to mount electric outlets and data receptacles to the outlet enclosure.

4. The wall of claim 3, wherein the plurality of columns include evenly spaced slotted through-holes and the outlet enclosure includes a number of downwardly extending tabs which are spaced apart by an interval that is equal to the interval between the slotted through-holes and configured to extend through the slotted through-holes.

5. The wall of claim 4, wherein the columns include evenly spaced square-shaped through holes positioned between the slotted through-holes and fasteners extend through one of the first or second pluralities of panels and the square-shaped through-holes to removably fasten the panel to the modular frame structure.

6. The wall of claim 3, wherein the columns and cross-members are formed to include evenly spaced and fixed through-holes and a flexible conduit passes through at least one of the through-holes.

7. The wall of claim 6, wherein at least one of the first or second plurality of panels is configured to cover the outlet enclosure.

8. The wall of claim 1, wherein the wall further comprises a junction box supported by the modular frame structure and an electrical cable communicating electrical power from the junction box to at least one electrical power outlet.

9. The wall of claim 8, wherein the electrical cable passes through at least one through-hole formed in a column.

10. The wall of claim 1, wherein at least one of the first or second pluralities of panels includes a sheet and a face removably coupled to the sheet, the face formed to include a number of electrical outlet and data receptacle sized openings.

11. The wall of claim 1, wherein at least one of the first or second pluralities of panels is movable relative to the modular frame structure to expose a storage space located within the modular frame structure.

12. The wall of claim 11, wherein at least one of the first or second pluralities of panels pivots relative to the modular frame structure.

13. The wall of claim 11, wherein at least one of the first or second pluralities of panels slides relative to the modular frame structure.

14. The wall of claim 1, wherein the service outlet is a data receptacle in communication with a centralized information management system.

15. The wall of claim 1, wherein the wall is configured to be expanded by adding additional members to the modular frame structure.

16. The wall of claim 1, wherein the modular frame structure is positioned outside the boundaries of the wall.

17. A modular architectural room wall for a room in a healthcare facility having a wall, the wall comprising:

a modular frame structure including a plurality of columns and cross-members secured together by removable fasteners, the modular frame structure including a first side positioned to serve as a wall of a first room and a second side positioned to serve as a wall of a second room, a first plurality of panels secured to the first side of the modular frame structure, the first plurality of panels each having a surface facing the first room, the first plurality of panels removably secured to the first side of the modular frame structure such that the first plurality of panels is reconfigurable, a second plurality of panels secured to the second side of the modular frame structure, the second plurality of panels each having a surface facing the second room, the second plurality of panels removably secured to the second side of the modular frame structure such that the second plurality of panels is reconfigurable independently of the first plurality of panels, a service outlet mounted on at least one of the first or second pluralities of panels, and a gas manifold supported within the modular frame structure and a flexible conduit communicating gas from the gas manifold to the service outlet, the gas manifold including a number of unused ports configured to receive additional flexible conduits, wherein the wall is configured to be expanded by removing at least one of the first or second pluralities of panels and replacing the removed one of the first or second pluralities of panels with a panel having additional service outlets and additional flexible conduits communicating gas from the unused ports of the gas manifold to the additional service outlets.

18. The wall of claim 17, wherein at least one of the first or second pluralities of panels is coupled to the modular frame structure to move relative to the frame structure to expose a storage space located in the modular frame structure.

19. The wall of claim 17, wherein each of the first and second pluralities of panels includes a support bracket that couples each panel to at least one of the plurality of columns to cause the panel to be supported on the at least one of the plurality of columns before the removable fastener secures the panel to the modular frame structure.

20. The wall of claim 19, wherein the support bracket includes a main portion and a tab coupled to the main portion to extend generally perpendicularly away from the main portion and into a slotted hole formed in at least one of the plurality of columns.

* * * * *